US010143270B2

(12) United States Patent
Fiedler et al.

(10) Patent No.: US 10,143,270 B2
(45) Date of Patent: Dec. 4, 2018

(54) CLOSURE DEVICE FOR RELEASABLY CONNECTING TWO PARTS

(71) Applicant: Fidlock GmbH, Hannover (DE)

(72) Inventors: Joachim Fiedler, Hannover (DE); Breido Botkus, Kassel (DE)

(73) Assignee: Fidlock GmbH, Hannover (DE)

( * ) Notice: Subject to any disclaimer, the term of this patent is extended or adjusted under 35 U.S.C. 154(b) by 434 days.

(21) Appl. No.: 14/400,035

(22) PCT Filed: Dec. 12, 2013

(86) PCT No.: PCT/EP2013/076331

§ 371 (c)(1),
(2) Date: Nov. 10, 2014

(87) PCT Pub. No.: WO2014/090926

PCT Pub. Date: Jun. 19, 2014

(65) Prior Publication Data

US 2015/0135486 A1 May 21, 2015

(30) Foreign Application Priority Data

Dec. 14, 2012 (EP) ..... 12197363

(51) Int. Cl.
*A44B 11/25* (2006.01)
*A44B 99/00* (2010.01)
*A44B 11/26* (2006.01)

(52) U.S. Cl.
CPC ..... *A44B 11/2584* (2013.01); *A44B 11/2588* (2013.01); *A44B 11/26* (2013.01);
(Continued)

(58) Field of Classification Search
CPC ..... Y10T 24/32; Y10T 24/40; A44B 11/2584; A44B 99/00; A44B 11/26; A44B 11/2588; A44D 2203/00
See application file for complete search history.

(56) References Cited

U.S. PATENT DOCUMENTS 3,589,341 A * 6/1971 Krebs ..... A01K 27/005 119/865
5,008,984 A * 4/1991 Levy ..... A44C 5/2042 24/303

(Continued)

FOREIGN PATENT DOCUMENTS

DE 4312032 C2 4/1997
JP 2004121361 A 4/2004

(Continued)

*Primary Examiner* — Robert Sandy
(74) *Attorney, Agent, or Firm* — The Webb Law Firm

(57) ABSTRACT

A closure device for releasably connecting two parts. The closure device includes a first closure part and a second closure part, wherein for closing the closure device the first closure part is attachable to the second closure part and in a closed position is held at the second closure part, a first engaging protrusion of the first closure part and a second engaging protrusion of the second closure part, wherein for closing the first engaging protrusion can be brought in engagement with the second engaging protrusion in an engagement direction and in the closed position positively is in engagement with the second engaging protrusion, and a blocking element arranged at the second closure part. Between the first closure part and the second closure part a magnetic mechanism acts, which is formed to support the attachment of the first closure part to the second closure part by providing a force of magnetic attraction.

22 Claims, 54 Drawing Sheets

(52) U.S. Cl.
CPC ..... *A44B 99/00* (2013.01); *A44D 2203/00* (2013.01); *Y10T 24/32* (2015.01); *Y10T 24/40* (2015.01)

(56) References Cited

U.S. PATENT DOCUMENTS

| | | | | |
|---|---|---|---|---|
| 5,664,298 | A * | 9/1997 | Nessar-Ivanovic | A44C 5/2071 24/303 |
| 6,163,938 | A * | 12/2000 | Weber-Unger | A41F 1/002 24/303 |
| 6,857,169 | B2 * | 2/2005 | Chung | A44B 11/258 24/303 |
| 7,073,232 | B1 * | 7/2006 | Fuhrman | A44C 5/2042 24/303 |
| 2005/0150089 | A1 | 7/2005 | Benedict | |
| 2010/0283269 | A1 | 11/2010 | Fiedler | |
| 2011/0138583 | A1 * | 6/2011 | Fiedler | A44B 11/25 24/303 |
| 2012/0255144 | A1 * | 10/2012 | Gaudillere | A44B 11/266 24/303 |

FOREIGN PATENT DOCUMENTS

| | | | |
|---|---|---|---|
| JP | 2009050703 | A | 3/2009 |
| KR | 969916 | Y1 | 8/1995 |
| WO | 2008006355 | A2 | 1/2008 |
| WO | 2008006357 | A2 | 1/2008 |
| WO | 2012162711 | A1 | 12/2012 |

* cited by examiner

C-C

D-D (A-A)

(A-A)

(A-A)

(A-A)

(A-A)

(A-A)

(A-A)

(A-A)

(A-A)

(A-A)

(A-A)

(A-A)

(A-A)

(A-A)

(A-A)

CLOSURE DEVICE FOR RELEASABLY CONNECTING TWO PARTS

CROSS-REFERENCE TO RELATED APPLICATIONS

This application is the United States national phase of International Application No. PCT/EP2013/076331 filed Dec. 12, 2013, and claims priority to European Patent Application No. 12197363.0 filed Dec. 14, 2012, the disclosures of which are hereby incorporated in their entirety by reference.

BACKGROUND OF THE INVENTION

Field of the Invention

This invention relates to a closure device for connecting two parts.

Description of Related Art

Such closure device comprises a first closure part and a second closure part. The first closure part can be attached to the second closure part for closing the closure device and in a closed position is held at the second closure part. For closing the closure device, a first engaging protrusion of the first closure part can be brought in engagement with the second engaging protrusion in an engagement direction and in the closed position positively is in engagement with the second engaging protrusion. At the second closure part a blocking element furthermore is arranged, which during attachment of the first closure part to the second closure part is moved out of a normal position by cooperating with the first closure part, so that the first engaging protrusion can be brought in engagement with the second engaging protrusion in the engagement direction. During or after producing the engagement between the first engaging protrusion and the second engaging protrusion, the blocking element gets back into its normal position, so that in the normal position it blocks the positive engagement of the first engaging protrusion with the second engaging protrusion against the engagement direction.

In a closure device known from KR 20 1996 009 916 Y1, a closure part is fixed at an object via a fixing plate. The fixing plate includes openings which can be brought in engagement with engaging protrusions of the closure part. At the openings spring tongues are provided, which back away elastically during attachment of the closure part to the fixing plate and after establishing a positive connection of the engaging protrusions of the closure part with the edge of the openings of the fixing plate get back into their normal position, so that in the normal position they block a release of the engaging protrusions from their engagement.

In a closure known from DE 43 12 032 C2, a pin is arranged at a first closure part, which can be brought in engagement with an engagement cutout at a second closure part. During attachment, the pin pushes a blocking element aside, which after producing the engagement of the pin of the first closure part with the engagement cutout of the second closure part gets back into a normal position in which the engagement of the pin with the engagement cutout is blocked. For releasing the pin from the engagement cutout, the blocking element can be actuated, in order to release the pin and remove the same from the engagement cutout.

There is a need of closure devices which can be closed in a haptically pleasant, smooth way, in the closed position ensure a firm hold and hence a safe connection between parts to be connected, and in addition can be opened in a comfortable and easy way.

SUMMARY OF THE INVENTION

It is an object of the present invention to provide a closure device which provides for easy closing, a firm hold in the closed position, and easy opening.

According to an exemplary embodiment of the invention, in a closure device as mentioned above it is provided that between the first closure part and the second closure part magnetic mechanism are acting, which are formed to support the attachment of the first closure part and the second closure part by providing a force of magnetic attraction.

The present closure device provides an engaging protrusion each at two closure parts, which is formed in the manner of an undercut and in particular can rigidly be arranged at a base body of the respectively associated closure part. For closing the closure device, these engaging protrusions are brought in engagement with each other, wherein for this purpose the engaging protrusions must be moved past each other, until the first engaging protrusion can positively be pushed in engagement with the second engaging protrusion in the engagement direction. In the closed position, the engaging protrusions produce a firm hold of the closure parts at each other, so that the closure device can be subjected to high loads, without the closure parts separating from each other.

To exclude an undesired separation of the closure parts from each other in the closed position, a blocking element additionally is provided, which for example is formed as an elastic spring tongue arranged at a base body of the second closure part or as a blocking part resiliently arranged at the base body. During attachment of the first closure part to the second closure part, the blocking element backs away such that the first engaging protrusion of the first closure part can be pushed into engagement with the second engaging protrusion of the second closure part in the engagement direction. During attachment, the blocking element thus is pushed aside such that the first engaging protrusion can be guided into engagement with the second engaging protrusion. During or after production of the engagement, the blocking element gets back into its normal position and in this normal position blocks the positive engagement of the first engaging protrusion with the second engaging protrusion against the engagement direction. The hold of the first engaging protrusion at the second engaging protrusion and thus of the first closure part at the second closure part hence is secured, so that the closure device cannot be opened inadvertently.

In addition magnetic mechanism are provided, which for example are formed in the form of a magnet at the first closure part and a magnet at the second closure part or in the form of a magnet at one of the closure parts and a magnetic armature in the form of a component made of a ferromagnetic material at the other one of the closure parts. The magnetic mechanism act between the first closure part and the second closure part, in that during attachment of the first closure part to the second closure part they cooperate in a magnetically attracting manner and thus the first closure part is pulled into engagement with the second closure part with magnetic support.

The magnetic mechanism advantageously can be dimensioned such that the engagement of the first engaging protrusion with the second engaging protrusion largely is produced automatically during attachment of the closure parts to each other, and in particular the backing away of the blocking element during attachment of the closure parts to each other largely is effected automatically in a magnetically supported way. In this way, an easily closing closure is provided, in which for closing the closure parts merely must be attached to each other in a comparatively unprecise way and the actual closing of the closure then proceeds largely automatically in a magnetically supported way.

Advantageously, the engagement direction corresponds to a load direction, in which a load acts between the closure parts when the closure device is used properly. In particular, in the loaded condition a load advantageously acts on the first closure part, which pulls the first engaging protrusion into engagement with the second engaging protrusion in the engagement direction or at least loads the first engaging protrusion in the engagement direction, so that the engaging protrusion is securely held in engagement with the second engaging protrusion.

The blocking element can be realized for example by a blocking tongue arranged at a base body of the second closure part, which is formed to elastically back away from its normal position during attachment of the first closure part to the second closure part in a direction transverse to the engagement direction and again get back into its normal position during or after production of the engagement. The blocking tongue advantageously is formed integrally with the base body for example fabricated as injection-molded plastic part, in particular extends in the engagement direction and is designed elastically resilient in a direction transverse to the engagement direction. For closing the closure device, the first engaging protrusion or a blocking nose provided at the first closure part can be guided along the blocking tongue and thereby acts on the blocking tongue such that the blocking tongue is pushed aside in an elastically resilient manner in the direction in which it is designed elastic, so that the first engaging protrusion can get in engagement with the second engaging protrusion. When the engagement is produced, the blocking tongue gets back into its normal position in which it blocks the engagement of the first engaging protrusion with the second engaging protrusion by acting on the first engaging protrusion or onto a blocking nose designed separately at the first closure part. In direction of the engagement direction the blocking element is designed rigid, i.e. non-elastic, so that the engagement is blocked effectively and in particular moving the first engaging protrusion against the engagement direction out of the second engaging protrusion is not easily possible.

The blocking element can be designed such that during production of the engagement or only after production of the engagement between the first engaging protrusion and the second engaging protrusion it again gets back into its normal position. The blocking element for example can snap back into its normal position, as soon as the engagement is produced (i.e. after production of the engagement). It is, however, also possible that already during production of the engagement the blocking element effects a pretension on the first closure part due to its elastic design, which presses the first engaging protrusion into engagement with the second engaging protrusion in the engagement direction and thus supports bringing into engagement already during production of the engagement.

In the closed position the first engaging protrusion of the first closure part positively is in engagement with the second engaging protrusion of the second closure part. This engagement is blocked by the blocking element, in that the blocking element prevents moving of the first closure part and thus also of the first engaging protrusion against the engagement direction, so that the first engaging protrusion cannot be brought out of engagement with the second engaging protrusion against the engagement direction. For opening the closure device, this blockage either can be eliminated, wherein different actuation variants for opening are conceivable and possible, or the first engaging protrusion and the second engaging protrusion can be brought out of engagement, without a separate elimination of this blockage being necessary.

In a first variant, the closure device can include an actuating mechanism which is formed to act on the blocking element upon actuation, in order to eliminate the blockage of the engagement between the first engaging protrusion and the second engaging protrusion by moving the blocking element out of a normal position. By actuating the actuating mechanism the blocking element thus is pushed aside, so that the path is cleared for the first engaging protrusion or for a blocking nose out of the second engaging protrusion against the engagement direction, and hence the first closure part can be removed from the second closure part.

In particular, the actuating mechanism can be e.g. a handle formed integrally with the blocking element or a separate, movable actuating part.

In a second variant, there can be provided an actuating mechanism for opening the closure device, which is formed to move a blocking nose arranged at the first closure part, with which the blocking element blockingly cooperates in the closed position, in the case of an actuation, in order to eliminate the blockage of the engagement between the first engaging protrusion and the second engaging protrusion by moving the blocking nose. Thus, not the blocking element is moved, but a blocking nose at the first closure part, which is moved out of the region of the blocking element, in order to eliminate the blockage of the movement of the first closure part relative to the second closure part against the engagement direction. By moving the blocking nose, the movement of the first closure part relative to the second closure part against the engagement direction thus is enabled, so that the first closure part can be removed from the second closure part.

For example, the actuating mechanism can include a lever element which is pivotally arranged on the base body of the first closure part about a pivot axis. At the lever element one or more blocking engagement elements, in particular in the form of protrusions in the manner of blocking noses, can be arranged, which in the closed position blockingly are in engagement with the blocking element at the second closure part and thus block the engagement between the first engaging protrusion of the first closure part and the second engaging protrusion of the second closure part against the engagement direction. By moving the lever element together with the blocking engagement elements arranged thereon, the blockage can be eliminated in that the blocking engagement elements are moved out of their blocking position relative to the blocking element of the second closure part. By actuating the lever element, the blockage between the first closure part and the second closure part thus can be eliminated, so that the first closure part is moved relative to the second closure part against the engagement direction and thus can be released from the second closure part.

The lever element for example can be formed of metal, in particular of a ferromagnetic sheet metal. This has the advantage that after an actuation of the lever element, the lever element can automatically be moved back into a starting position due to the magnetic effect of a magnet arranged at the first closure part, so that the first closure part in turn can be attached to the second closure part for closing the closure device.

Alternatively or in addition, it is also conceivable to provide a mechanical spring for biasing the lever element relative to the base body of the first closure part.

In an advantageous embodiment, a lever portion is provided at the lever element, which on pivoting the lever element for opening the closure device becomes operatively connected with the second closure part and produces a force against the engagement direction on the first closure part relative to the second closure part. By mechanism of this lever portion, the opening operation thus can be supported in that on actuation of the lever element for opening the closure device not only the blockage between the at least one blocking engagement element of the lever element and the blocking element of the second closure part is eliminated, but in addition a force is produced between the closure parts, which brings the first closure part and the second closure part out of engagement with each other. Upon actuation of the lever element, the lever portion therefore can immerse for example into an opening of the base body of the second closure part for opening the closure device and get in contact with an edge portion of this opening, so that the first closure part is shifted relative to the second closure part against the engagement direction.

The lever portion of the lever element also can serve to effect resetting of the lever element into its starting position, in which the at least one blocking engagement element at the lever element can get in blocking contact with the blocking element of the second closure part, when the first closure part is attached to the second closure part.

A closure device with such an actuating mechanism at the first closure part in principle also can be formed purely mechanical, i.e. without magnetic mechanism arranged at the first closure part and the second closure part. For example, such closure device for releasably connecting two parts generally can have the following features:

- a first closure part and a second closure part, wherein the first closure part is attachable to the second closure part for closing the closure device and in a closed position is held at the second closure part,
- a first engaging protrusion of the first closure part and a second engaging protrusion of the second closure part, wherein for closing the first engaging protrusion can be brought in engagement with the second engaging protrusion in an engagement direction and in the closed position positively is in engagement with the second engaging protrusion,
- a blocking element arranged at the second closure part, which during attachment of the first closure part to the second closure part is moved out of a normal position by cooperating with the first closure part, so that the first engaging protrusion can be brought in engagement with the second engaging protrusion in the engagement direction, and during or after production of the engagement gets back into its normal position, so that in the normal position the positive engagement of the first engaging protrusion with the second engaging protrusion against the engagement direction is blocked, and
- an actuating mechanism for opening the closure device, which on actuation is formed to move a blocking engagement element arranged at the first closure part, with which the blocking element blockingly cooperates in the closed position, in order to eliminate the blockage of the engagement between the first engaging protrusion and the second engaging protrusion by moving the blocking engagement element, wherein the actuating mechanism includes a lever element pivotally arranged at the base body of the first closure part about a pivot axis, at which at least one blocking engagement element is arranged for cooperating with the blocking element in the closed position.

In a third variant, the first closure part as a whole or a part of the first closure part can be moved relative to the second closure part for opening the closure device, in order to eliminate the blockage of the engagement between the first engaging protrusion and the second engaging protrusion and/or the positive engagement between the first engaging protrusion and the second engaging protrusion. By moving the first closure part relative to the second closure part, the blockage of the movement of the first closure part against the engagement direction thus can be eliminated, in that by moving the first closure part a blocking nose arranged at the first closure part or the engaging protrusion are moved out of the region of the blocking element, so as to enable a movement against the engagement direction. It is, however, also conceivable that by moving the first closure part or the part of the first closure part, the first engaging protrusion tangentially is moved out of engagement with the second engaging protrusion by shifting, rotating or pivoting, so that due to the movement the engagement of the first engaging protrusion with the second engaging protrusion is eliminated. When the engagement is eliminated, the closure parts can be removed from each other. What is also conceivable here is a combination such that by moving the first closure part or the part of the first closure part, both the blockage and the engagement is eliminated.

The movement of the first closure part or the part of the first closure part for opening the closure device can be effected linearly along a straight path or also by rotating. In particular in the first variants, different types of actuating mechanism, for example actuating knobs or actuating slides, are conceivable and possible. When several blocking noses are provided at the first closure part, in particular several actuating mechanism also are possible, which can be actuated independent of each other, in order to each act on an associated blocking element or a blocking nose.

An actuating direction, in which the actuating mechanism is to be actuated, for example can be directed transversely to the engagement direction. It is, however, also conceivable that the actuating mechanism is to be actuated in an actuating direction which is directed along the engagement direction (in the engagement direction or against the engagement direction). The actuating direction should be chosen such that a comfortable, application-adapted operation easy for a user is obtained. When for opening the closure device the first closure part or a part of the first closure part is moved relative to the second closure part, it can be provided in a further embodiment that at the first closure part and/or at the second closure part a ramp is arranged, which is designed such that when moving the first closure part or the part of the first closure part, the first closure part and the second closure part run up onto each other along the ramp, so that the first closure part is separated from the second closure part in a direction vertical to the engagement direction. The separation in particular can be effected against a closing direction, in which the first closure part approximately is to be attached to the second closure part for closing the closure device. In this closing direction, the magnetic mechanism have an attracting effect, so that due to the separation of the closure parts supported by mechanism of the ramp on opening, a removal of the magnetic mechanism from each other and thus a weakening of the acting magnetic forces is effected at the same time. This supports a simple, easy, comfortable opening of the closure device.

In the closed position the blocking element blocks the engagement of the first engaging protrusion with the second engaging protrusion, so that the first engaging protrusion cannot easily be moved out of engagement with the second engaging protrusion against the engagement direction. It can be provided that upon exceedance of a limit force acting on the first closure part against the engagement direction, the blocking element eliminates the position of the engagement between the first engaging protrusion and the second engaging protrusion. For this purpose, a slight bevel for example can be provided at the blocking element, which upon exceedance of the limit force effects that a blocking nose or the first engaging protrusion of the first closure part runs up onto the blocking element and pushes the same aside, so that the first engaging protrusion can be brought out of engagement with the second engaging protrusion against the engagement direction. The blocking element thus blocks the engagement only with a force acting against the engagement direction, which lies below the limit force. When the limit force is exceeded, the blocking element is pushed aside, so that the closure device can be opened.

Advantageously, the first closure part and/or the second closure part include a run-up slope which is designed such that on attachment of the first closure part to the second closure part in a closing direction different from the engagement direction the first engaging protrusion runs up onto the second engaging protrusion and the first closure part is pushed against the engagement direction, until the first engaging protrusion can be brought in engagement with the second engaging protrusion in the engagement direction. The closing direction for example is directed transversely to the engagement direction. The run-up slope describes an inclined plane which is directed at an angle between e.g. 30° to 60°, in particular 45° (based on the surface normal of the inclined plane) to the closing direction and the engagement direction. Such run-up slope facilitates the attachment of the closure parts to each other. In particular when the engaging protrusions are formed as rigid elements on a base body of the closure parts, the engaging protrusions must be moved past each other for being brought in engagement, wherein it is also required for this purpose to move the first engaging protrusion (which is formed in the manner of an undercut) relative to the second engaging protrusion against the engagement direction to such an extent that the engaging protrusions formed in the manner of undercuts can be brought in engagement with each other. This movement against the engagement direction is supported by the run-up slope, along which the closure parts slide along each other, until the engaging protrusions can be brought in engagement with each other.

The possibility of closing the closure device in a closing direction different from the engagement direction is very advantageous in daily use. In the closure known from DE 43 12 032 C2 for example pin and engagement cutout must be manually brought in engagement comparatively exactly in engagement direction, which can be difficult e.g. in the dark.

The magnetic mechanism advantageously can be formed by a first magnet of the first closure part and a second magnet of the second closure part. The magnets advantageously are arranged at the closure parts such that during attachment of the first closure part to the second closure part they magnetically attract each other, wherein in the closed position—as seen along the engagement direction—the first magnet and the second magnet however are offset to each other such that in the closed position a force of magnetic attraction acts on the first closure part in the engagement direction. The magnetic mechanism thus effect a pretension between the closure parts, which attempts to pull the first engaging protrusion into engagement with the second engaging protrusion in the engagement direction and thus magnetically supports the engagement and also the hold of the first engaging protrusion in the second engaging protrusion. As seen along the engagement direction, the magnet of the first closure part thus is arranged before the magnet of the second closure part, so that the force of magnetic attraction between the magnets at least has a force component in the engagement direction.

In principle, the magnetic mechanism have a magnetically attracting effect in a closing direction, which for example can be directed approximately vertical to the engagement direction. Due to the action of the magnetic mechanism, the closure parts thus are mutually attracted on attachment in the closing direction, wherein the action of force between the magnetic mechanism is such that the first engaging protrusion of the first closure part is brought in engagement with the second engaging protrusion of the second closure part in a magnetically supported way and the closing of the closure device thus is effected largely automatically in a magnetically supported way.

The first engaging protrusion at the first closure part and the second engaging protrusion at the second closure part advantageously are formed and designed such that in the loaded condition of the closure device an enhancement of the engagement is obtained. For example, at the first closure part and the second closure part two engaging protrusions each can be provided, which extend at an acute angle to each other, so that a V-shape is obtained. The tip of the V points in the engagement direction, which preferably also corresponds to the loading direction, so that in the loaded condition the hold of the engaging protrusions of the first closure part in the engaging protrusions of the second closure part is enhanced.

In addition, the V-shape also is advantageous with regard to two further aspects. Firstly, due to the V-shaped arrangement, forces which differ from the loading direction within an angle specified by the V-shape advantageously are absorbed by the positive connection between the first engaging protrusions and the second engaging protrusions. Secondly, the V-shape stabilizes such that pivoting forces which act at the closure in the closed position around the closing direction can be absorbed on a comparatively large effective width (as compared to the depth of the engaging protrusions). The effective width here approximately is the width of the V-shaped engaging protrusions in the loading direction.

In principle, however, other shapes of the engaging protrusions at the first closure part and the second closure part also are conceivable. For example, the first engaging protrusion and the second engaging protrusion each can be designed arc-shaped.

The V-shape or arc shape also has the advantage that engaging protrusions connected in a V-shape or arc-shaped protrusions can have an improved stability as compared to a simple linear engaging protrusion.

It is also conceivable and possible that at each closure part several engaging protrusions are arranged, which are offset to each other along the engagement direction. The engaging protrusions can be arranged at the respective closure part in the manner of a row or in the manner of a matrix, so that for closing several engaging protrusions are brought in engagement with each other. The number of the blocking elements need not correspond to the number of the engaging protrusions. In principle, a single blocking element is sufficient for blocking the movement of the first closure part relative to the second closure part against the engagement direction. Advantageously, however, several blocking elements can also be provided.

Engaging protrusions for example also can be arranged at the closure parts periodically or in groups, so that the closure parts can be brought in engagement with each other in different closed positions. In particular, the engaging protrusions also can be realized by groups of V-shaped or arc-shaped engaging protrusions arranged in the manner of a row or matrix.

The advantageous enhancement of the positive connection of the engaging protrusions under a load in the loading direction is an essential functional difference to a conventional push-in buckle, as it is known in many different variants for use e.g. at backpacks. The principle of the push-in buckle especially is defined in that two closure parts are attached to each other in a plugging direction which is opposite to a loading direction. This mechanism that the loadability of such closure depends on the stability of necessarily resiliently designed latching elements. On the other hand, a closure in which the loading direction advantageously enhances the positive connection of two in particular rigid engaging portions has a great safety and a high loadability. Such closure thus is quite useful for safety-relevant applications such as e.g. helmet closures or safety belts, in particular for child seats or baby carriages, not only from a technical, but also from a user-psychological point of view.

In an advantageous embodiment, the first closure part and the second closure part are identical in construction. This provides a particularly easy manufacturability with only one tool, for example by mechanism of plastics injection molding, wherein for closing the closure parts are attached to each other inversely, and the first engaging protrusion of the first closure part is brought in engagement with the second engaging protrusion of the second closure part.

In a further embodiment, the first closure part and/or the second closure part is retractably arranged at a housing such that in a retracted position the closure part is at least partly enclosed by the housing and during attachment of the first closure part to the second closure part for producing the engagement between the first engaging protrusion and the second engaging protrusion is extended from its retracted position. In the retracted position, the respective closure part thus is at least partly retracted in the housing, so that in particular the engaging protrusion does not or only partly protrude to the outside. For producing the connection of the closure parts, the closure part is extended during attachment of the closure parts to each other, in particular by action of the magnetic mechanism between the closure parts, so that in the extended position the engagement between the engaging protrusions can be produced and the closure device thus can be closed.

This is particularly advantageous when it is required that objects are to be brought in positive engagement, which with an open closure do not have any hooks protruding to the outside in a disturbing way.

The object also is solved by a belt buckle for connecting two belts subjected to tension along a loading direction. Such belt buckle comprises

- a first closure part and a second closure part, wherein the first closure part is attachable to the second closure part for closing the closure device and in a closed position is held at the second closure part,
- a first engaging protrusion of the first closure part and a second engaging protrusion of the second closure part, wherein for closing the first engaging protrusion can be brought in engagement with the second engaging protrusion in an engagement direction and in the closed position positively is in engagement with the second engaging protrusion, and
- a blocking element arranged at the second closure part, which on attachment of the first closure part to the second closure part is moved out of a normal position by cooperating with the first closure part, so that the first engaging protrusion can be brought in engagement with the second engaging protrusion in the engagement direction, and during or after production of the engagement gets back into its normal position, so that in the normal position the positive engagement of the first engaging protrusion with the second engaging protrusion against the engagement direction is blocked.

It is furthermore provided that at the first closure part and/or the second closure part a belt webbing receptacle is arranged for fixing a belt, and in a loaded condition load forces act on the closure parts along a load direction such that the first closure part is loaded relative to the second closure part in the engagement direction.

In purely functional terms, the belt buckle corresponds to the closure device described above, wherein the belt buckle also can be designed as a purely mechanical, non-magnetic closure device. Advantageously, however, the belt buckle also can include magnetic mechanism for supporting the closing operation, so that the above description also applies for the belt buckle.

The belt buckle represents a closure device in which belts to be subjected to tension are connected with each other by the (releasable) connection of the closure parts. The load direction is directed along the engagement direction, so that when the belts are subjected to tension, the hold of the closure parts is enhanced, and in the loaded condition the belt buckle thus cannot easily be opened. The engagement of the closure parts additionally is secured by the blocking element, so that even an inadvertent release in the loaded or unloaded condition is not easily possible.

BRIEF DESCRIPTION OF THE DRAWINGS

The idea underlying the invention will be explained in detail below with reference to the exemplary embodiments illustrated in the Figures, in which:

FIGS. 4A-4G show sectional views along line C-C in the respectively associated FIG. 3A-3G;

FIGS. 5A-5G show sectional views along line D-D in the respectively associated FIG. 3A-3G;

DESCRIPTION OF THE INVENTION

Figure 1A:
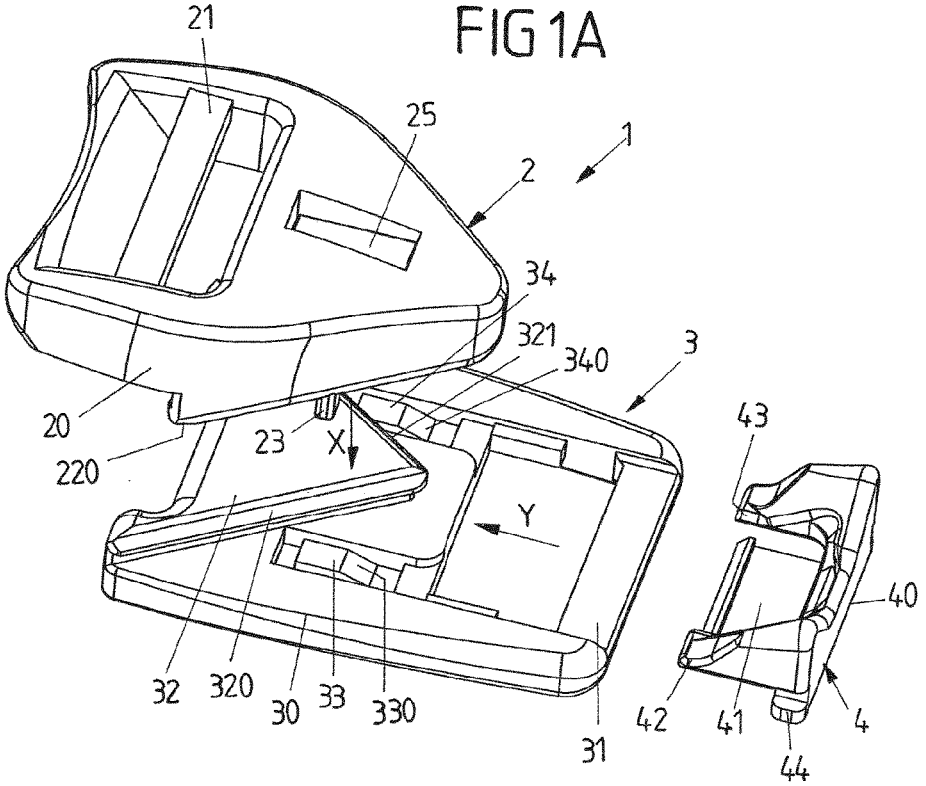
FIGS. 1A, 1B show different perspective views of a first exemplary embodiment of a closure device.
Figure 1B:
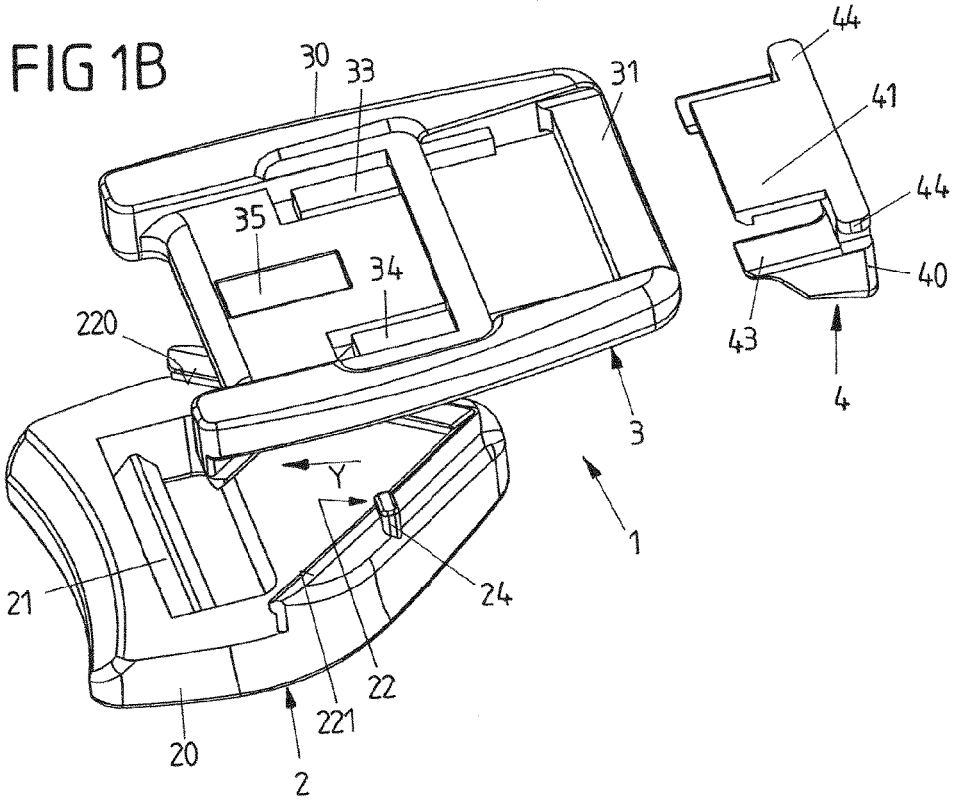
Figure 2A:
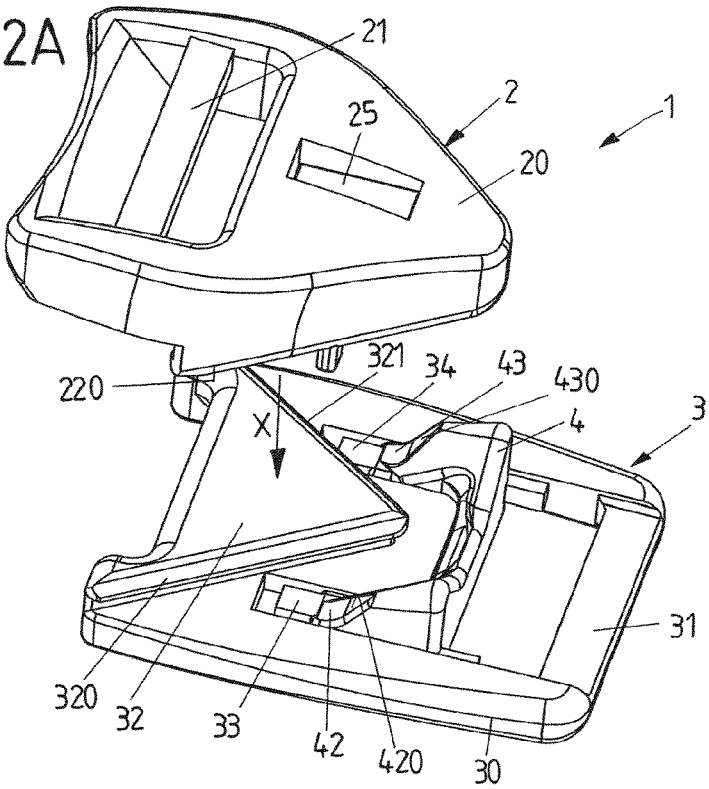
FIGS. 2A, 2B show the perspective views of FIGS. 1A, 1B with attached actuating mechanism.
Figure 2B:
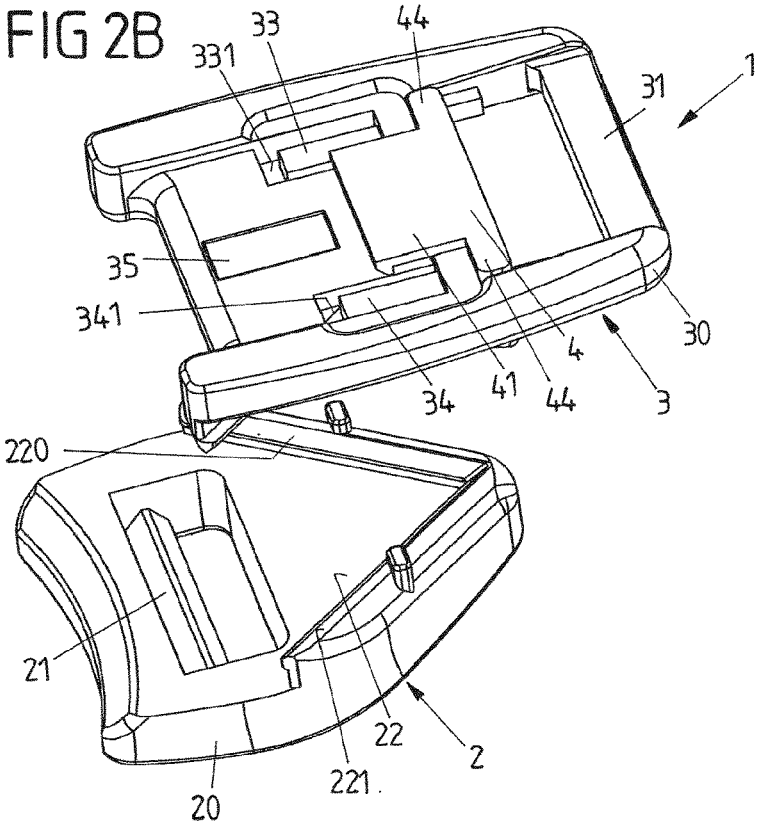

A first exemplary embodiment of a closure device 1 is shown in FIGS. 1A and 1B as well as FIGS. 2A and 2B in different perspective views. The closure device 1 includes a first closure part 2 and a second closure part 3, which for closing of the closure device 1 can be attached to each other approximately in a closing direction X. In a closed position, engaging protrusions 220, 221 of the first closure part 2 mechanically are in engagement with engaging protrusions 320, 321 of the second closure part 3, so that by mechanism of the engaging protrusions 220, 221, 320, 321 the closure parts 2, 3 are held at each other.

The first closure part 2 includes a base body 20 at which a belt webbing receptacle 21 is formed for fixing a belt. At the first closure part 2 an engaging mechanism 22 is formed, which substantially is formed by two engaging protrusions 220, 221 which each extend linearly and together form a V-shape. The engaging protrusions 220, 221 each are formed in the manner of undercuts.

The second closure part 3 likewise includes a base body 30 at which a belt webbing receptacle 31 is mounted for fixing a belt. At the second base body 30 an engaging mechanism 32 is formed, which includes engaging protrusions 320, 321 which likewise are formed in the manner of undercuts and in the closed position are in engagement with the engaging protrusions 220, 221 of the first closure part 2.

At the first closure part 2 two blocking noses 23, 24 are formed, which protrude from the latching protrusions 220, 221 and serve to cooperate with blocking elements 33, 34 of the second closure part 3 for blocking the closure device 1 in its closed position. The blocking elements 33, 34 are formed as elastic blocking tongues at the base body 30 of the second closure part 3 and extend in a tongue-like manner along an engagement direction Y (see e.g. FIGS. 1A, 1B and FIG. 5D) in which the first closure part 2 with its engaging protrusions 220, 221 is to be brought in engagement with the second closure part 3 with its engaging protrusions 320, 321.

At the second closure part 3 an actuating mechanism 4 is provided in the form of an actuating slide which is shiftable on the base body 30 along the engagement direction Y and for this purpose encloses the base body 30 with a holding element 41 (see e.g. FIG. 2B). The actuating mechanism 4 in the form of the actuating slide includes actuating noses 42, 43 which serve to cooperate with the blocking elements 33, 34, in order to actuate the blocking elements 33, 34 for unblocking the closure device 1. For this purpose, the actuating noses 42, 43 can run up onto run-up slopes 330, 340 of the blocking elements 33, 34, as will yet be described below. At the actuating mechanism 4 in the form of the actuating slide further guide elements 44 are provided, by which the actuating mechanism 4 is guided on the base body 30 of the second closure part 3.

The mode of operation of the closure device 1 will be explained below with reference to FIGS. 3A to 3G, 4A to 4G and 5A to 5G. FIGS. 3A to 3G show top views of the closure device 1, FIGS. 4A to 4G show sectional views along line C-C of FIGS. 3A to 3G, and FIGS. 5A to 5G show sectional views along line D-D of FIGS. 3A to 3G. In the Figures, the closure device is shown in different positions, wherein the Figures designated with "A", "B", "C" etc. each represent identical positions.

Figure 3A:
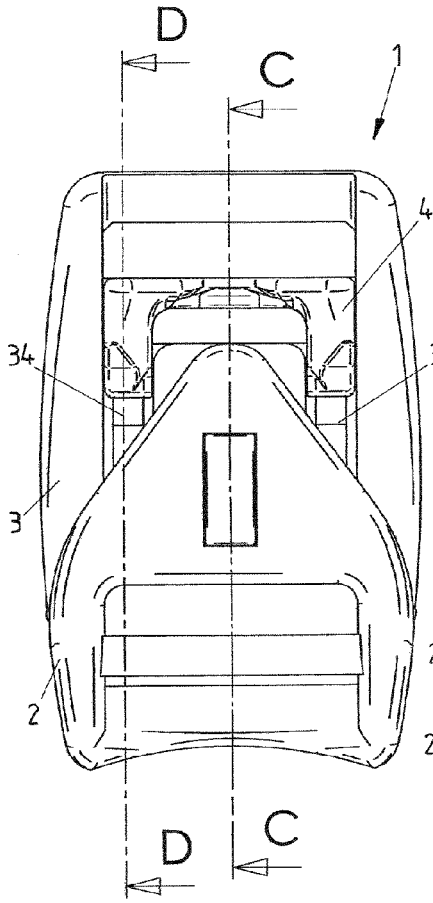
FIGS. 3A-3G show top views of the closure device in different positions.
Figure 4A:
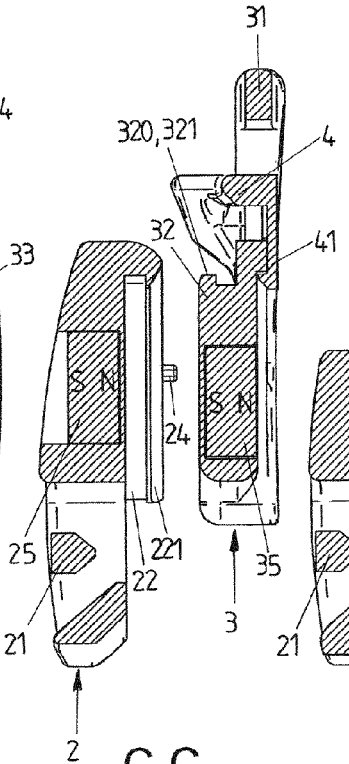
Figure 5A:
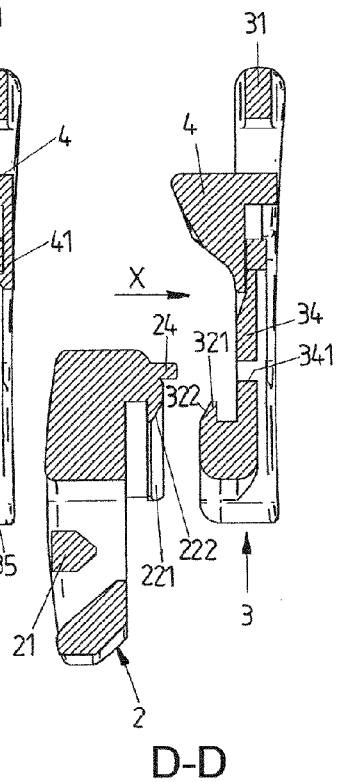
Figure 4B:
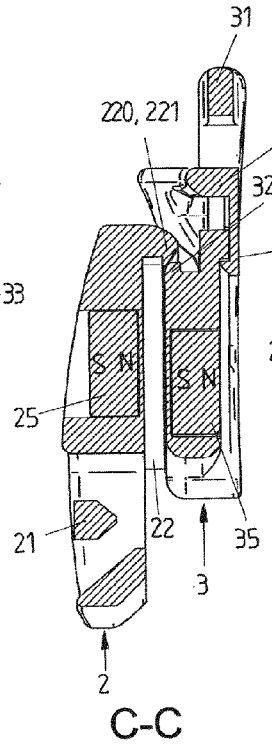
Figure 5B:
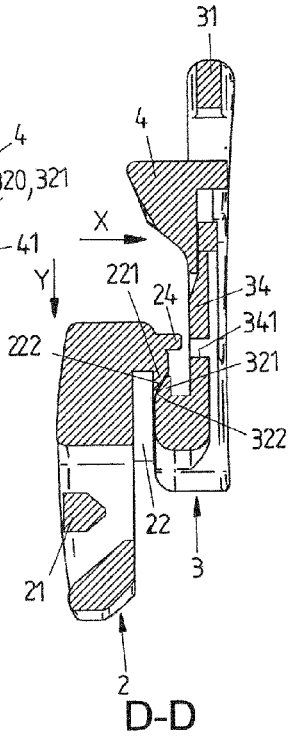
Figure 4C:
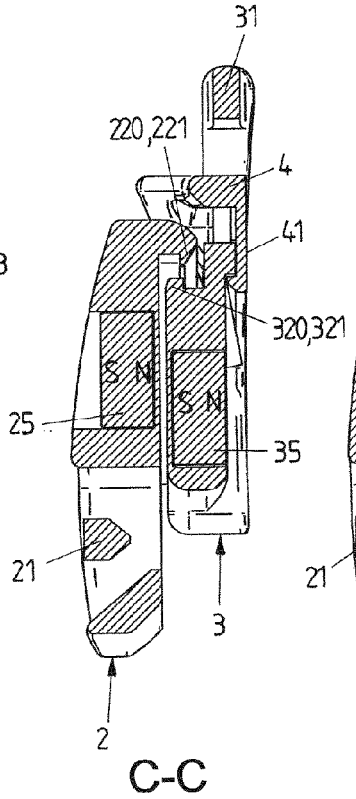
Figure 5C:
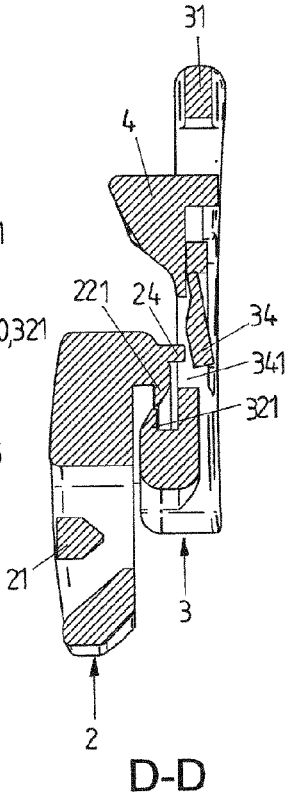

In a starting position, shown in FIGS. 3A, 4A and 5A, the closure parts 2, 3 are present separate from each other. For closing the closure device, the first closure part 2 is attached to the second closure part 3 in a closing direction X, so as to mechanically bring the engaging protrusions 220, 221, 320, 321 and their closure parts 2, 3 in engagement with each other.

For supporting the attachment and the production of the connection of the closure parts 2, 3 magnets 25 are arranged at the closure parts 2, 3, which, as can be taken from the sectional view of FIG. 4A, point towards each other with unlike poles, so that a force of magnetic attraction is effected between the closure parts 2, 3.

When the closure parts 2, 3 are attached to each other in the closing direction X, the engaging protrusions 220, 221 of the first closure part 2 and the engaging protrusions 320, 321 of the second closure part 3 with run-up slopes 222, 322 at the engaging protrusions 220, 221, 320, 321 run up onto each other, so that the first closure part 2 is set back with respect to the second closure part 3 against the engagement direction Y, until the engaging protrusions 220, 221 of the first closure part 2 have moved past the engaging protrusions 320, 321 of the second closure part 3 and the first closure part 2 with its engaging protrusions 220, 221 can be brought in engagement with the engaging protrusions 320, 321 of the second closure part 3 in the engagement direction Y. This is shown in FIGS. 3B, 4B, 5B and 3C, 4C and 5C.

Figure 3B:
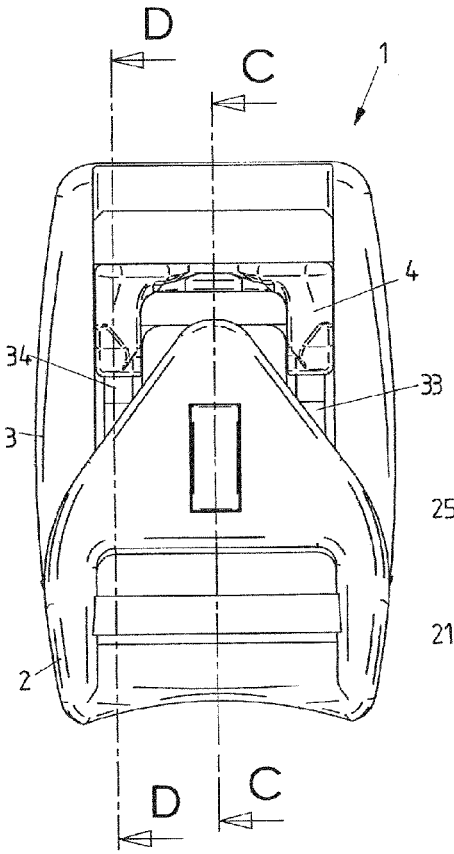
Figure 3C:
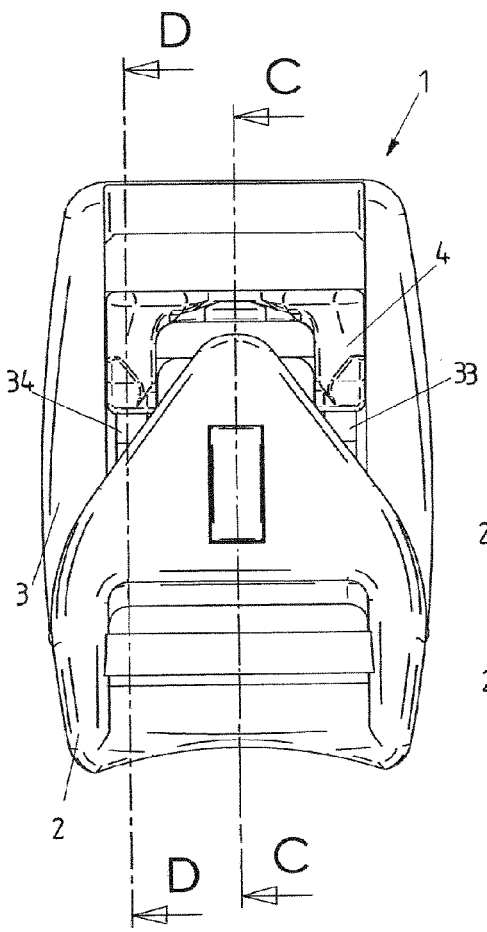
Figure 3D:
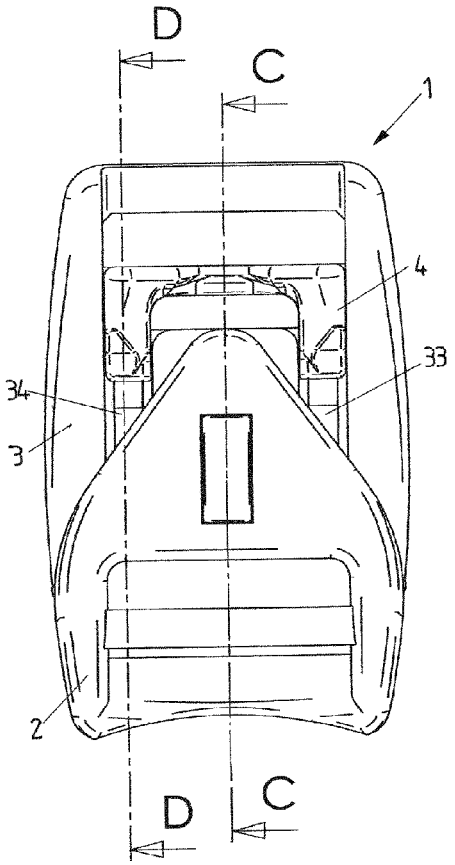
Figure 4D:
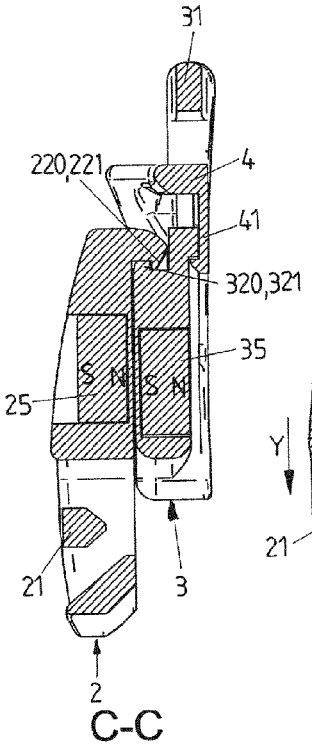
Figure 5D:
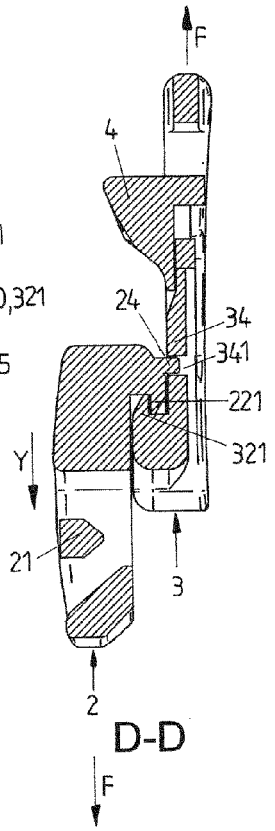

When the engaging protrusions 220, 221, 320, 321 have been moved past each other, the first closure part 2 can be shifted relative to the second closure part 3 in the engagement direction Y, until the engaging protrusions 220, 221 of the first closure part 2 have come in engagement with the engaging protrusions 320, 321 of the second closure part 3, as is shown in FIGS. 3D, 4D and 5D. When attaching the first closure part 2 to the second closure part 3, the first closure part 2 with its blocking noses 23, 24 acts on the respectively associated blocking elements 33, 34, which as a result of the attachment are elastically deflected from their normal position and correspondingly back away in a direction transverse to the engagement direction Y, as can be taken from FIG. 5C. In the closed position, shown in FIG. 5D, the blocking noses 23, 24 have slid along the blocking elements 33, 34 and now engage in an opening 341 formed in engagement direction Y beyond the respectively associated blocking element 33, 34. By mechanism of the blocking elements 33, 34, which are formed rigid against the engagement direction Y, the engagement of the engaging protrusions 220, 221 of the first closure part 2 into the engaging protrusions 320, 321 of the second closure part 3 thus is blocked, so that the second closure part 2 cannot easily be moved relative to the second closure part 3 against the engagement direction Y and thus, the first closure part 2 cannot easily be released from the second closure part 3.

When the closure device 1 is properly loaded in the closed position, forces act along a load direction F between the closure parts 2, 3 (see FIG. 5D), which can reliably and loadably be absorbed by the engagement of the engaging protrusions 220, 221, 320, 321. By mechanism of the blocking elements 33, 34, which cooperate with the blocking noses 23, 24, the closure device 1 additionally is secured against inadvertent opening.

As can be taken from FIG. 4D, the magnets 25, 35 are arranged at the closure parts 2, 3 such that in the closed position they still have an offset to each other along the engagement direction Y. Thus, the magnet 35 of the second closure part 3, as seen along the engagement direction Y, is arranged behind the magnet 25 of the first closure part 2, so that also in the closed position there is still effected a force of magnetic attraction with a component in the engagement direction Y between the closure parts 2, 3, which leads to the fact that in the closed position the first closure part 2 is loaded relative to the second closure part 3 in the engagement direction Y and thus on the one hand the transfer of the first closure part 2 into the closed position and also the hold of the first closure part 2 at the second closure part 3 is magnetically supported.

Figure 3E:
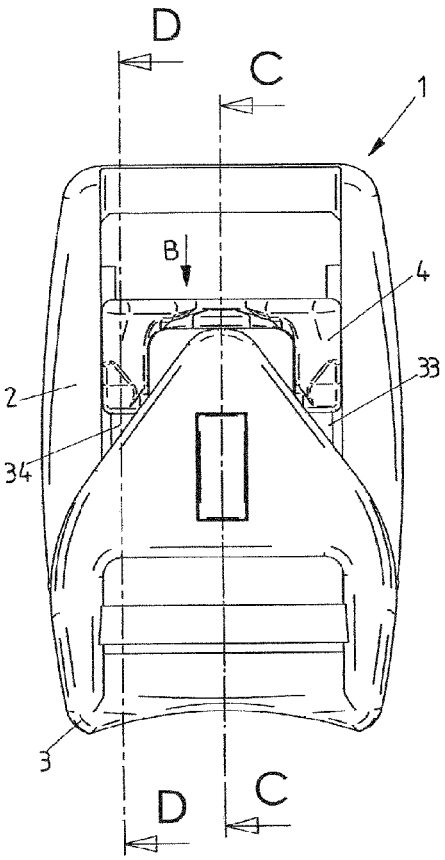
Figure 4E:
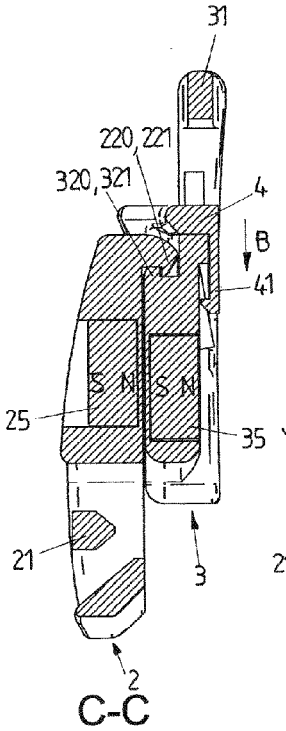
Figure 5E:
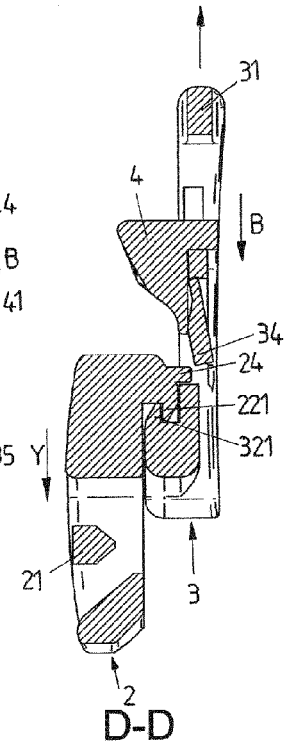
Figure 3F:
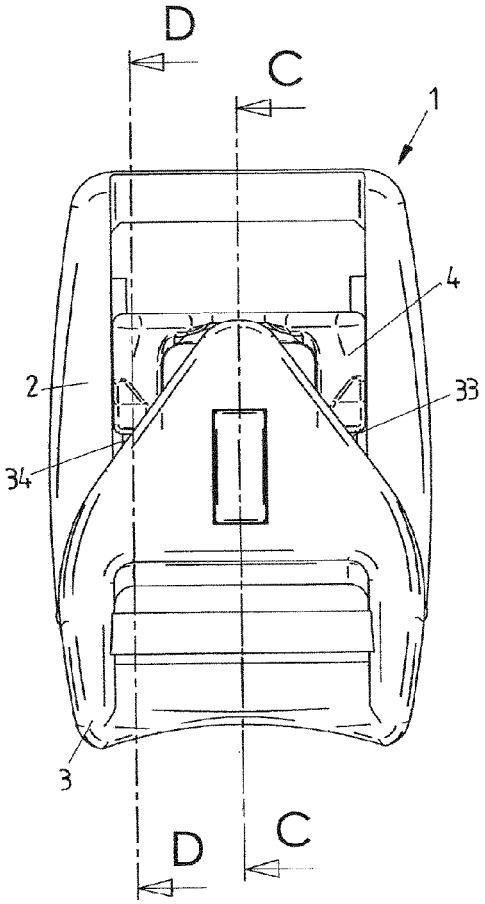
Figure 4F:
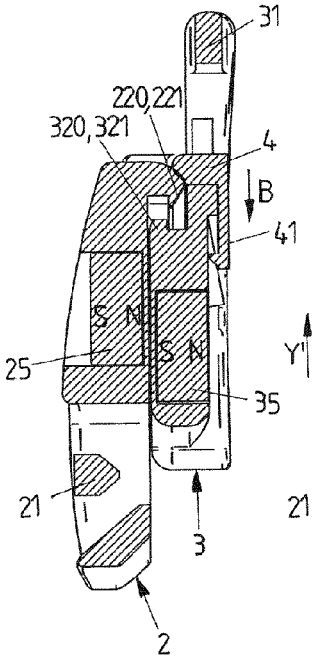
Figure 5F:
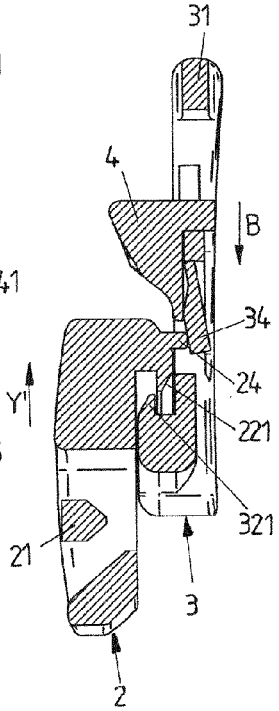
Figure 3G:
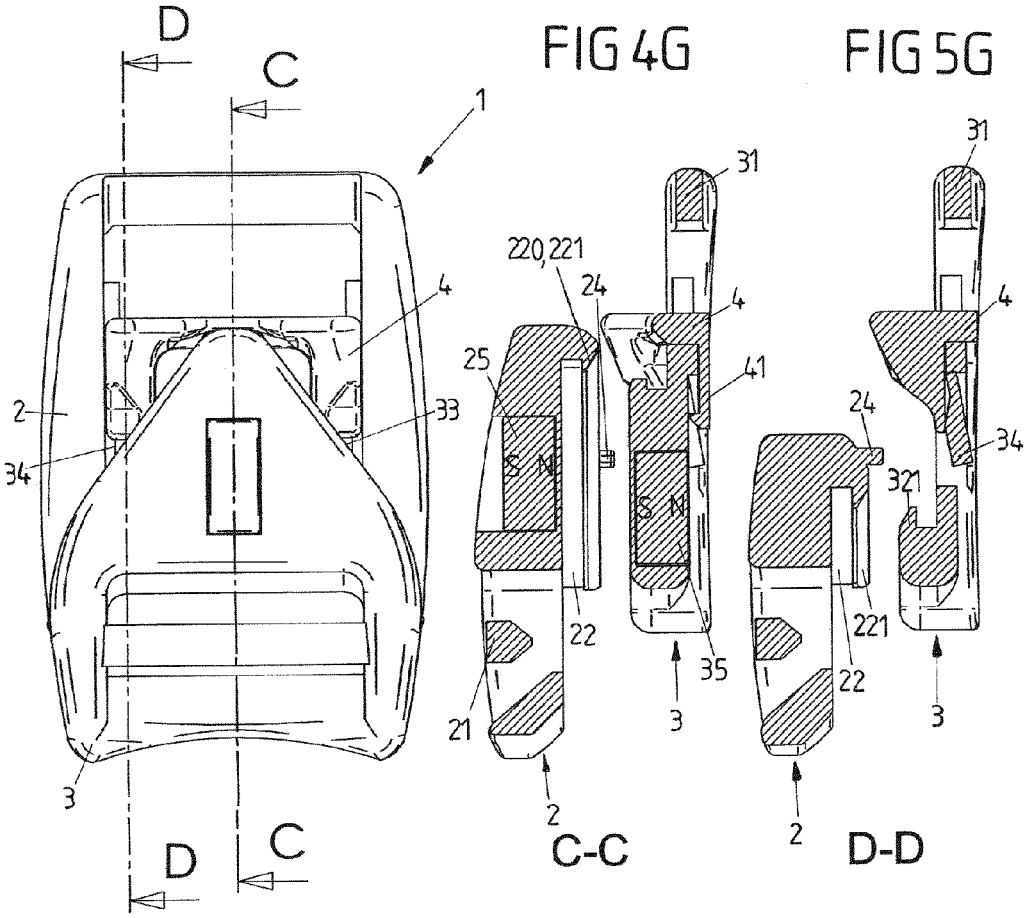

To open the closure device 1, the actuating mechanism 4 in the form of the actuating slide is actuated by shifting the actuating slide 4 relative to the base body 30 of the second closure part 3 in an actuation direction B parallel to the engagement direction Y, as is shown in FIGS. 3E, 4E and 5E. The actuating noses 42, 43 of the actuating slide 4 thereby run up onto the run-up slopes 330, 340 of the associated blocking elements 33, 34, so that the blocking elements 33, 34 are pushed aside transversely to the engagement direction Y, as is shown in FIG. 5E. The blocking noses 23, 24 thus are cleared, and the closure device 1 is unblocked, so that the closure parts 2, 3 can be released from each other, as is shown in FIGS. 3F, 4F, 5F and 3G, 4G, 5G.

This design of the actuating mechanism is advantageous in particular because a user can perform the two operations necessary for opening (elimination of the blockage by the blocking piece and elimination of the engagement of the engaging protrusions) with one actuation.

The closure parts 2, 3 for example can be designed in a simple form as injection-molded plastic parts. In this case, the magnets 25, 35 are attached to the closure parts 2, 3 as additional components, for example formed as neodymium magnets.

The magnets 25, 35 in principle also can be omitted, in order to provide a purely mechanical closure device 1. In this case, the closure parts 2, 3 are to be attached to each other and engaged with each other manually.

Figure 6A:
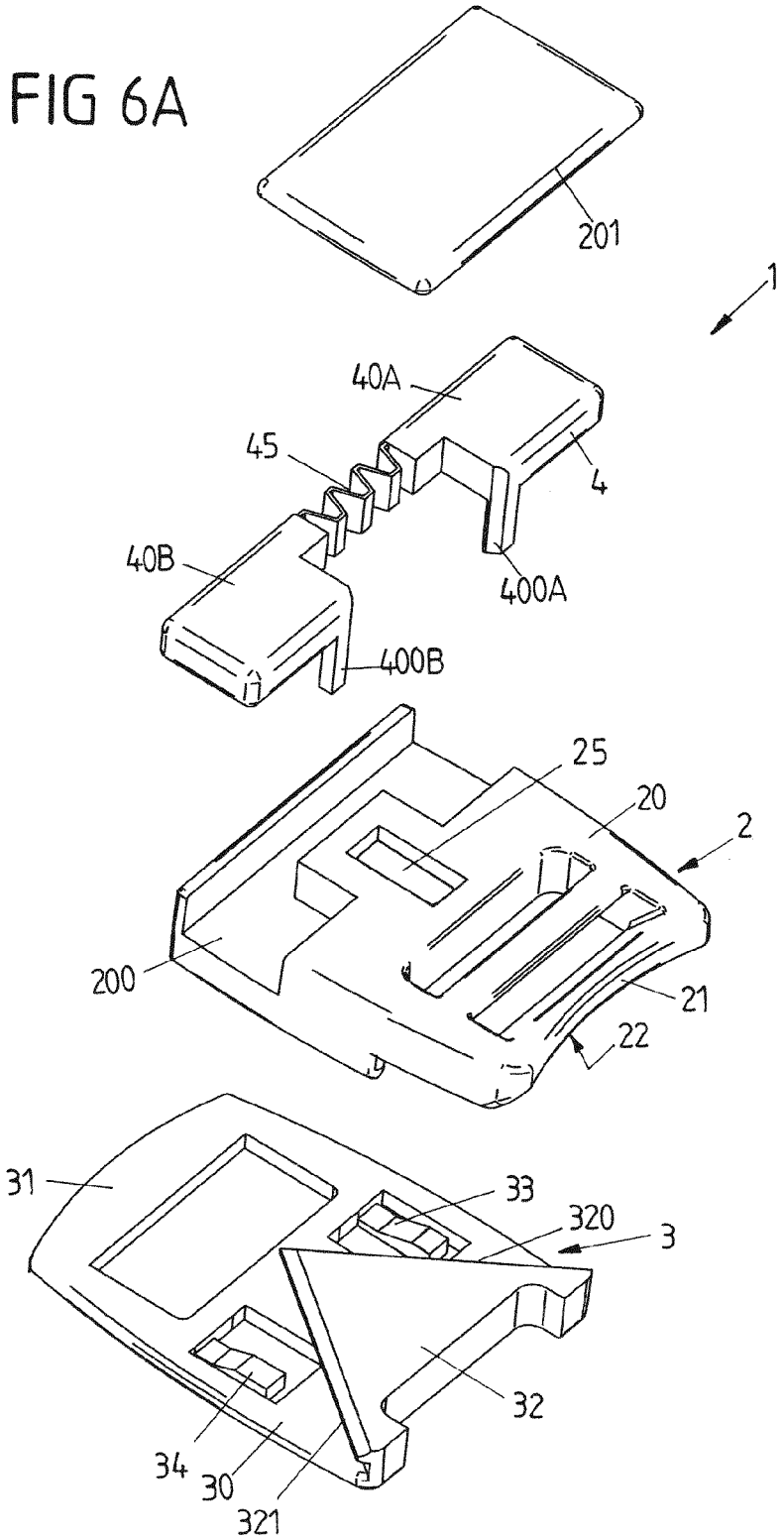
FIGS. 6A, 6B show perspective exploded views of a second exemplary embodiment of a closure device.
Figure 6B:
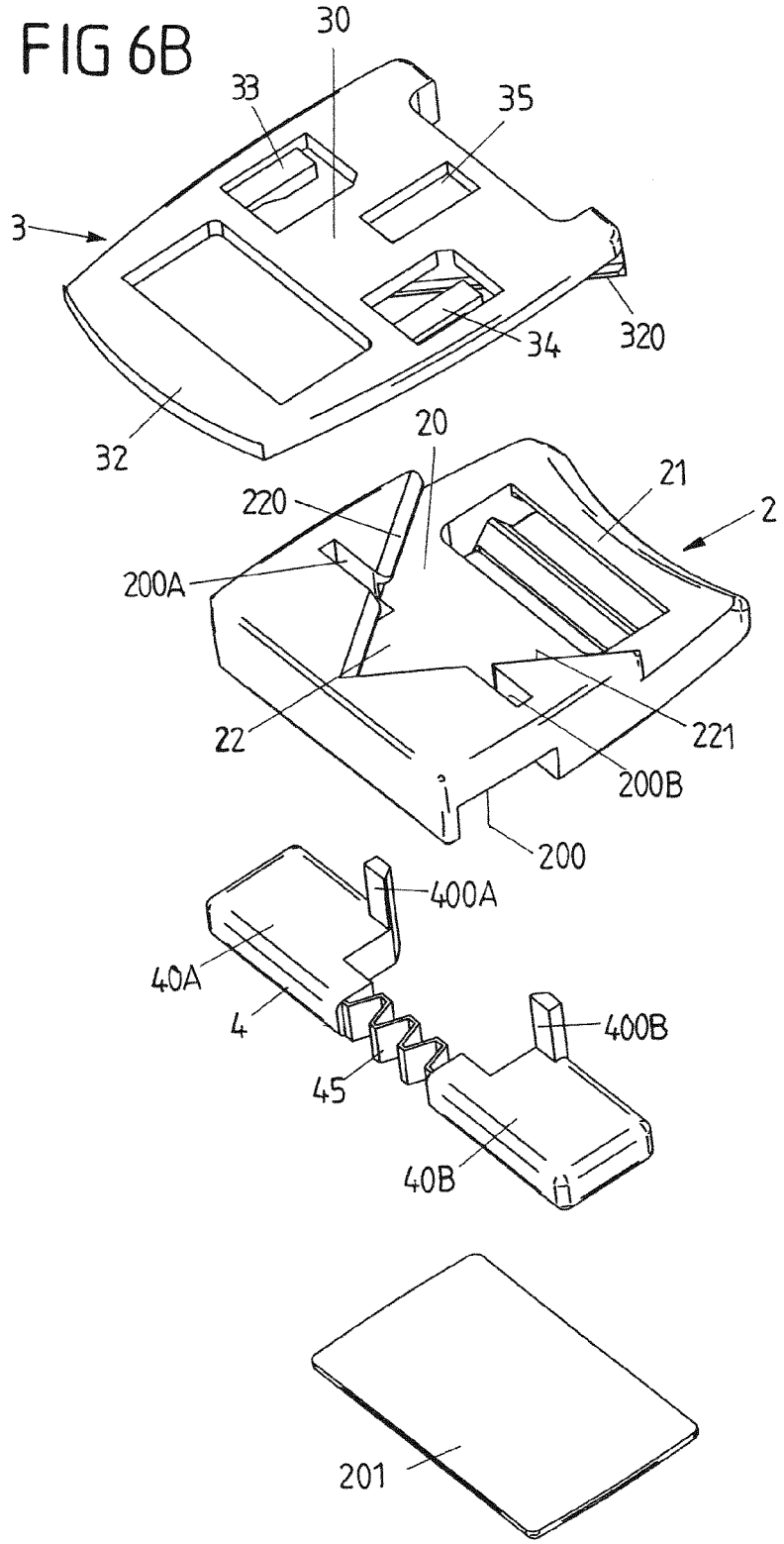

FIGS. 6A, 6B as well as FIGS. 7A to 7F, 8A-8F and 9A-9*f* show a further exemplary embodiment of a closure device 1. This closure device 1 includes a first closure part 2 and a second closure part 3 with one base body 20, 30 each, at which the engaging protrusions 220, 221, 320, 321 are formed. Each closure part 2, 3 carries a belt webbing receptacle 21, 31. At the second closure part 3 blocking elements 33, 34 are arranged.

The mode of operation of the closure device is similar to the preceding exemplary embodiment, so that reference should be made to the above explanations. In contrast to the exemplary embodiment described above, however, this exemplary embodiment includes an actuating mechanism 4 with two actuating parts 40A, 40B, which are connected with each other via a spring element 45. The actuating mechanism 4 for example can be designed integrally as a plastic part. The actuating mechanism 4 is arranged in a receiving space 200 at the first closure part 2 and is held in the receiving space 200 via a housing cover 201. (For better clarity, the housing cover 201 is not shown in FIGS. 7A-7F, 8A-8F and 9A-9F). At each actuating part 40A, 40B a blocking nose 400A, 400B is arranged, which each extends through a gap 200A, 200B at the base body 20 of the first closure part 2.

The mode of operation of the closure device 1 can be taken from FIGS. 7A-7F, 8A-8F and 9A-9F, in which the closure device 1 is shown in different positions.

Figure 9A:
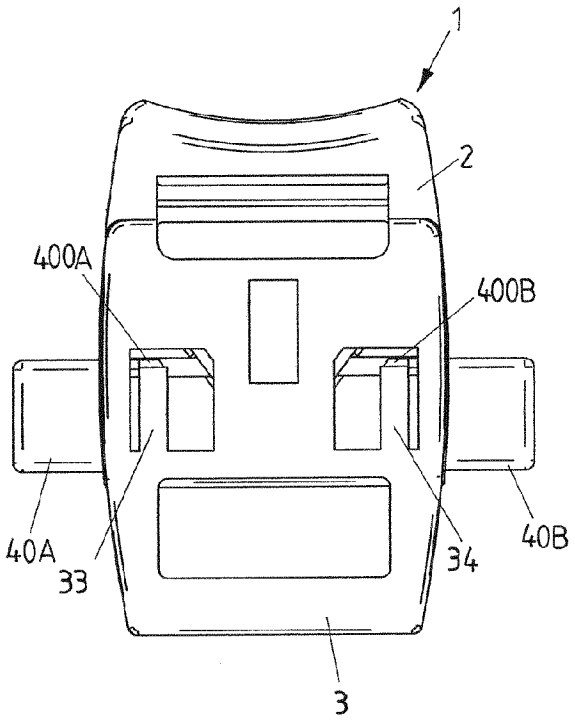
FIGS. 9A-9F show views of the closure device from below.
Figure 8A:
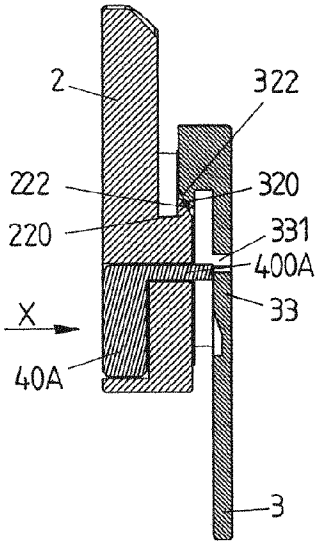
FIGS. 8A-8F show sectional views along line A-A according to the respectively associated FIG. 7A-7F.
Figure 7A:
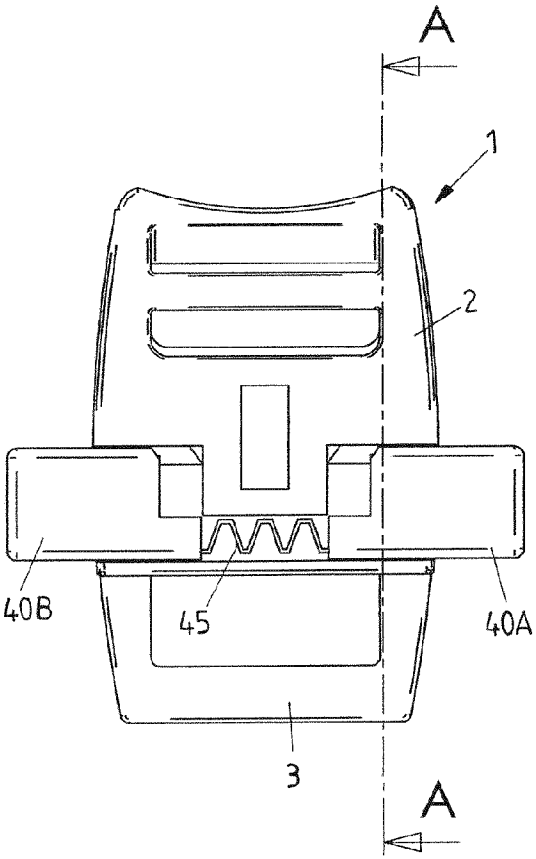
FIGS. 7A-7F show top views of the closure device in different positions.

For closing, the closure parts 2, 3 are attached to each other in a closing direction X, wherein run-up slopes 222, 322 at the engaging protrusions 220, 221, 320, 321 run up onto each other and—analogous to the above description—move the engaging protrusions 220, 221, 320, 321 past each other (see FIGS. 7A, 8A, 9A).

Figure 9B:
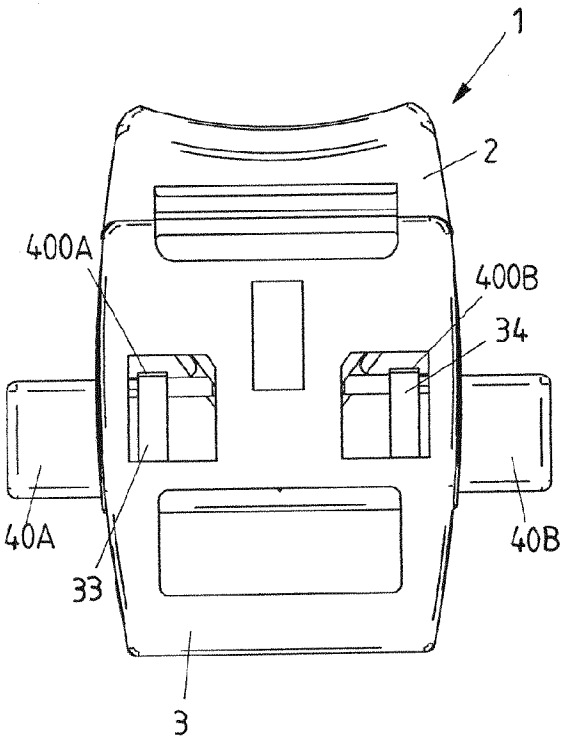
Figure 8B:
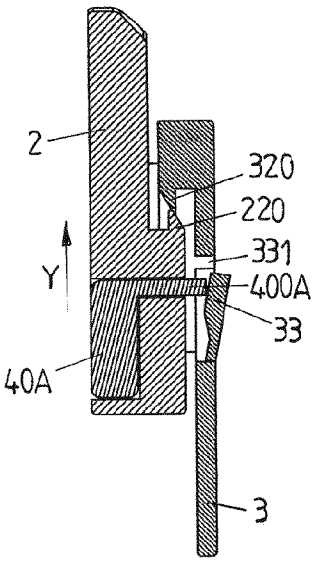
Figure 7B:
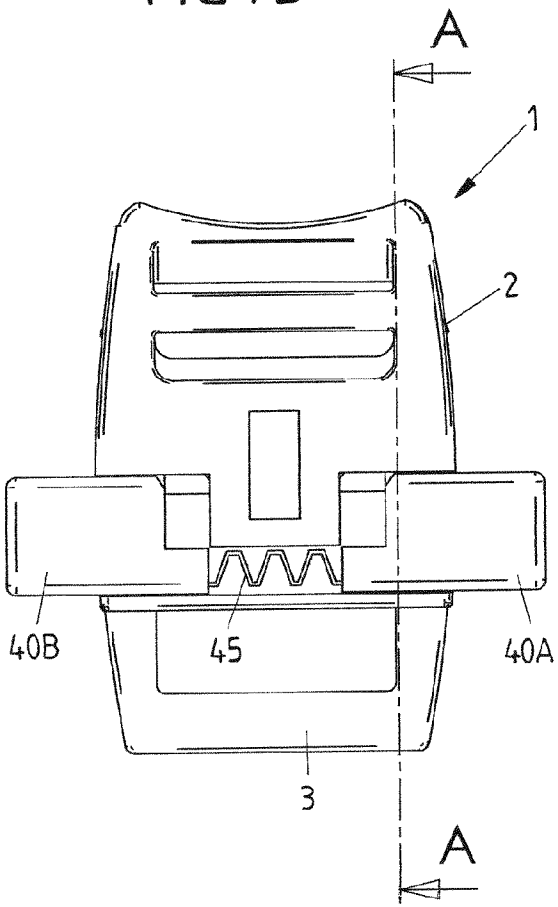

The blocking noses 400A, 400B, which during attachment—due to a pretension caused by the spring element 45, which pushes the actuating parts 40A, 40B away from each other—, are located in an outer position in the respectively associated gap 200A, 200B, hit the blocking elements 33, 34 during attachment, so that the same are pushed out of their rest position (FIGS. 7B, 8B, 9B).

Figure 9C:
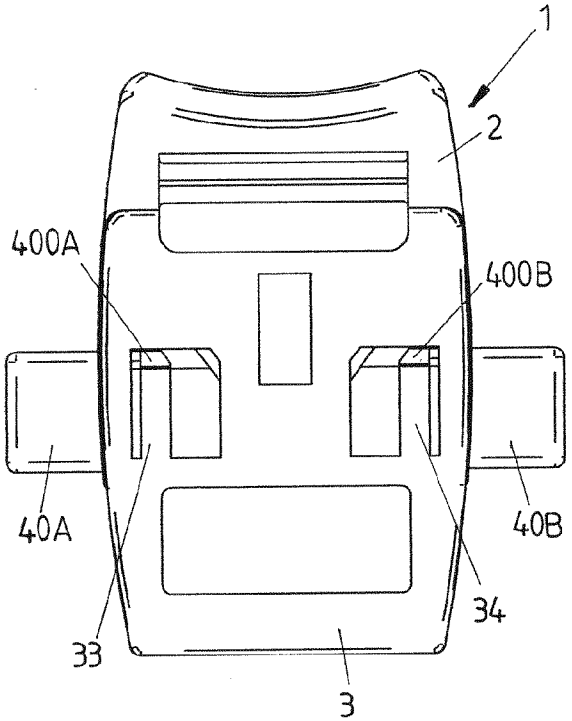
Figure 8C:
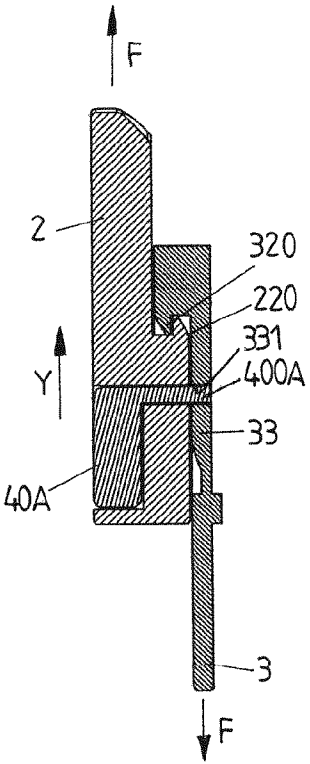
Figure 7C:
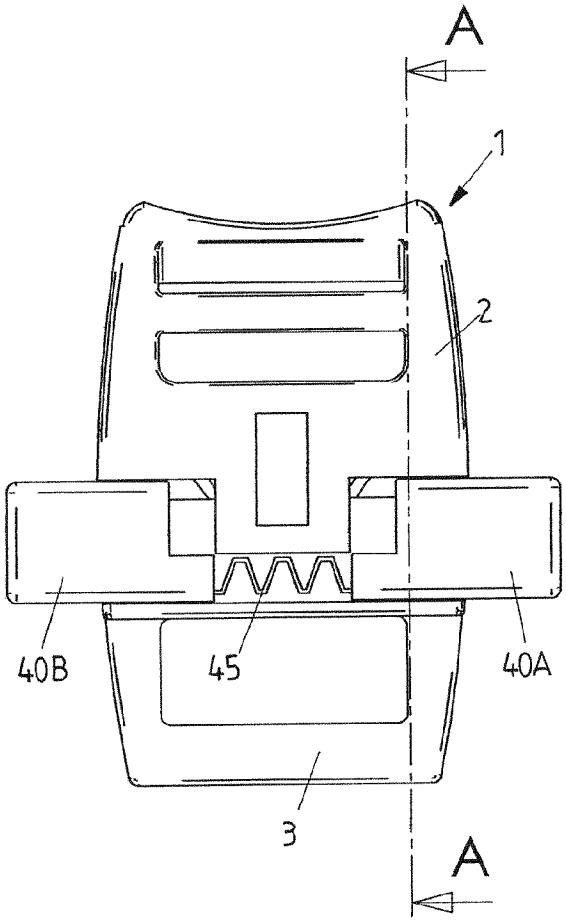

When the engaging protrusions 220, 221 of the first closure part have passed the engaging protrusions 320, 321 of the second closure part 3 in the closing direction X, the engaging protrusions 220, 221 can be brought in engagement with the engaging protrusions 320, 321 of the second closure part 2 in the engagement direction Y (FIGS. 7C, 8C, 9C).

In the closed position, the engaging protrusions 220, 221 of the first closure part 2 engage into the engaging protrusions 320, 321 of the second closure part 3, so that the first closure part 2 is mechanically held at the second closure part 3.

When moving the second closure part in the engagement direction Y relative to the second closure part 3 for bringing the engaging protrusions 220, 221, 320, 321 in engagement, the blocking noses 400A, 400B also move along the respectively associated blocking elements 33, 34. In the closed position, the blocking noses 400A, 400B then lie in openings 331, 341 beyond the blocking elements 33, 34 (see FIG. 8C), so that the closure device 1 is blocked by mechanism of the blocking noses 400A, 400B and the blocking elements 33, 34 cooperating with the same and thus the engagement of the engaging protrusions 220, 221, 320, 321 with each other is secured.

Figure 9D:
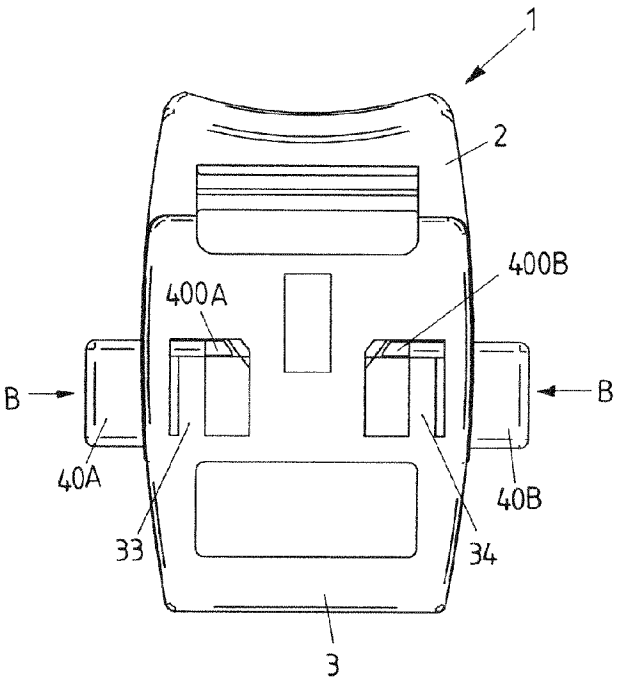
Figure 8D:
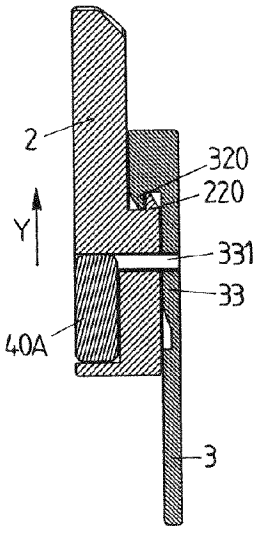
Figure 7D:
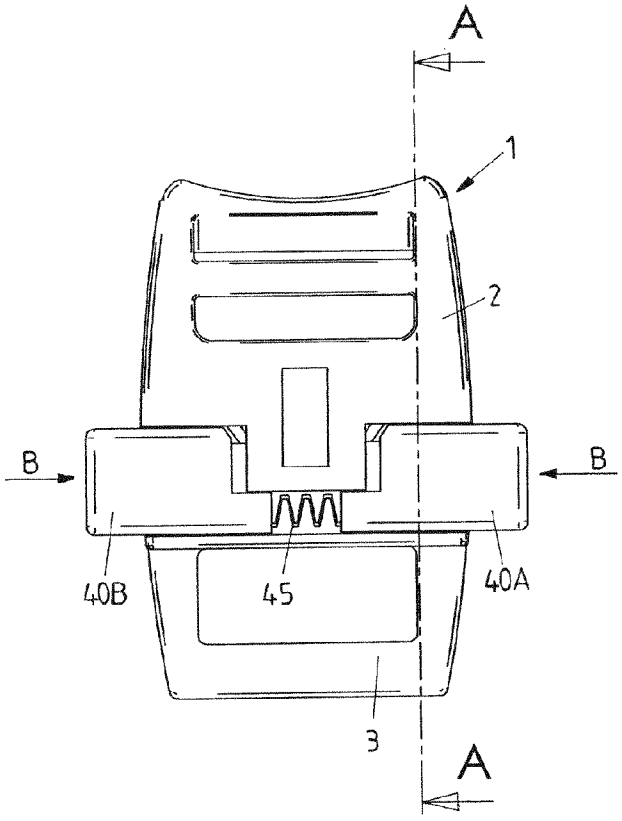
Figure 8E:
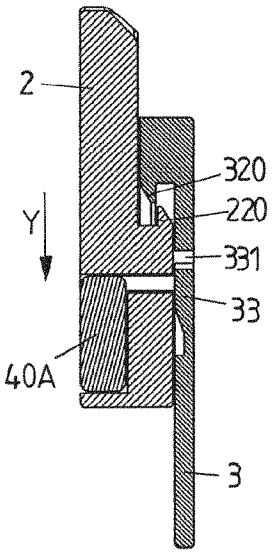
Figure 7E:
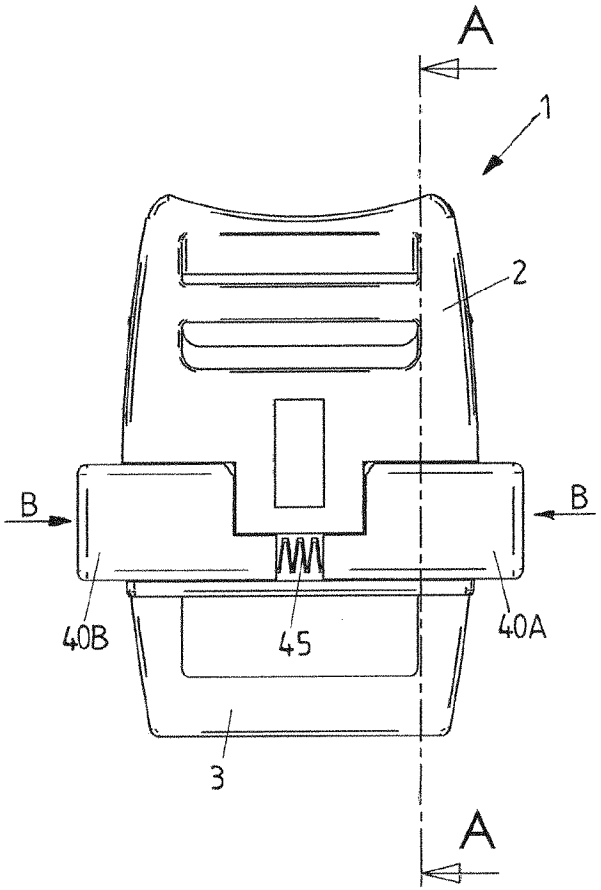

When the closure device 1 is to be opened, the actuating parts 40A, 40B of the actuating mechanism 4 are pushed towards each other in an actuating direction B (FIGS. 7D, 8D, 9D). The blocking noses 400A, 400B arranged at the actuating parts 40A, 40B thereby are moved out of the region of the blocking elements 33, 34 transversely to the engagement direction Y (FIG. 9D), so that the first closure part 2 with the engaging protrusions 220, 221 arranged thereon can be moved relative to the second closure part 3 against the engagement direction Y, without this movement being blocked by the blocking elements 33, 34.

In that the blocking noses 400A, 400B in the associated gaps 200A, 200B are pushed further towards each other (in the actuating direction B, see FIGS. 7E, 8E, 9E), the blocking noses 400A, 400B act on the V-shaped engaging protrusions 320, 321 of the second closure part 2 in the actuating direction B and push the first closure part 2 away from the second closure part 3 against the engagement direction Y, so that releasing the closure parts 2, 3 from each other is supported mechanically.

Figure 9E:
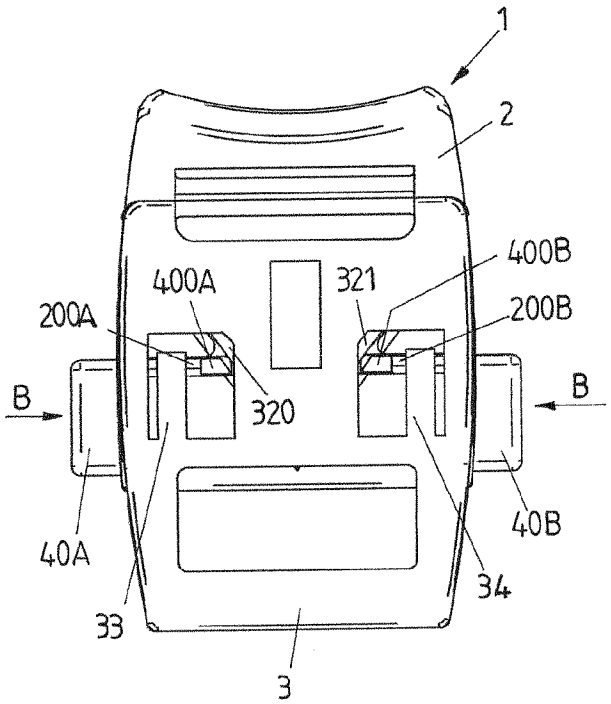
Figure 9F:
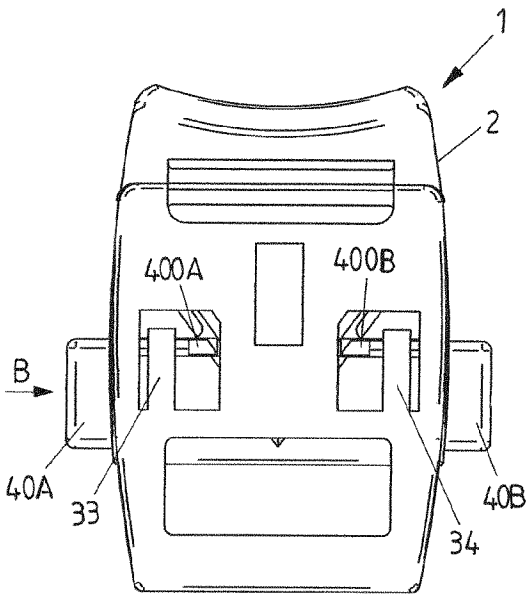
Figure 8F:
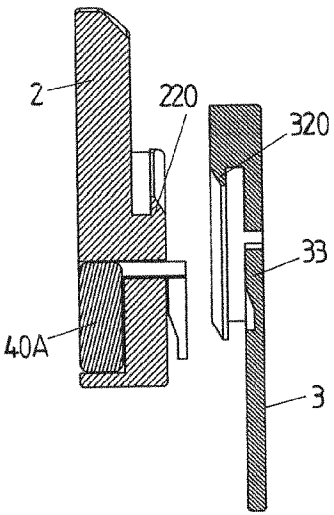
Figure 7F:
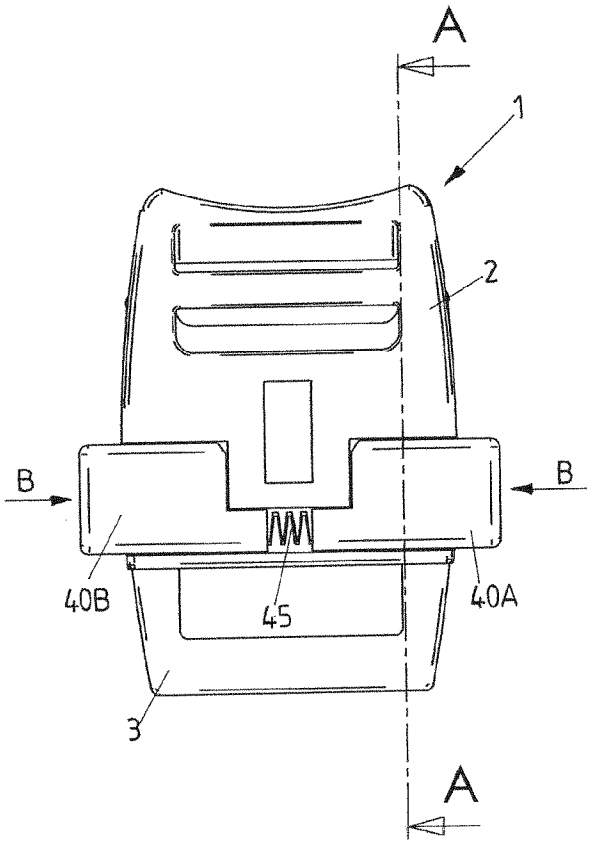

After unblocking the device and releasing the closure parts 2, 3 from each other, the first closure part 2 can be removed from the second closure part 3 (FIG. 7F, 8F, 9F).

In the illustrated exemplary embodiment magnetic mechanism 25, 35 in turn are provided, which magnetically support the attachment of the closure parts 2, 3 to each other in the closing direction X. In this connection, reference is made to the observations on the first exemplary embodiment according to FIGS. 1-5.

In the exemplary embodiment described with reference to FIGS. 6-9, the actuating mechanism 4 is formed with two separate, independently actuatable actuating parts 40A, 40B. For opening the closure device 1, the same must be moved towards each other along an actuating direction B transversely to the closing direction X and transversely to the engagement direction Y, so as to bring the blocking noses 400A, 400B out of their blocking position relative to the blocking elements 33, 34.

Figure 10A:
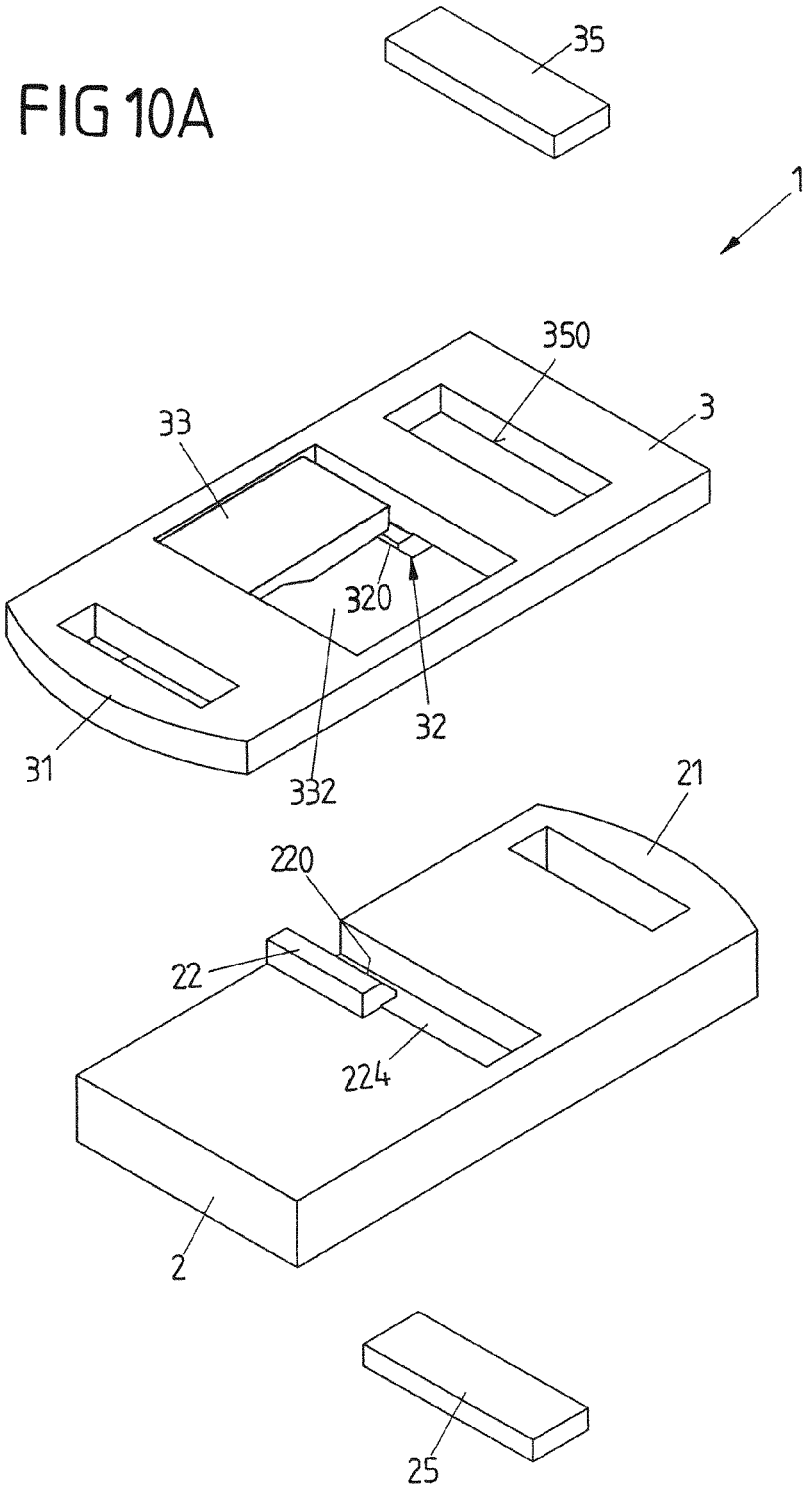
FIGS. 10A, 10B show perspective exploded views of a third exemplary embodiment of a closure device.
Figure 10B:
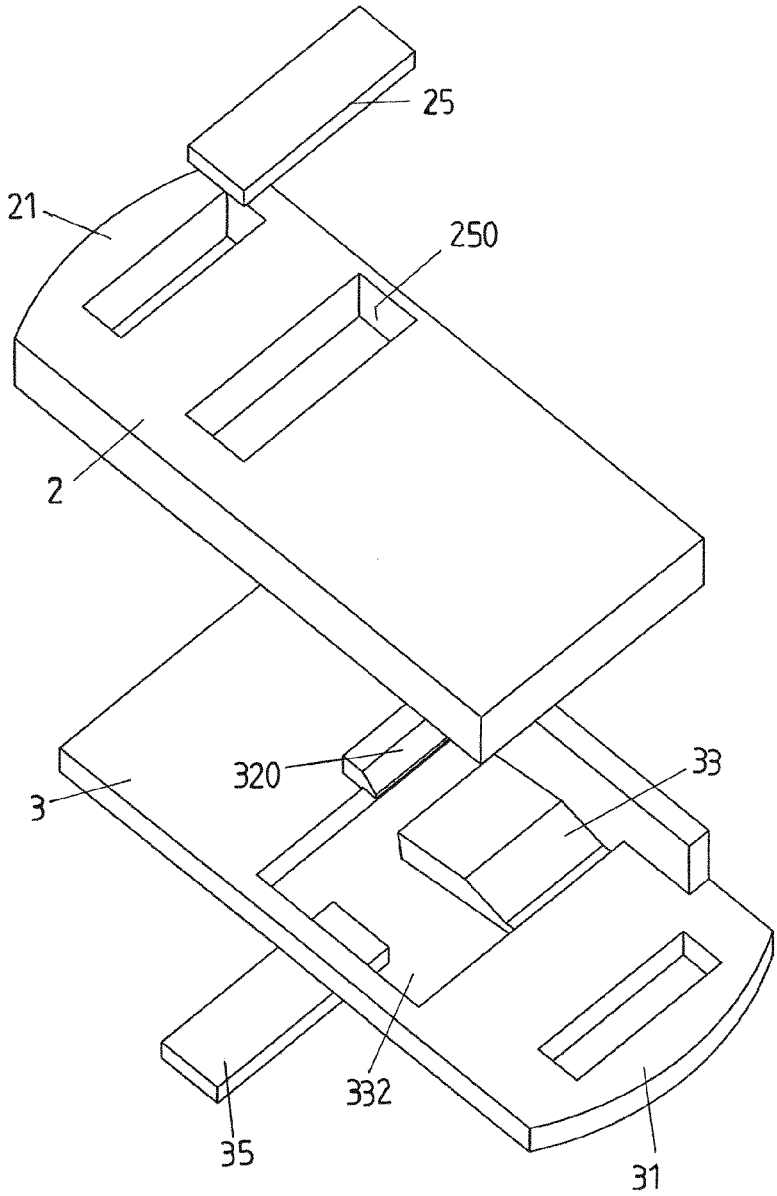
Figure 11A:
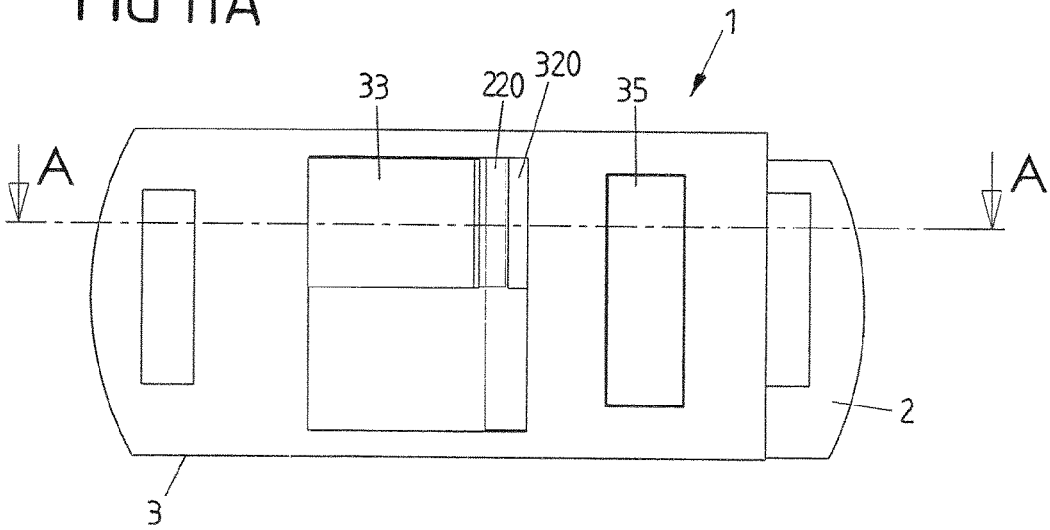
FIGS. 11A-11C show top views of the closure device in different positions.
Figure 11B:
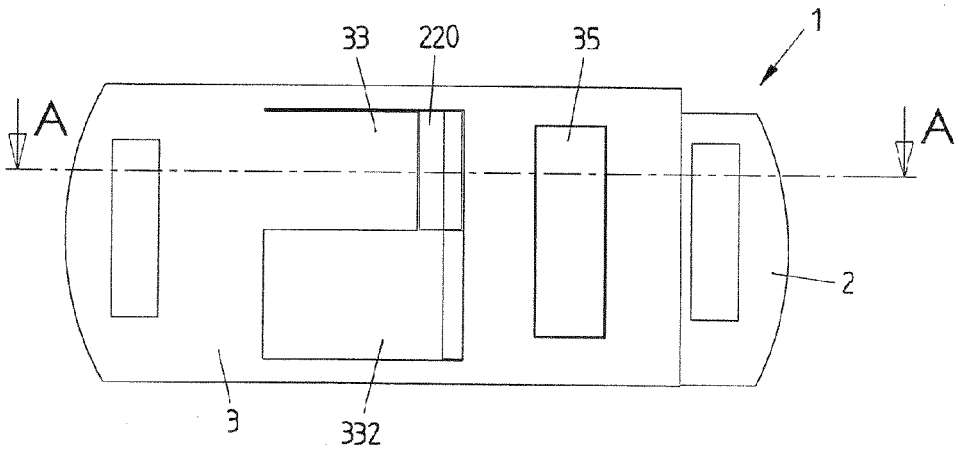

In a further exemplary embodiment of a closure device 1, shown in FIGS. 10A, 10B as well as FIGS. 11A-11C and 12A-12C, a first closure part 2 includes a first engaging protrusion 220 and a second closure part 3 includes a second engaging protrusion 320. At a second closure part 3 there is also arranged a blocking element 33 in the form of a spring tongue, which is resiliently connected with a base body 30 of the second closure part 3.

The mode of operation of the closure device 1 can be taken from FIGS. 11A-11C and 12A-12C, which show the closure device 1 in different positions.

On closing (FIGS. 11A, 12A), the first closure part 2 is attached to the second closure part 3 in a closing direction X, wherein the engaging protrusions 220, 320 with run-up slope run up onto each other and thus the first closure part 2 is offset to the second closure part 3 against an engagement direction Y (vertical to the closing direction X). The first engaging protrusion 220 of the first closure part 2 also acts on the blocking element 33 of the second closure part 3, so that the blocking element 33 backs away approximately in the closing direction X and thus the engaging protrusion 220 of the first closure part 2 can be brought in engagement with the engaging protrusion 320 of the second closure part 3.

At the first closure part 2 and the second closure part 3 magnets 25, 35 are arranged, which magnetically support the attachment of the closure parts 2, 3 to each other and for this purpose provide a force of magnetic attraction.

Figure 12A:
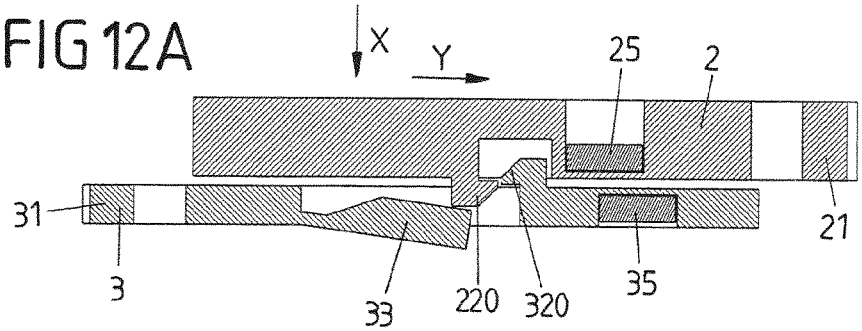
FIGS. 12A-12C show sectional views along line A-A in the respectively associated FIG. 11A-11C.
Figure 12B:
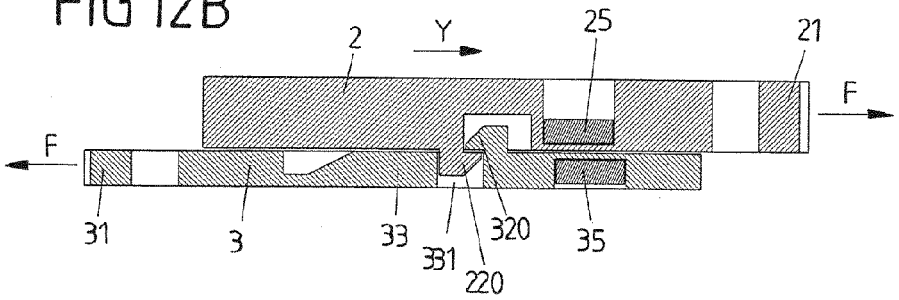
Figure 11C:
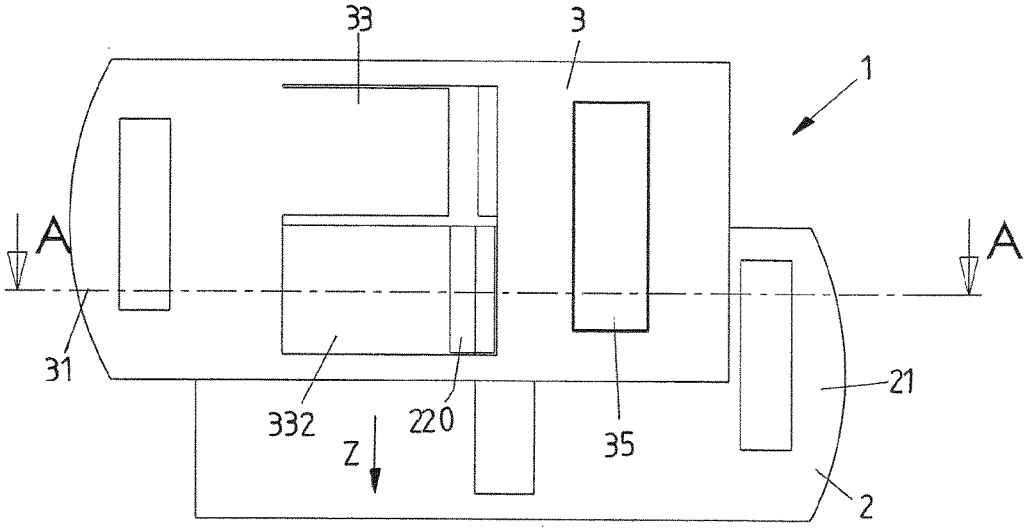
Figure 12C:
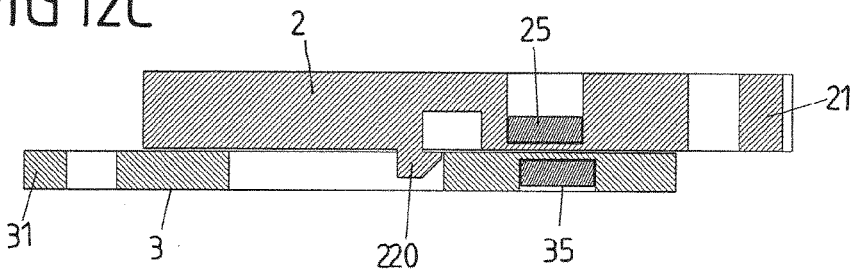

In the closed position (FIGS. 11B, 12B), the engaging protrusion 220 of the first closure part 2 positively is in engagement with the engaging protrusion 320 of the second closure part 3, as is shown in FIG. 12B. In the closed position, the blocking element 33 takes its normal position in which the blocking element 33 extends along the engagement direction Y and blocks the first engaging protrusion 220 of the first closure part 2 against a movement against the engagement direction Y. In this case, the engaging protrusion 220 engages into an opening 331 on the part of the free end of the blocking element 33.

For opening, the first closure part 2 can be shifted in an opening direction Z directed transversely to the closing direction X and transversely to the engagement direction Y into a cutout 332 of the second closure part 3, so that the engaging protrusion 220 of the first closure part 2 is removed from the region of the blocking element 33 and at the same time the engaging protrusion 220 is moved out of engagement with the engaging protrusion 320. The engaging protrusion 320 of the second closure part 3 slides in a groove-shaped cutout 224 of the first closure part 2 (FIG. 10A), so that the engaging protrusions 220, 320 mutually get out of engagement.

Due to the opening movement of the first closure part 2 in the opening direction Z, the blockage by the blocking element 33 thus is eliminated on the one hand, in that the engaging protrusion 220 is removed from the region of the blocking element 33. On the other hand, the engagement between the engaging protrusions 220, 320 is eliminated, so that the first closure part 2 can be removed from the second closure par 3 not only against the opening direction Y, but also directly against the closing direction X.

In principle, it is also conceivable that by shifting the second closure part 2 in the opening direction Z only the blockage or only the engagement of the engaging protrusions 220, 320 is eliminated. In the first case, the engaging protrusion 320 would extend along the entire width of the cutout 332. In the second case, the blocking element 33 would extend along the entire width of the cutout 332.

The mode of operation of the closure device 1 otherwise is similar to the two exemplary embodiments described above, so that in addition reference will also be made to the above description.

Figure 13A:
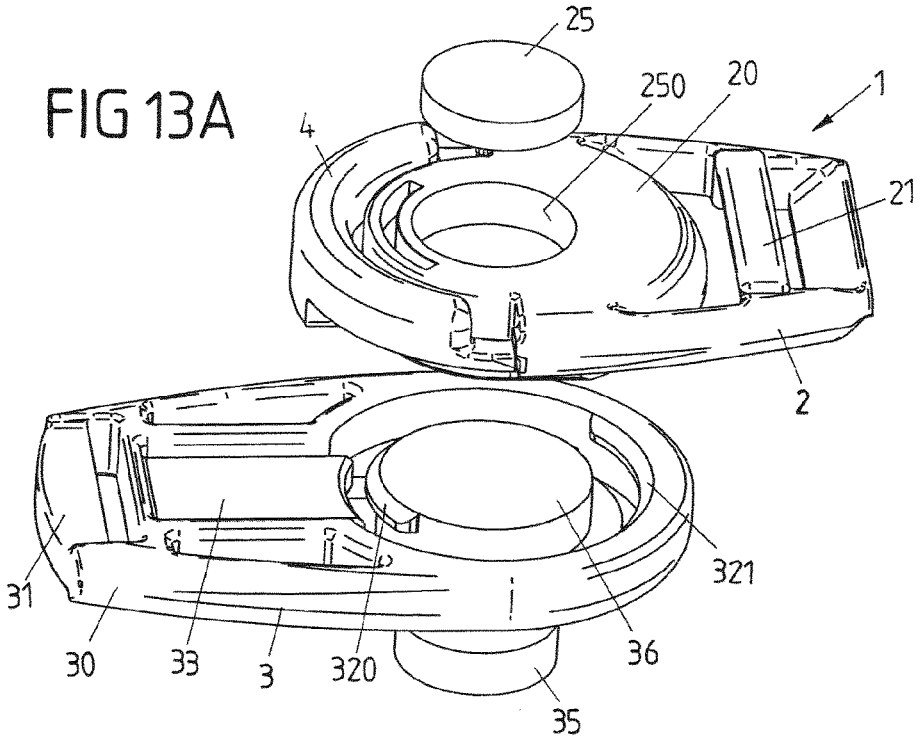
FIGS. 13A, 13B show perspective exploded views of a further exemplary embodiment of a closure device.
Figure 13B:
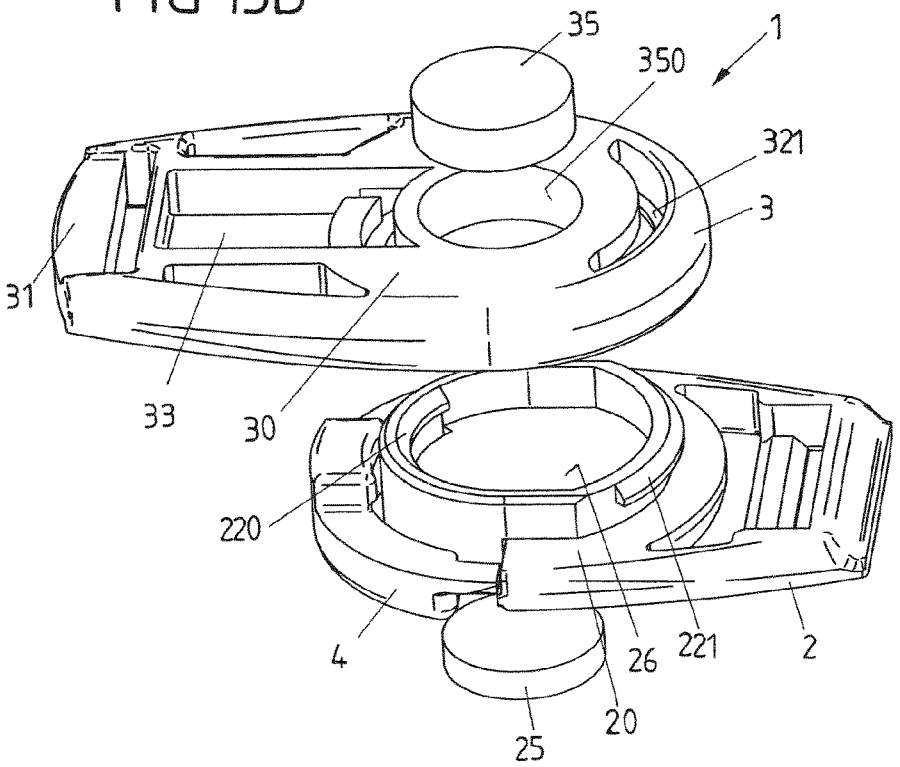

In a further exemplary embodiment shown in FIGS. 13A, 13B as well as FIGS. 14A-14E and FIGS. 15A-15E, a closure device 1 includes a first closure part 2 and a second closure part 3, which each include two engaging protrusions 220, 221, 320, 321 which each describe circular arc portions.

The first closure part 2 includes a pin receptacle 26, into which a pin 36 of the second closure part 3 is inserted on closing the closure device 1. One of the engaging protrusions 220 of the first closure part 2 is arranged inside the pin receptacle 26, while the other one of the engaging protrusions 221 is located at an outer wall of the pin receptacle 26.

The second closure part 3 includes a blocking element 33, which is formed as an elastic blocking tongue at a base body 30 of the second closure part 3.

The mode of operation of the closure device 1 can be taken from FIGS. 14A-14E as well as FIGS. 15A-15E.

Figure 14A:
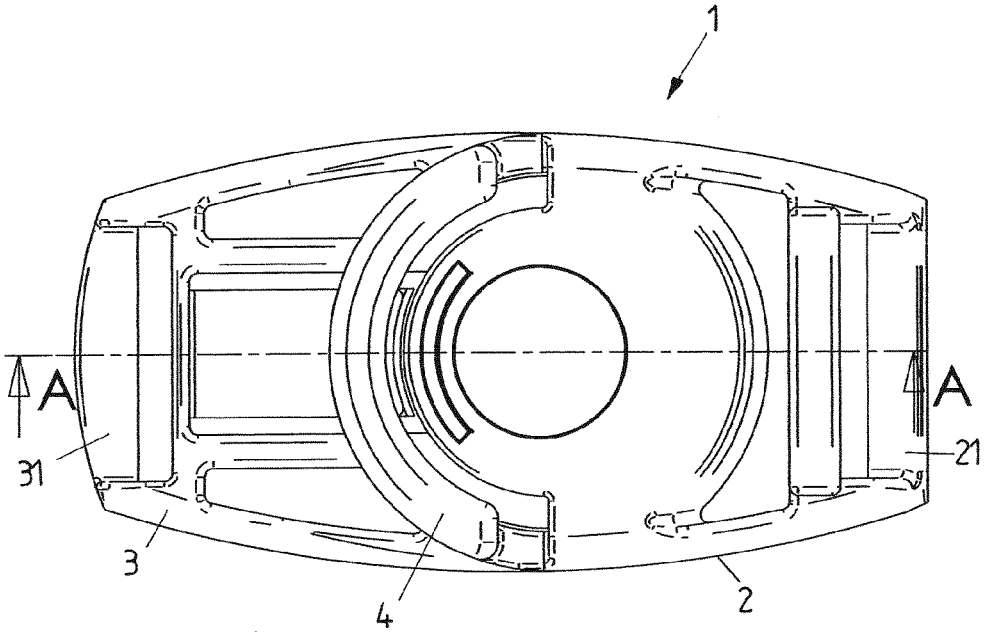
FIGS. 14A-14E show top views of the closure device in different positions.
Figure 15A:
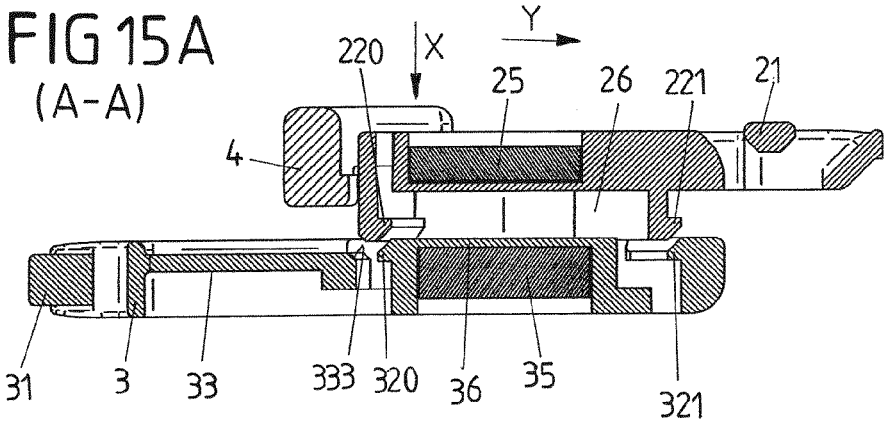
FIGS. 15A-15E show sectional views along line A-A in the respectively associated FIG. 14A-14E.
Figure 14B:
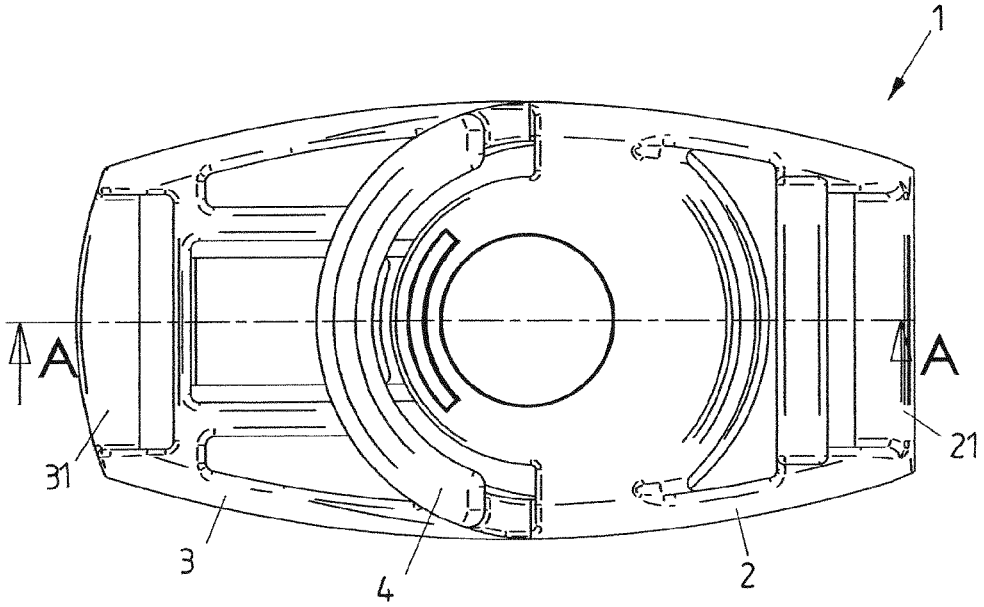
Figure 15B:
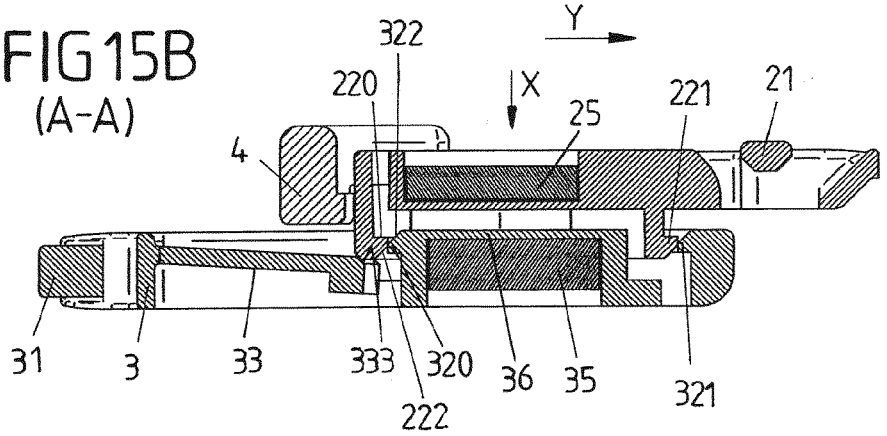
Figure 14C:
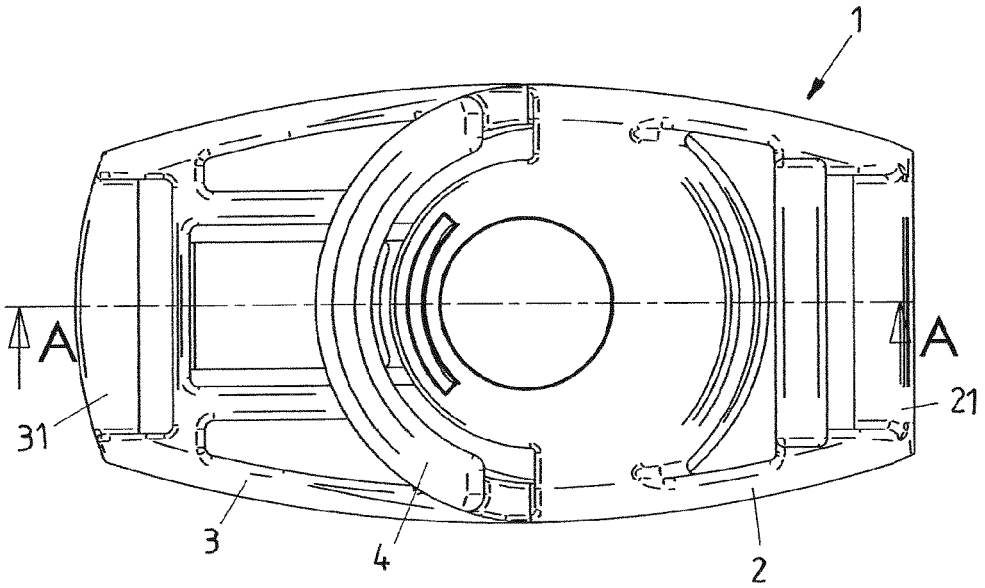

For closing, the first closure part 2 is attached to the second closure part 3 in a closing direction X. The engaging protrusions 220, 221 with run-up slopes each run up onto the associated engaging protrusions 320, 321 of the second closure part 3, so that the first closure part 2 is offset relative to the second closure part 3 against the engagement direction Y (FIGS. 14A, 15A).

Figure 15C:
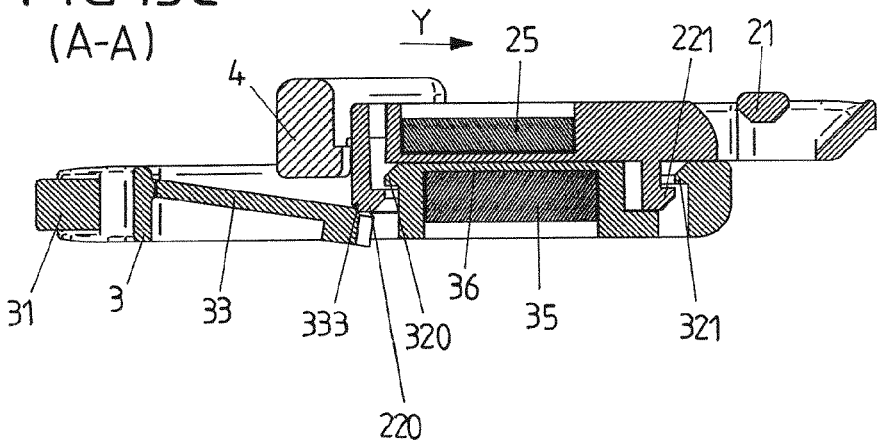
Figure 14D:
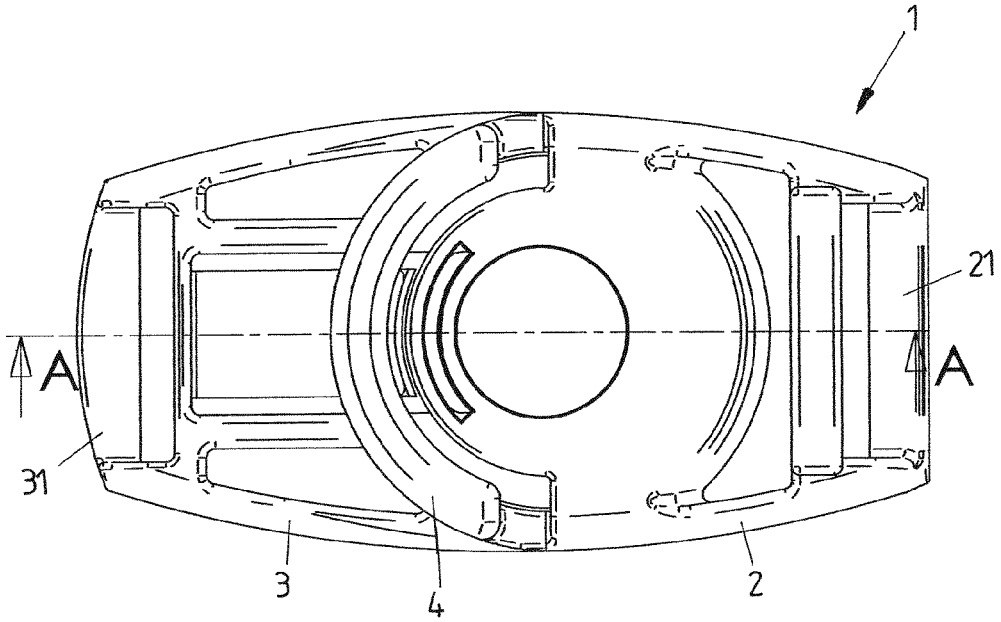
Figure 15D:
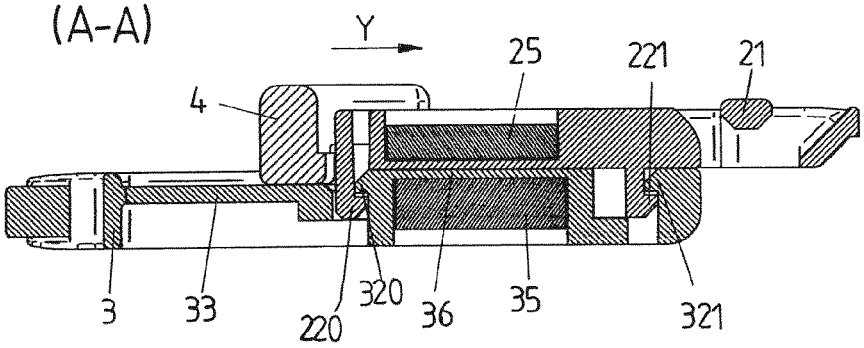

During attachment, an engaging protrusion 220 of the two engaging protrusions 220, 221 of the first closure part 2 also gets in contact with the blocking element 33 and pushes the same out of is normal position in the closing direction X (FIGS. 14B, 15B), until the engaging protrusions 220, 221 get in engagement with each other in the engagement direction Y (FIGS. 14C, 15C and FIGS. 14D, 15D). In the closed position (FIGS. 14D, 15D), the engaging protrusions 220, 221, 320, 321 are positively in engagement with each other, wherein the engagement of the engaging protrusion 220 of the first closure part 2 as shown on the left in FIG. 15D is secured by the blocking element 33 against the engagement direction Y.

As shown for example in FIG. 15C, the blocking element 33 is bent elastically and thereby pretensioned on attachment of the first closure part 2 to the second closure part 3. This pretensioning force with at least one force component thereby acts on the engagement protrusion 220 in the engagement direction Y, so that in the pretensioned condition the contact surfaces between the blocking element 33 and the engaging protrusion 220 no longer are parallel, but at an angle to each other, and the engagement of the engaging protrusions 220, 221 with the engaging protrusions 320, 321 in the engagement direction Y is mechanically supported by the blocking element 33 due to the spring pretension. This effect advantageously can even be enhanced in that slopes 333 are provided at the blocking element 33 and/or the engaging protrusion 220, with which the blocking element 33 and the engaging protrusion 220 rest against each other in the pretensioned condition and which convert at least a part of the pretension into a force component directed in the engagement direction Y, which supports the engagement.

At the closure parts 2, 3 magnets 25, 35 in turn are arranged, which magnetically attract each other and magnetically support the attachment of the closure parts 2, 3. In this respect, reference is also made to the explanations of the preceding exemplary embodiments.

Figure 14E:
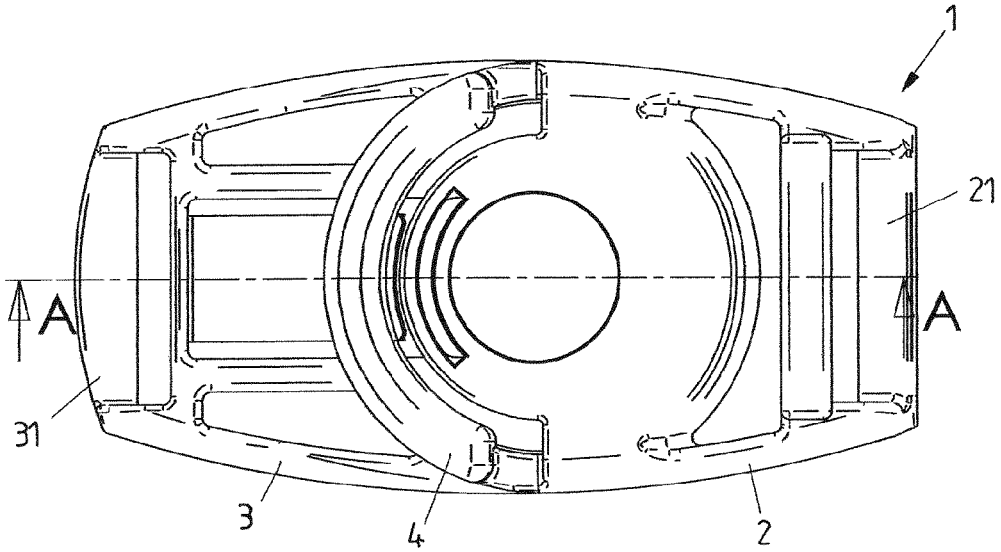
Figure 15E:
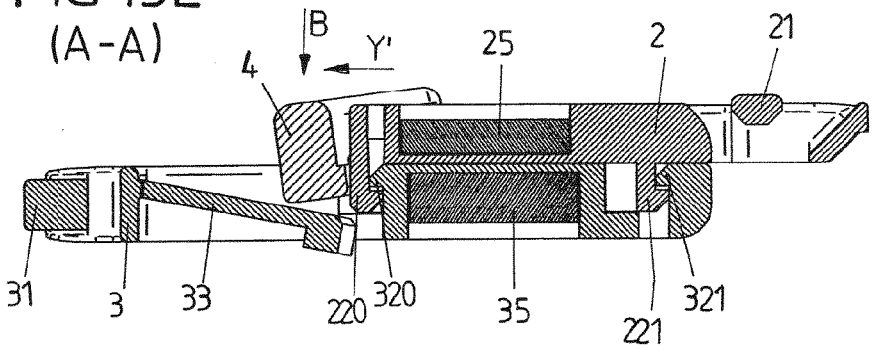
Figure 16A:
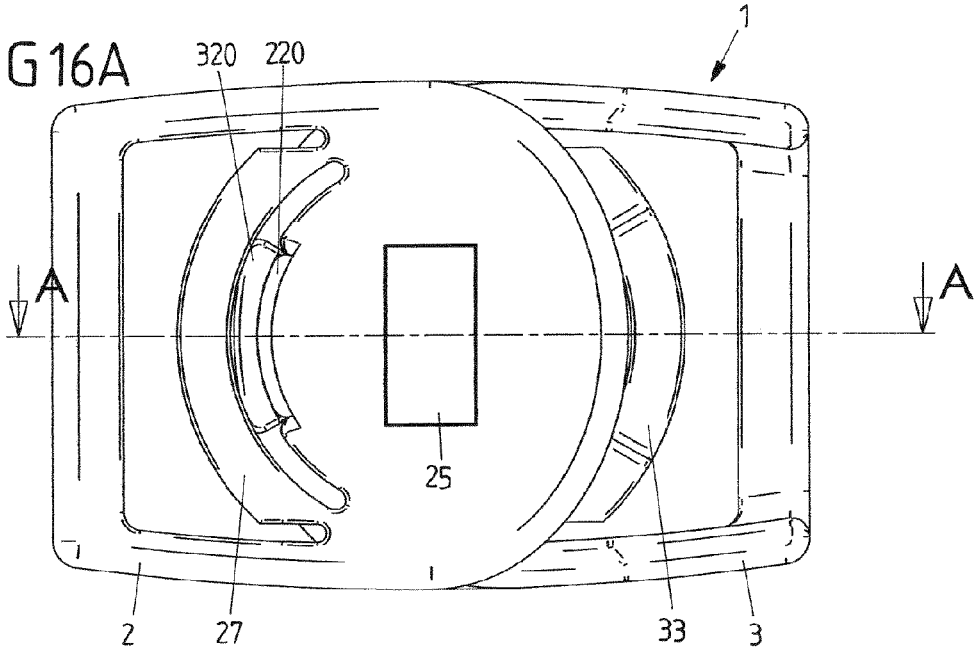
FIGS. 16A-16D show top views of a further exemplary embodiment of a closure device.

At the first closure part 2, an actuating mechanism 4 is arranged in the form of an actuating element 4 elastically connected with a base body 20 of the first closure part 2 and formed integrally with the base body 20, which for opening the closure device 1 is depressed in an actuating direction B directed along the closing direction X, so that the actuating element 4 acts on the blocking element 33 and moves the same out of a blocking normal position (FIGS. 14E, 15E). The engaging protrusion 220 thus is cleared, so that the first closure part 2 can be moved relative to the second closure part 3 in a release direction Y' opposite to the engagement direction Y, and in this way the engaging protrusions 220, 221, 320, 321 can be moved out of engagement with each other.

This is advantageous in particular because a user can perform the two operations necessary for opening (elimination of the blockage by the blocking piece and elimination of the engagement of the engaging protrusions) with one actuation.

In a further exemplary embodiment of a closure device 1 as shown in FIGS. 16A-16D as well as 17A-17D and 18A, 18B, two closure parts 2, 3 are formed identical in construction and each include two engaging protrusions 220, 221, 320, 321. Due to the fact that the closure parts 2, 3 are formed as identical parts, a particularly easy manufacture is obtained, because only one tool is required for manufacturing the closure parts for example by mechanism of plastics injection molding.

The closure parts 2, 3 each include a blocking element 27, 33 which in a closed position of the closure device 1 blockingly cooperates with an associated engaging protrusion 320, 221 of the respectively other closure part 3, 2.

The mode of operation of the closure device 1 can be taken from FIGS. 16A-16D and FIGS. 17A-17D.

Figure 17A:
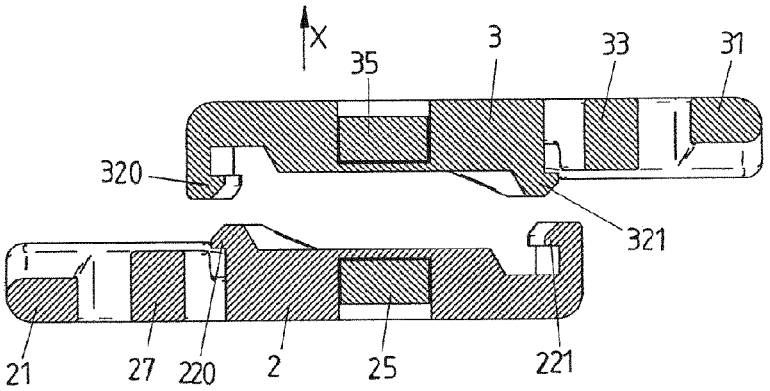
FIGS. 17A-17D show sectional views along line A-A in the respectively associated FIG. 16A-16D.
Figure 17B:
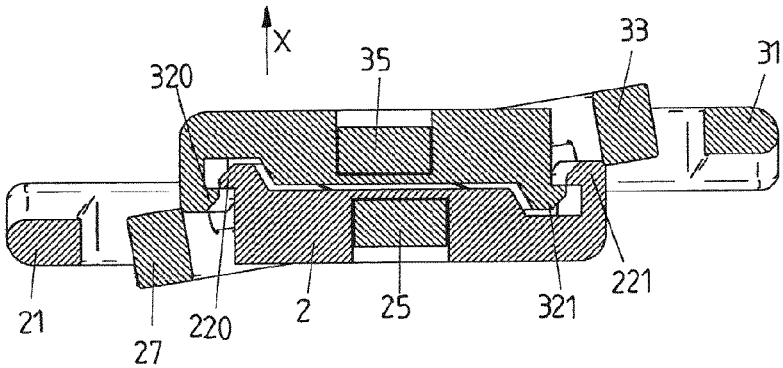
Figure 17C:
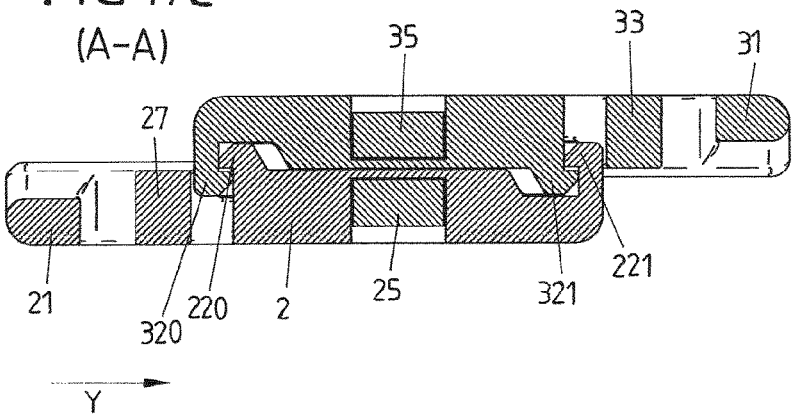

For closing, the first closure part 2 is attached to the second closure part 3 in the closing direction X, whereby the blocking elements 27, 33 are moved out of their normal position by cooperating with the engaging protrusion 320, 221 of the respectively other closure part 3, 2 (see FIGS. 17A and 17B). By pushing aside the blocking elements 27, 33, the engaging protrusions 220, 221, 320, 321 can be brought in engagement with each other, in that the first closure part 2 is moved relative to the second closure part 3 in the engagement direction Y, until in the closed position (FIGS. 16C, 17C) the engaging protrusions 220, 221, 320, 321 positively are in engagement with each other. When transferring the engaging protrusions 220, 221, 320, 321 in the closed position, the blocking elements 27, 33 again get back into their normal position in which they block a movement of the first closure part 2 relative to the second closure part 3 against the engagement direction Y, so that the engagement of the engaging protrusions 220, 221, 320, 321 is secured against the engagement direction Y.

Figure 16B:
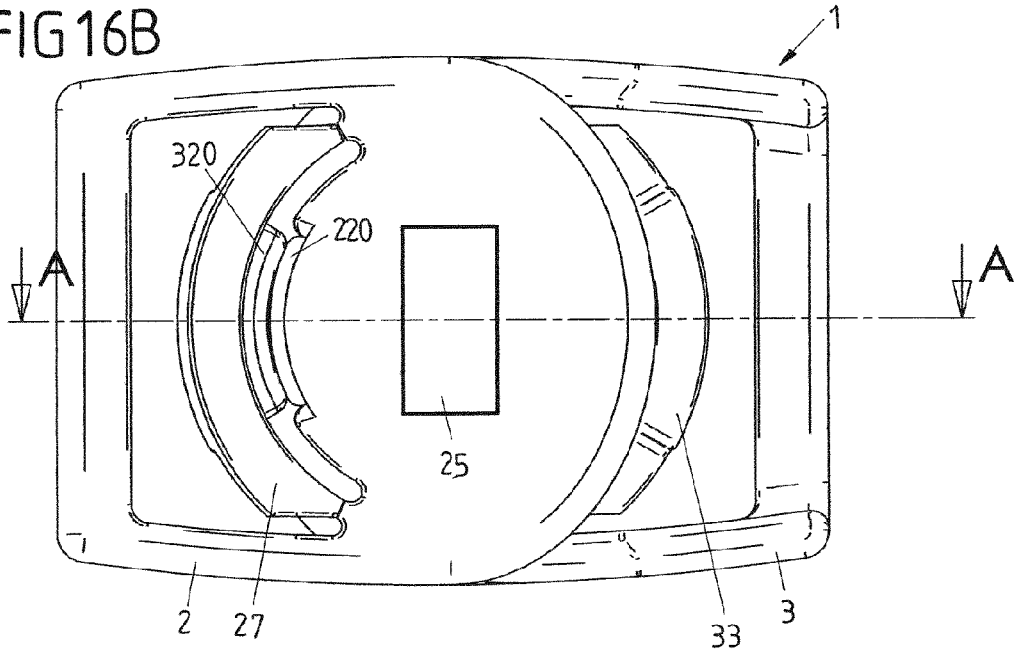
Figure 16C:
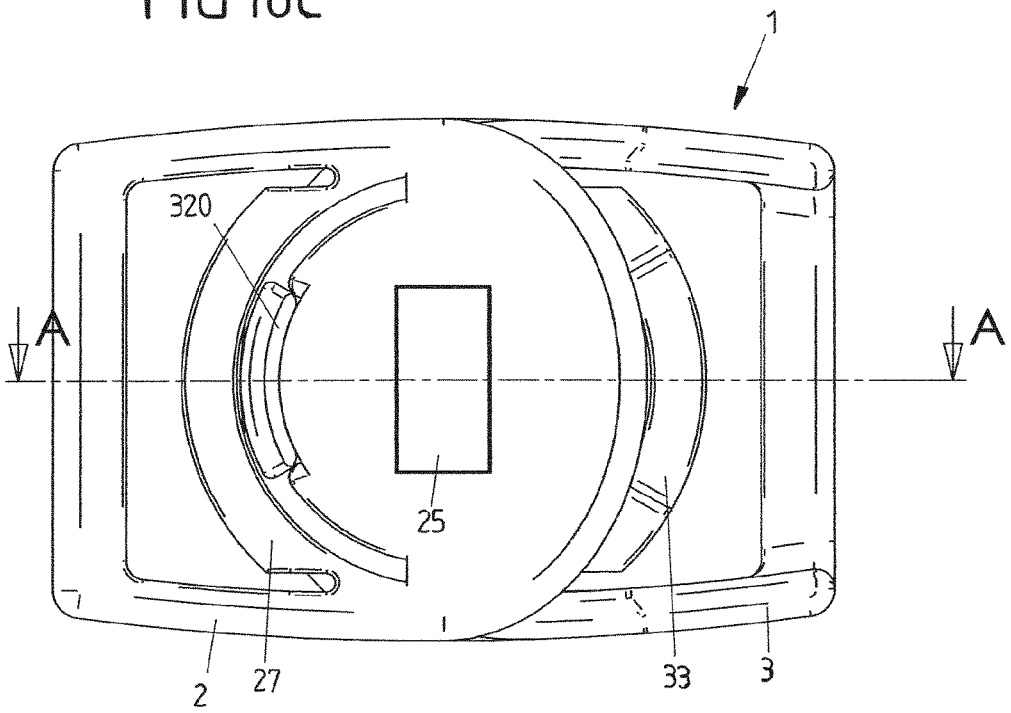
Figure 16D:
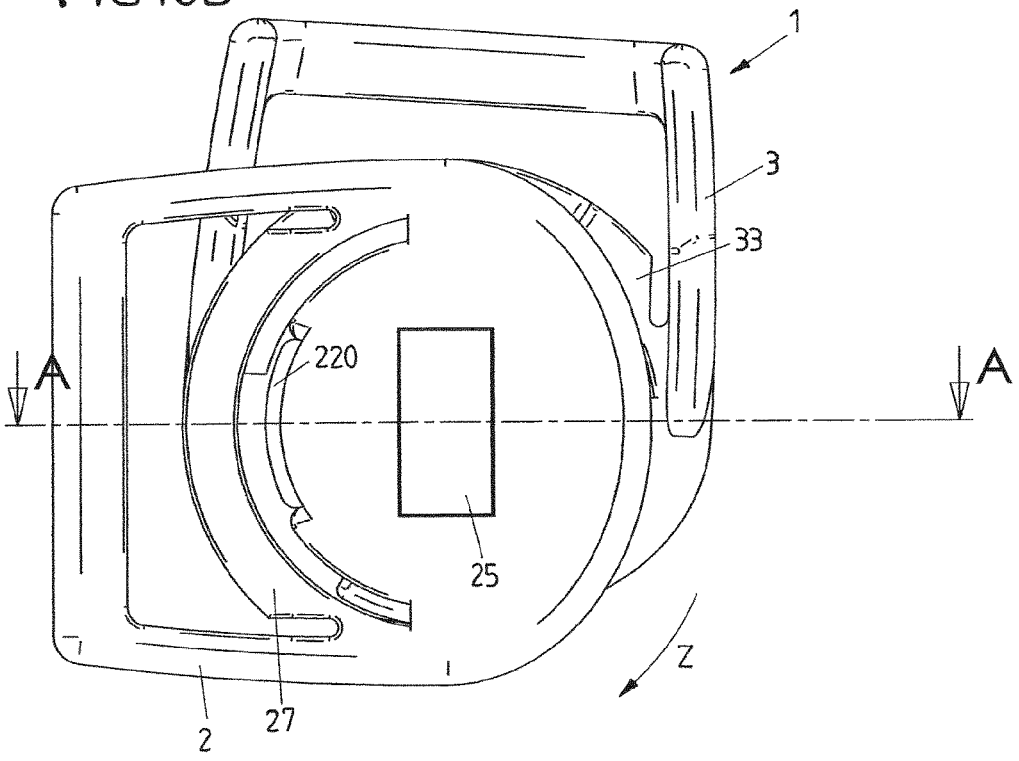
Figure 17D:
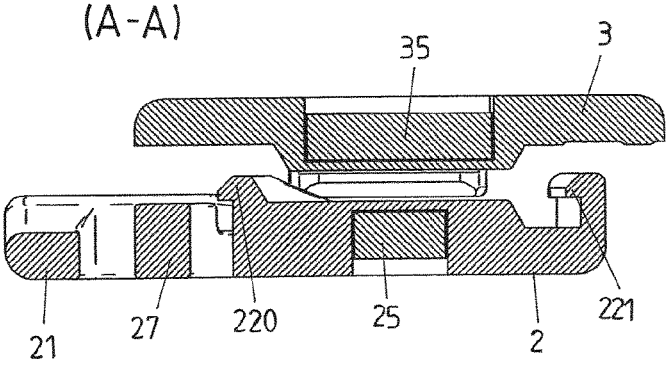

To open the closure device 1, the first closure part 2 can be rotated relative to the second closure part 3 in an actuating direction Z, whereby the engaging protrusions 220, 221 of the first closure part 2 are brought out of engagement with the engaging protrusions 320, 321 of the second closure part 3 in the opening direction Z (FIGS. 16D, 17D). At the same time, the engaging protrusions 220, 321 thus get out of the region of the blocking elements 27, 33, so that the blocking mechanism 27, 33 no longer block the closure device 1. In the now open position, the closure parts 2, 3 can be removed from each other.

Figure 18A:
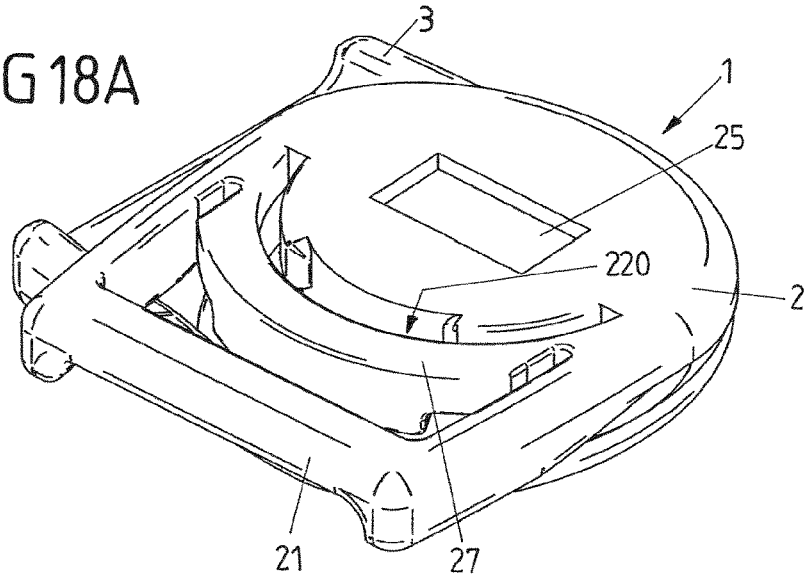
FIG. 18A shows a perspective view of the closure device in an open position.
Figure 18B:
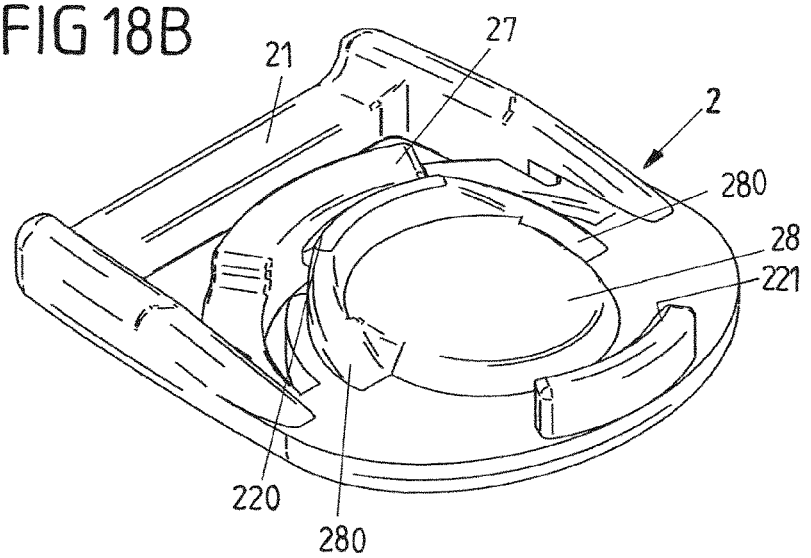
FIG. 18B shows a separate view of a closure part of the closure device.

During opening by rotating the first closure part 2 relative to the second closure part 3 in the opening direction Z, ramps 280 run up onto each other on a platform 28 of the closure parts 2, 3 (see FIG. 18B, in which the first closure part 2 is shown in a separate view; the second closure part 3 is identical in construction). Due to the ramps 280 of the closure parts 2, 3 running up onto each other, the first closure part 2 is separated from the second closure part 3 against the closing direction X on opening of the closure device 1, which is advantageous, in order to at the same time on opening effect a weakening of the magnetic forces acting between the magnets 25, 35 of the closure parts 2, 3. For opening, the first closure part 2 is rotated relative to the second closure part 3 by about 90° (FIG. 16B). Opening is possible by rotating both in the opening direction Z and against the opening direction Z, so that the first closure part 2 can be rotated relative to the second closure part 3 in both directions.

The magnets 25, 35 advantageously are designed as rectangular magnets. When approaching each other, the magnets 25, 35 thereby are aligned such that the closure parts 2, 3 preferably are oriented in the longitudinally aligned position as shown in FIGS. 16A-16C, FIGS. 17A-17C. During a rotation, a magnetic backdriving torque is obtained, which in particular in the case of an only slight, possibly inadvertent deflection again sets the closure parts 2, 3 back into their longitudinally aligned orientation corresponding to the closed position.

Figure 19A:
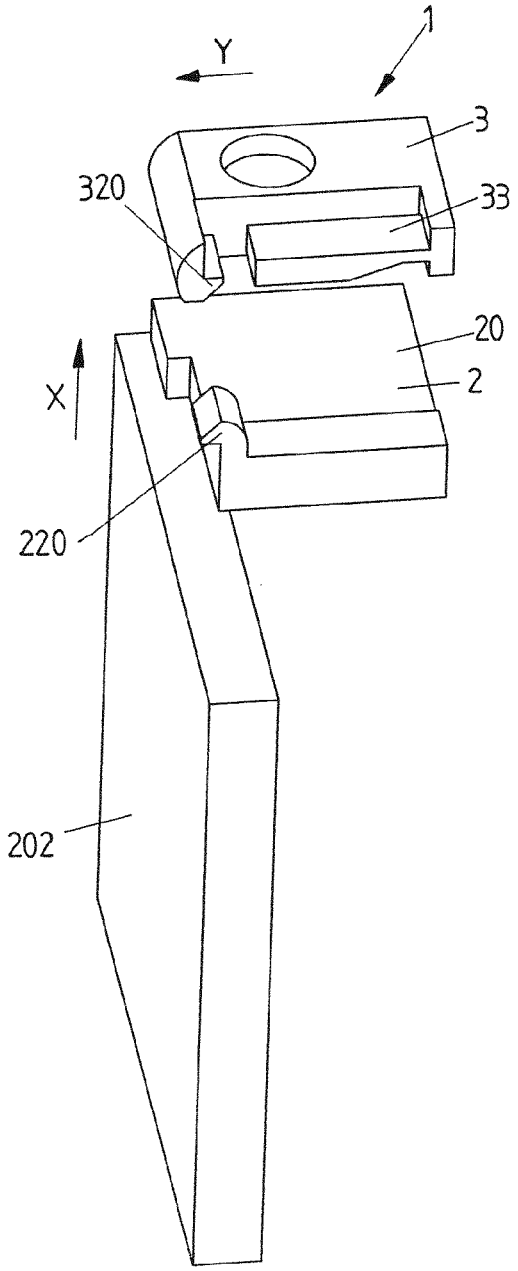
FIGS. 19A-19F show perspective views of a further exemplary embodiment of a closure device in different positions.
Figure 19B:
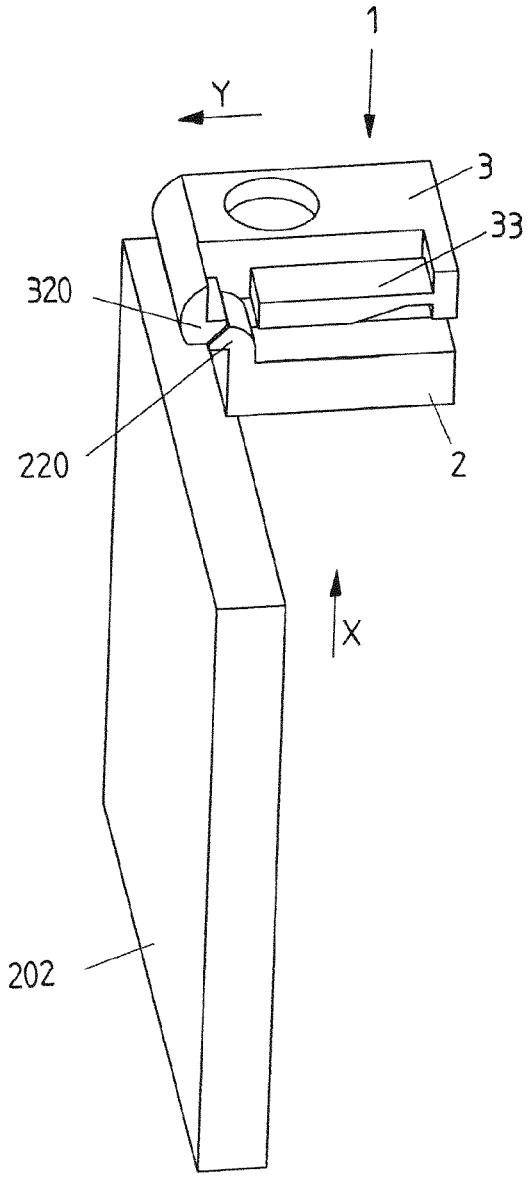
Figure 19C:
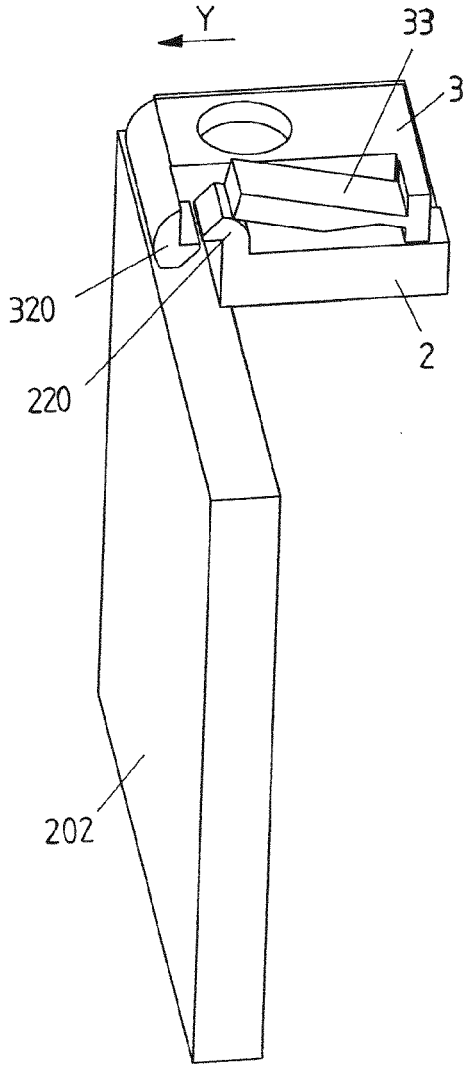
Figure 19D:
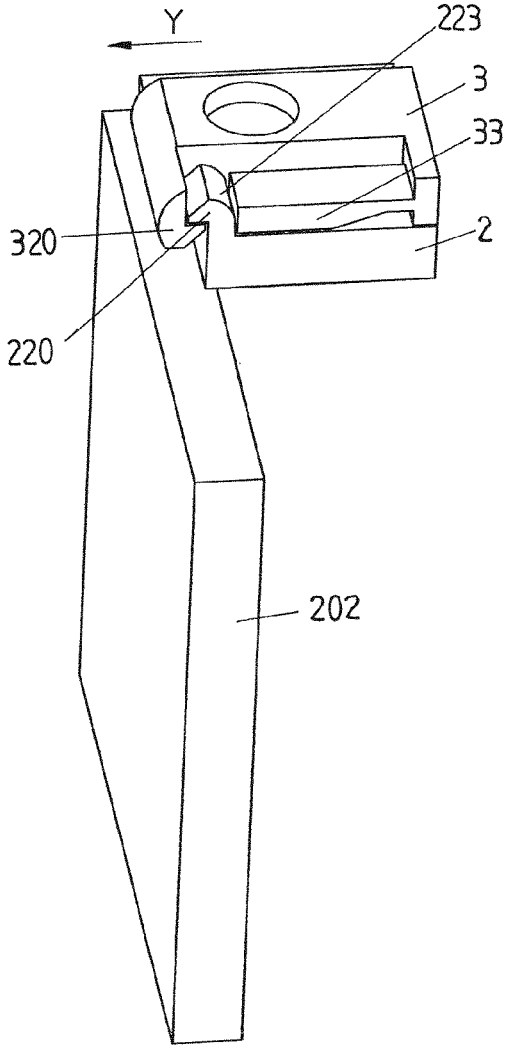
Figure 19E:
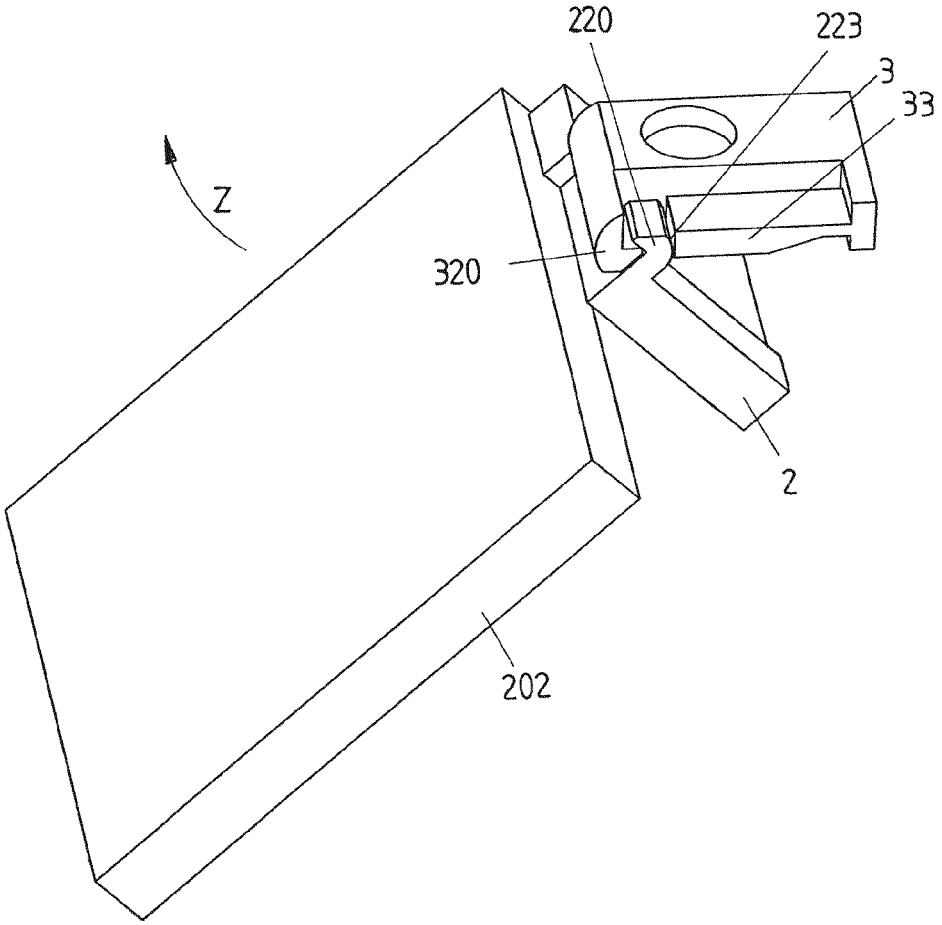
Figure 19F:
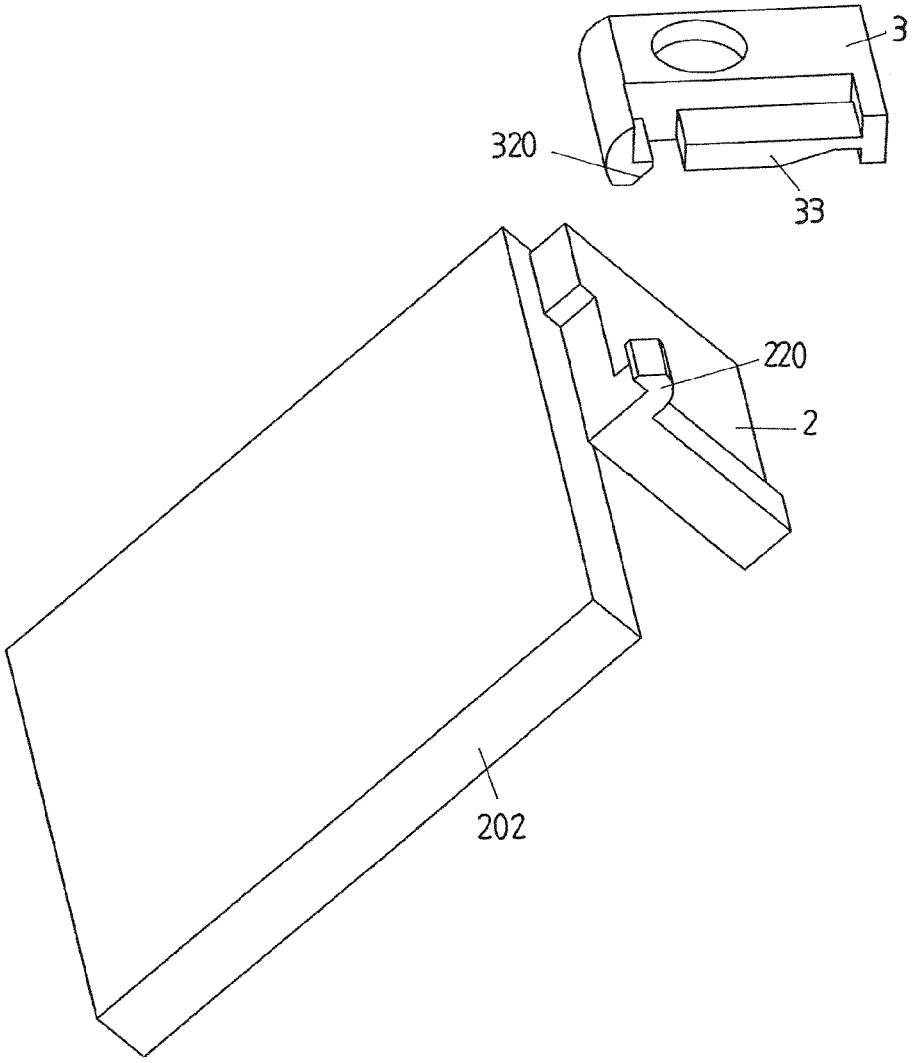

In a further exemplary embodiment of a closure device 1 as shown in FIGS. 19A-19F, a first closure part 2 can be attached to a second closure part 3 in a closing direction X. During attachment (FIGS. 19A, 19B), engaging protrusions 220, 320 of the first closure part 2 and of the second closure part 3 run up onto each other, so that the engaging protrusions 220, 320 slide along each other along run-up slopes and the first closure part 2 is offset relative to the second closure part 3 against an engagement direction Y. A blocking element 33 of the second closure part 3 also is pushed aside in closing direction X (FIG. 19C), so that the engaging protrusion 220 of the first closure part 2 can be moved past the engaging protrusion 320 of the second closure part 3, until the engaging protrusions 220, 320 can be positively brought in engagement with each other in the engagement direction Y (FIG. 19D). In the closed position (FIG. 19D), the blocking element 33 again is in its normal position in which the blocking element 33 blockingly acts on the engaging protrusion 220 of the first closure part 2 and thus secures the engagement of the engaging protrusions 220, 320 with each other. For opening, the first closure part 2 can be pivoted in an opening direction Z together with an object 202 arranged thereon. The engaging protrusion 220 with a rounded portion 223 moves along an end face of the blocking element 33, so that the positive engagement between the engaging protrusion 220 and the engaging protrusion 320 against the closing direction X is eliminated and the first closure part can be removed from the second closure part 3 against the closing direction X (FIG. 19F).

With the exemplary embodiment shown in FIGS. 19A-19F for example a pair of glasses (for example ski goggles) or a vizor or the like can be fixed at a helmet (for example a ski helmet).

Figure 20:
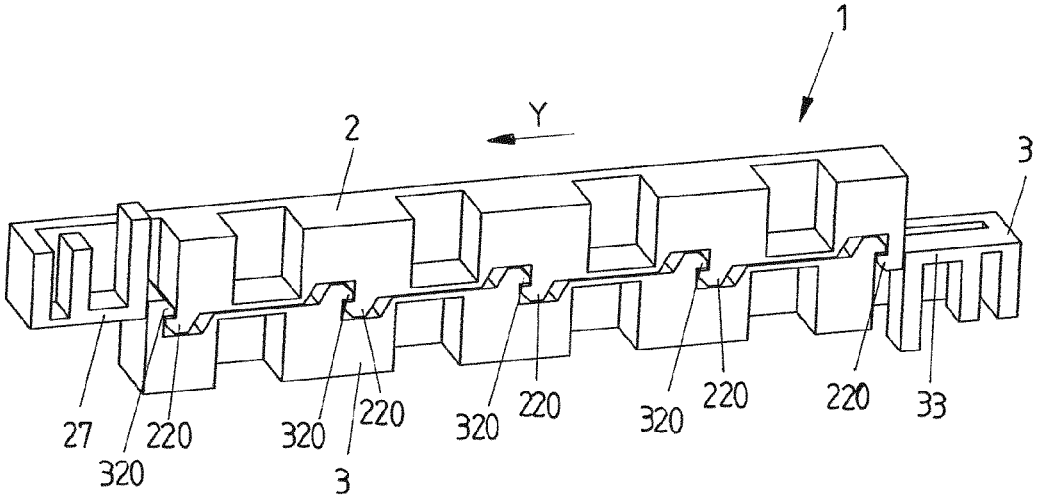
FIG. 20 shows a partly sectional view of a closure device with closure parts which each include engaging protrusions, wherein the engaging protrusions are arranged in a row.

In the exemplary embodiment of a closure device 1 as shown in FIG. 20, two closure parts 2, 3 formed as identically constructed parts each include a plurality of engaging protrusions 220, 320, which are arranged in a row at the respectively associated closure part 2, 3. The engaging protrusions 220, 320 are brought in engagement with each other by attaching the closure parts 2, 3 in a closing direction, wherein in the closed position shown in FIG. 20 the hold of the engaging protrusions 220, 320 at each other is secured by two blocking elements 27, 33 of the closure parts 2, 3, so that the engagement of the engaging protrusions 220, 320 cannot easily be eliminated.

For actuation, the blocking elements 27, 33 can be actuated by hand, in that they are bent out of their blocking engagement with the associated engaging protrusions 320, 220. After moving the blocking elements 27, 33 away, the engaging protrusions 220, 320 then can be moved towards each other against the engagement direction Y, so that the closure parts 2, 3 can be separated from each other.

Figure 21:
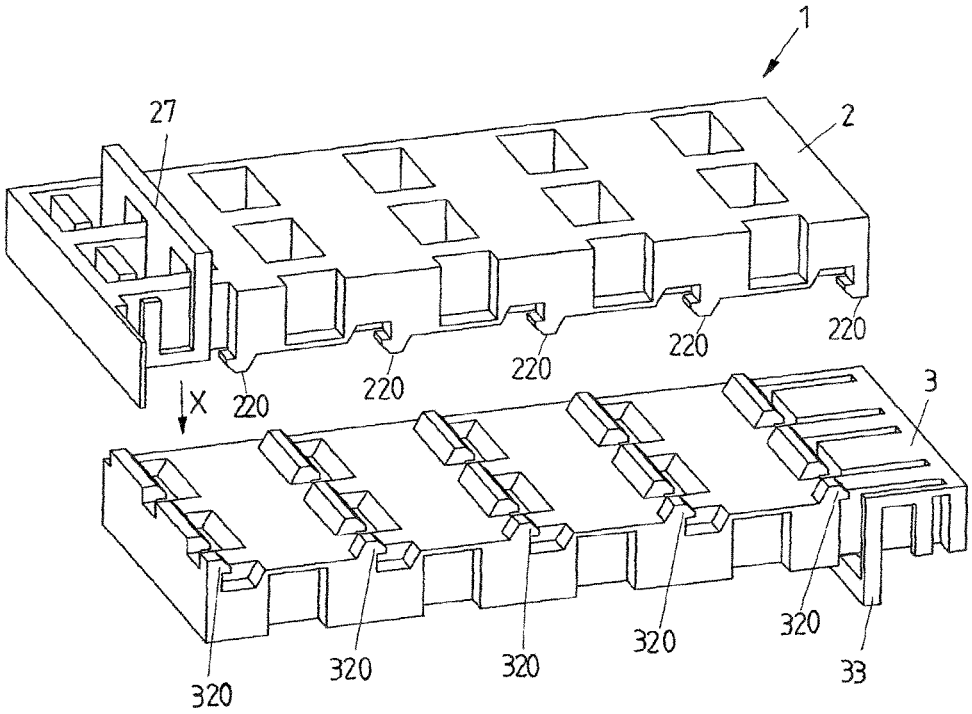
FIG. 21 shows a partly sectional, perspective view of an exemplary embodiment of a closure device in which the closure parts each include several engaging protrusions, wherein the engaging protrusions are arranged at the closure parts in the manner of a matrix.

In the exemplary embodiment of FIG. 21, in a modification of the exemplary embodiment of FIG. 20, a plurality of engaging protrusions 220, 320 each are arranged at two closure parts 2, 3 in the manner of a two-dimensional matrix. At each closure part 2, 3 a blocking element 27, 33 in turn is arranged, so that in the closed position the engagement of the engaging protrusions 220, 320 with each other is blocked.

In principle, the number of the engaging protrusions 220, 320 at a closure part 2, 3 need not correspond with the number of the blocking elements 27, 33. In principle, one blocking element 27, 33 at a closure part 2, 3 is sufficient, in order to blockingly secure the engagement of the engaging protrusions 220, 330, wherein for secure blocking it is also possible to provide a plurality of blocking elements 27, 33 either at the first closure part 2 or at the second closure part 3 or at both closure parts 2, 3.

Figure 22A:
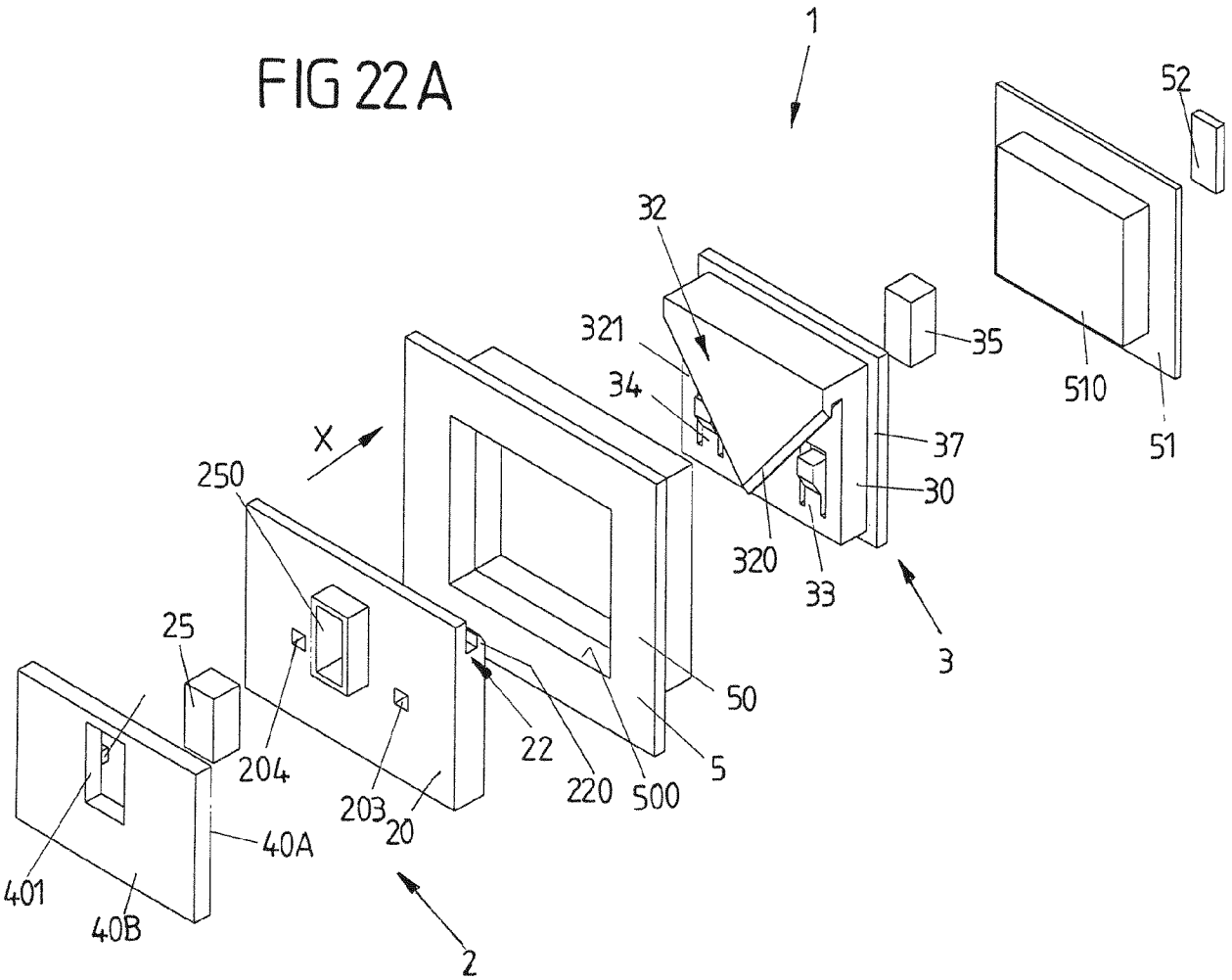
FIGS. 22A, 22B show perspective exploded views of a further exemplary embodiment of a closure device, in which one of the closure parts is retractable.
Figure 22B:
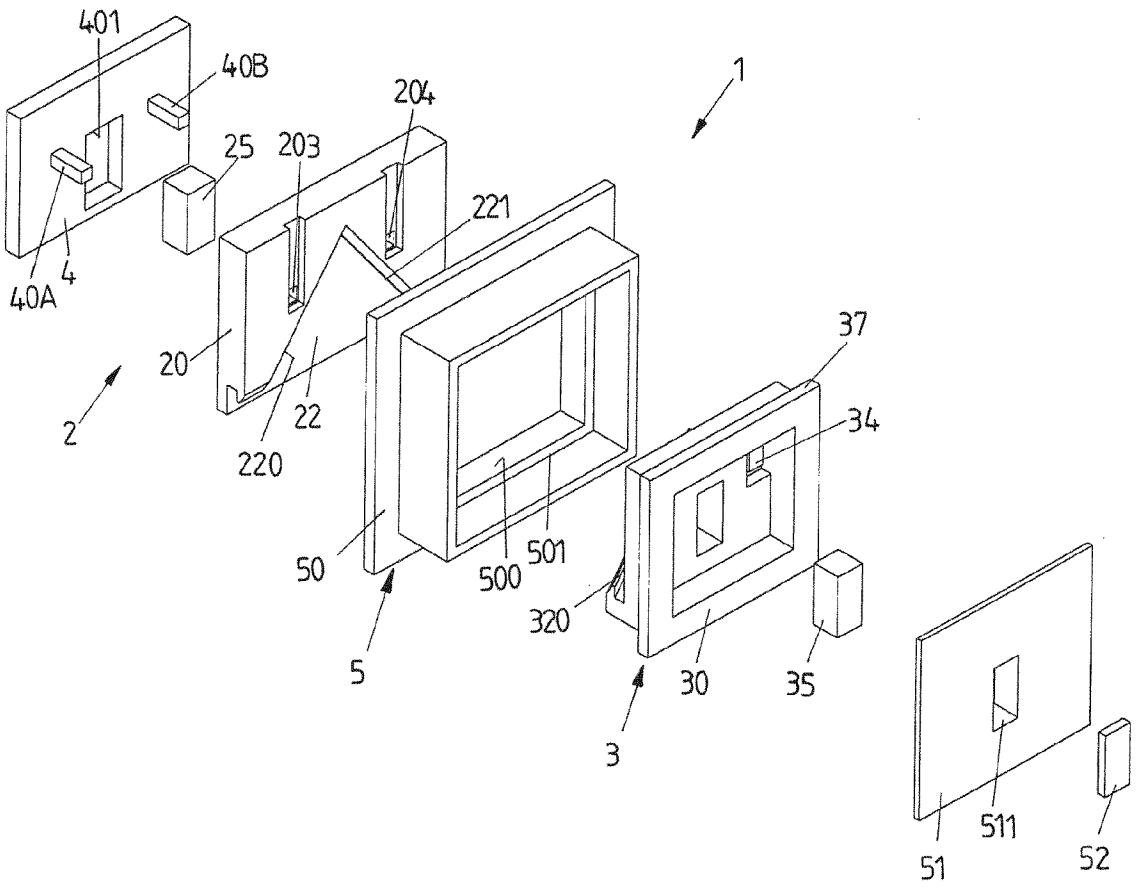
Figure 23A:
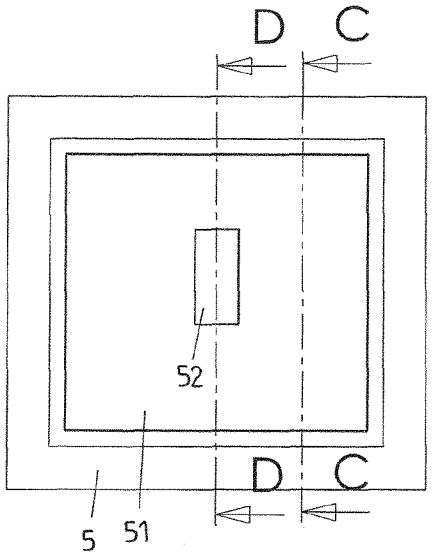
FIGS. 23A-23E show top views of the closure device in different positions.

In the exemplary embodiment of a closure device 1 as shown in FIGS. 22A, 22B as well as FIGS. 23A-23E, 24A-24E and FIGS. 25A-25E two closure parts 2, 3 are provided, of which a second closure part 3 is retractably arranged at a housing 5.

A first closure part 2 includes engaging protrusions 220, 221, which are formed similar to the exemplary embodiment of FIGS. 1 to 5. At the first closure part 2, an actuating mechanism 4 is arranged in the form of a push button which serves for opening the closure device 1. The push button 4 includes actuating parts 40A, 40B which extend through openings 203, 204 at a base body 20 of the first closure part 2 and serve for acting on blocking elements 33, 34 of the second closure part 3. The push button 4 includes an opening 401 which is in engagement with a magnet receptacle 250 of the first closure part 3. At the magnet receptacle 250 a magnet 25 of the first closure part 2 is retained.

The second closure part 3 likewise includes engaging protrusions 320, 321. At the second closure part 3 blocking elements 33, 34 are arranged in addition. In so far, the second closure part 3 is similar to the second closure part 3 according to the exemplary embodiment of FIGS. 1 to 5.

The second closure part 3 is arranged at a housing 5 and can be shifted in the housing 5 along the closing direction X in which the closure parts 2, 3 can be attached to each other. The housing 5 includes a base body 50 with an opening 500, at which a stop 501 is arranged for limiting the shifting path of the second closure part 3. At the base body 50 a bottom 51 is arranged, on which a magnet 52 is retained at a magnet receptacle 511 (the magnet 52 also can be formed as ferromagnetic armature).

The mode of operation of the closure device 1 will be explained below with reference to FIGS. 23A-23E, 24A-24E and 25A-25E.

Figure 24A:
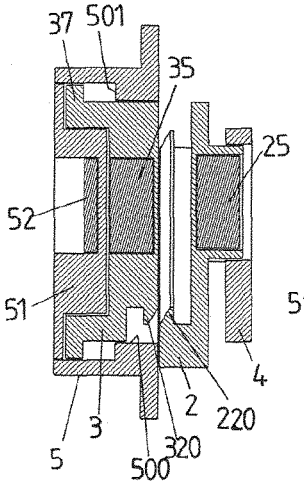
FIGS. 24A-24E show sectional views along line D-D in the respectively associated FIG. 23A-23E.
Figure 25A:
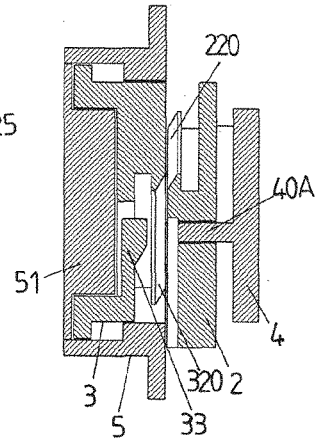
FIGS. 25A-25E show sectional views along line C-C in the respectively associated FIG. 23A-23E.
Figure 24B:
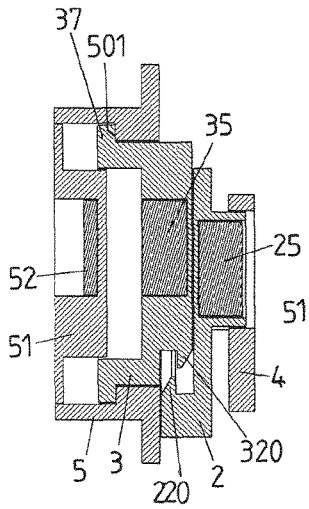
Figure 25B:
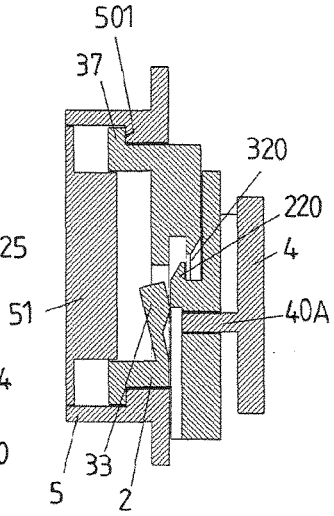

In a starting condition before closing the closure device 1, the second closure part 3 is in a retracted position inside the housing 5 (FIG. 24A). After opening the closure device 1, the second closure part 3 is pulled into this retracted position, in that the magnet 52 at the bottom 51 of the housing 5 cooperates with the magnet 35 of the second closure part 3 in a magnetically attracting manner and thus produces a force of magnetic attraction on the second closure part 3 into the housing 5.

When the closure device 1 is to be closed, the first closure part 2 is approached to the housing 5, so that the magnet 25 of the first closure part 2 also is approached to the magnet 35 of the second closure part 3. Due to the force of magnetic attraction between the magnets 25, 35, the second closure part 3 is extended from its retracted position in the housing 5 (FIG. 24B), so that the second closure part 3 gets into an extended position in which the first closure part 2 can be brought in engagement with the second closure part 3.

The shifting path of the second closure part 3 in the housing 5 here is limited by the stop 501 at the housing 5 as well as a stop 37 at the second closure part 3. In the extended position, these stops 501, 37 are in contact with each other, so that the second closure part 3 is in a defined position at the housing 5. In this position, at least the engaging protrusion 320 of the second closure part 3 protrudes from the opening 500 of the housing 5.

Figure 23B:
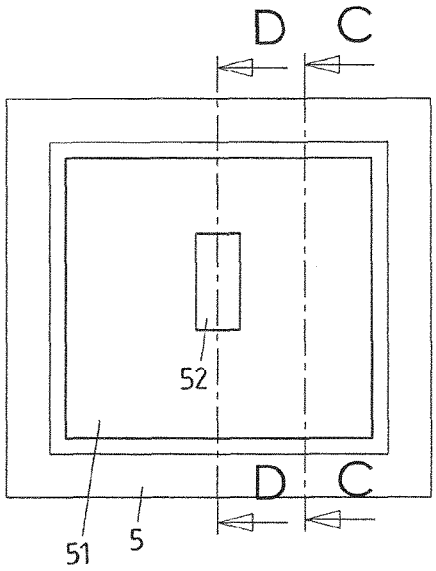
Figure 23C:
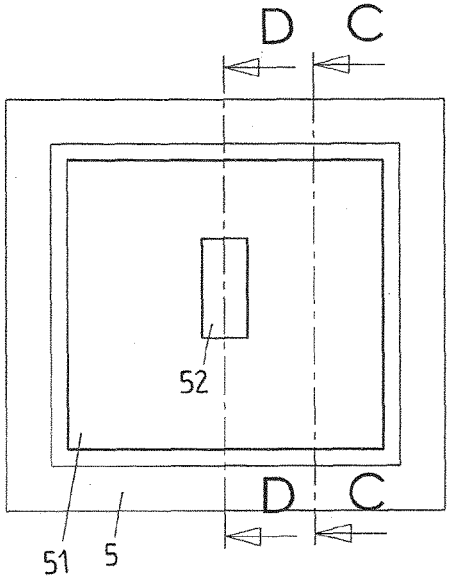
Figure 24C:
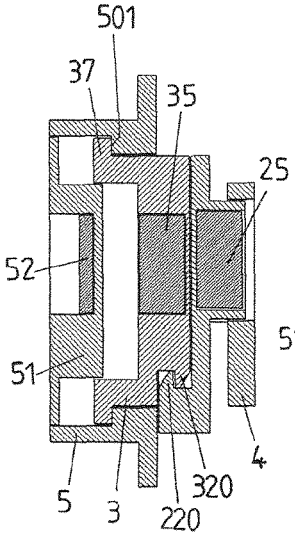
Figure 25C:
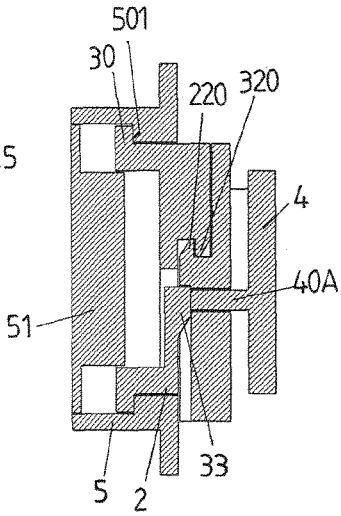
Figure 23D:
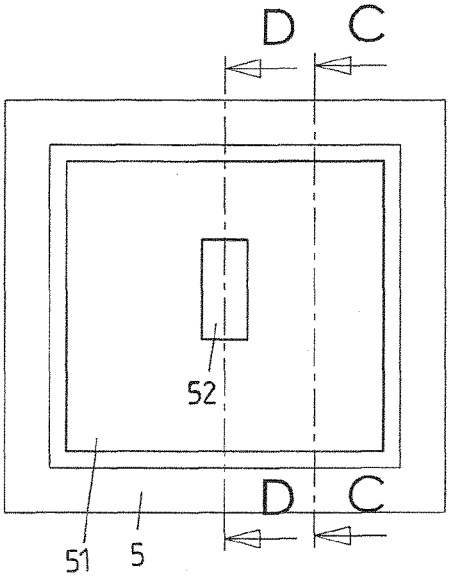
Figure 24D:
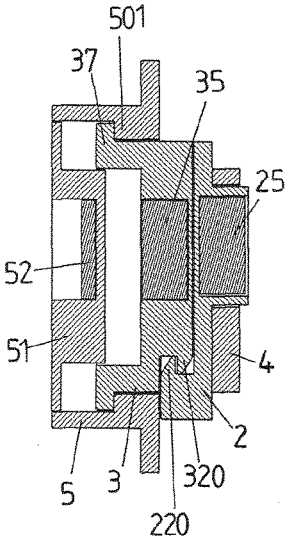

When attaching the first closure part 2 to the second closure part 3, the engaging protrusion 220 of the first closure part 2 is urged onto the blocking element 33 of the second closure part 3 (FIG. 25B), so that the blocking element 33 backs away in the closing direction X and the engaging protrusions 220, 221 of the first closure part 2 get in engagement with the engaging protrusions 320, 321 (FIGS. 23C, 24C, 25C).

In the closed position (FIGS. 23C, 24C, 25C), the engaging protrusions 220, 221, 320, 321 then are in engagement with each other, wherein the engagement against the engaging direction Y is secured by the blocking elements 33, 34.

Figure 25D:
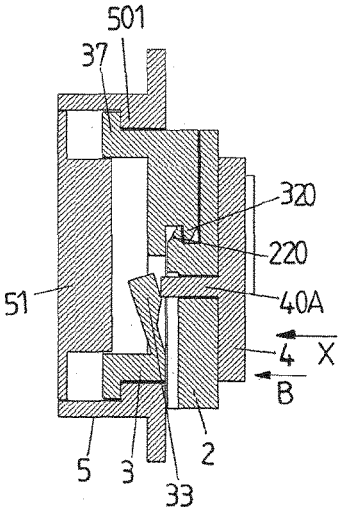
Figure 23E:
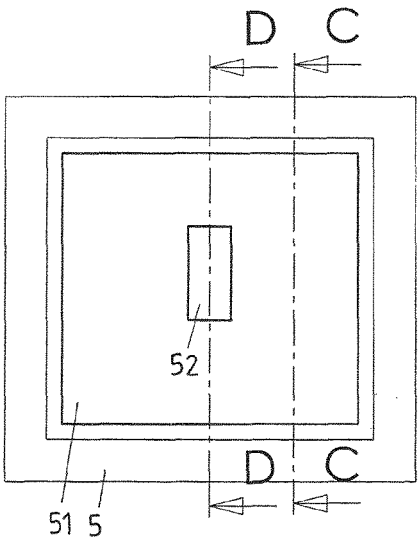
Figure 24E:
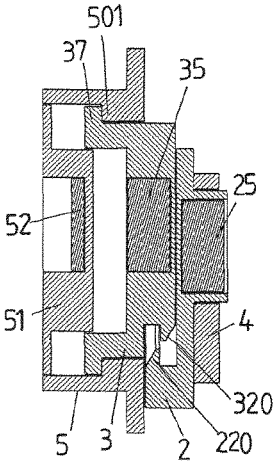
Figure 25E:
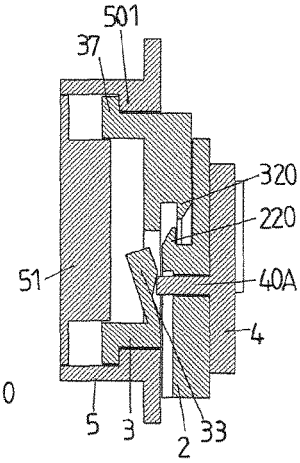

For opening, the actuating knob 4 is actuated in an actuating direction B parallel to the closing direction X, so that actuating parts 40A, 40B act on the respectively associated blocking elements 33, 34 and push the same out of their normal position (FIG. 25D). The blockage of the engagement of the engaging protrusions 220, 221, 320, 321 thus is eliminated, so that the engaging protrusions 220, 221 can be brought out of engagement with the engaging protrusions 320, 321 of the second closure part 3 against the engagement direction Y (FIGS. 23E, 24E, 25E). Out of this condition, the closure parts 2, 3 can be released from each other, so that the closure device 1 is opened.

Figure 26A:
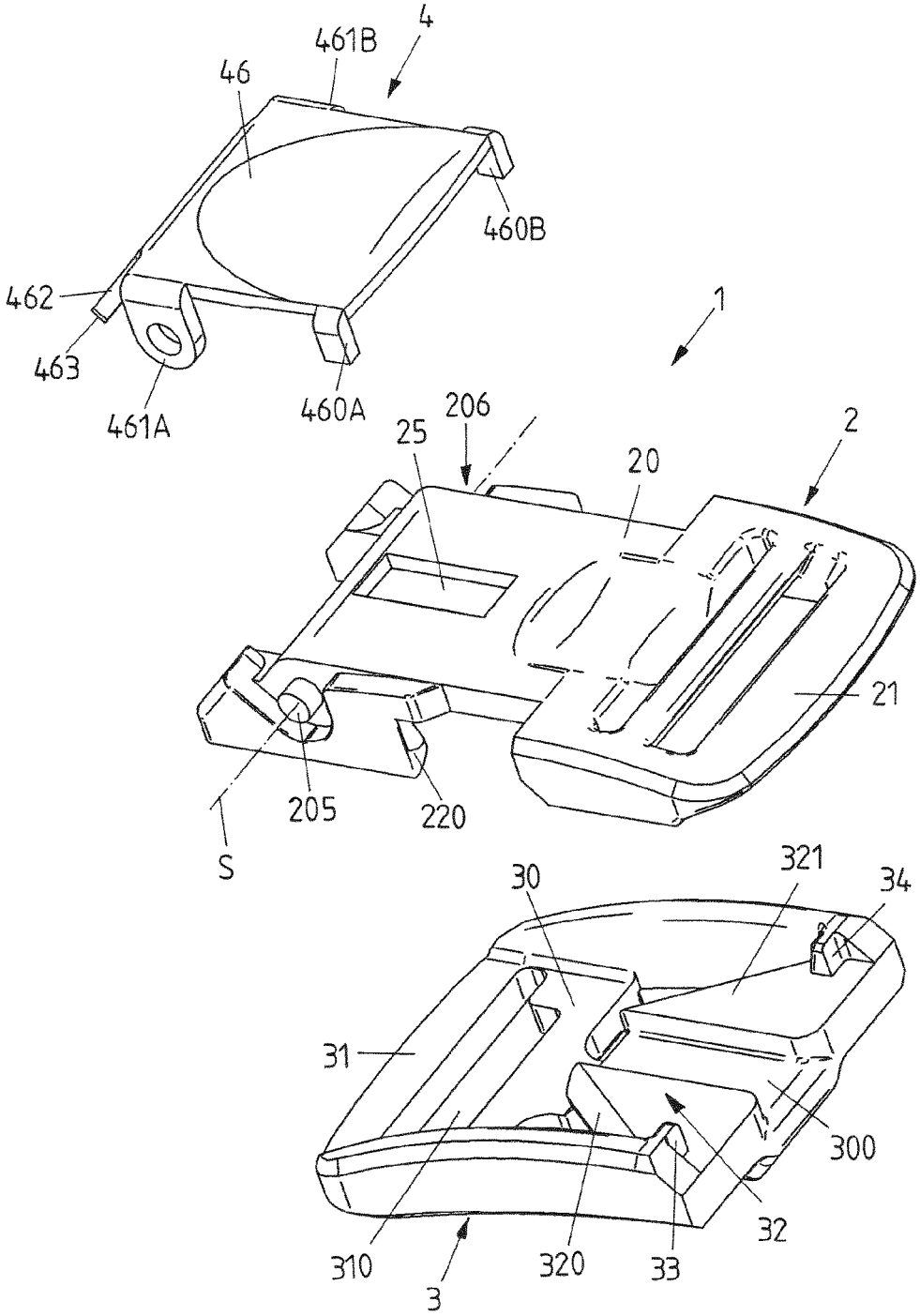
FIGS. 26A-26B show exploded views of a further exemplary embodiment of a closure device with an actuating mechanism in the form of a lever element.
Figure 26B:
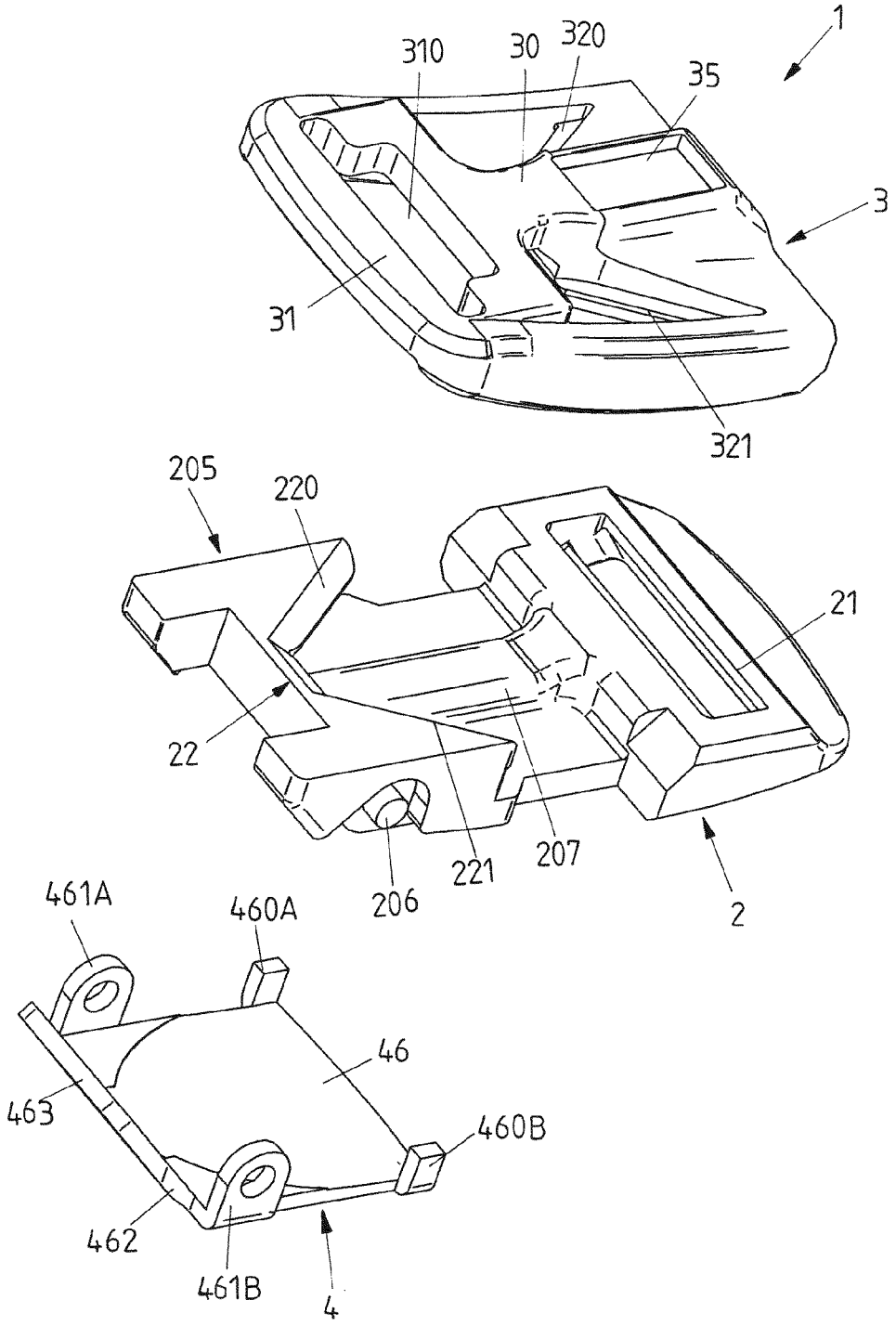

In an exemplary embodiment of a closure device 1 as shown in FIGS. 26A and 26B in two perspective exploded views and in FIGS. 27A-27D and 28A-28D in different positions two closure parts 2, 3 are provided, which in principle are formed in the manner of the exemplary embodiment described for example with reference to FIG. 1 to FIG. 5 and each include two engaging protrusions 220, 221, 320, 321, which are arranged V-shaped to each other and in the closed position of the closure device 1 positively are in engagement with each other. In this respect, reference will also be made to the above description.

In the exemplary embodiment shown in FIGS. 26 to 28, the first closure part 2 includes an actuating mechanism 4 which is formed by a lever element 46. Via two tabs, the lever element 46 is pivotally arranged at pins 205, 206 of the base body 20 of the first closure part 2 and pivotable relative to the base body 20 about a pivot axis S. At the lever element 4 two blocking noses 460A, 460B are arranged at a front end remote from the tabs 461A, 461B, which in the closed position of the closure device 1 are in engagement with blocking elements 33, 34 rigidly formed at the base body 30 of the second closure part 3 and in this way block the positive engagement between the closure parts 2, 3 in the closed position against the engagement direction Y.

Figure 27A:
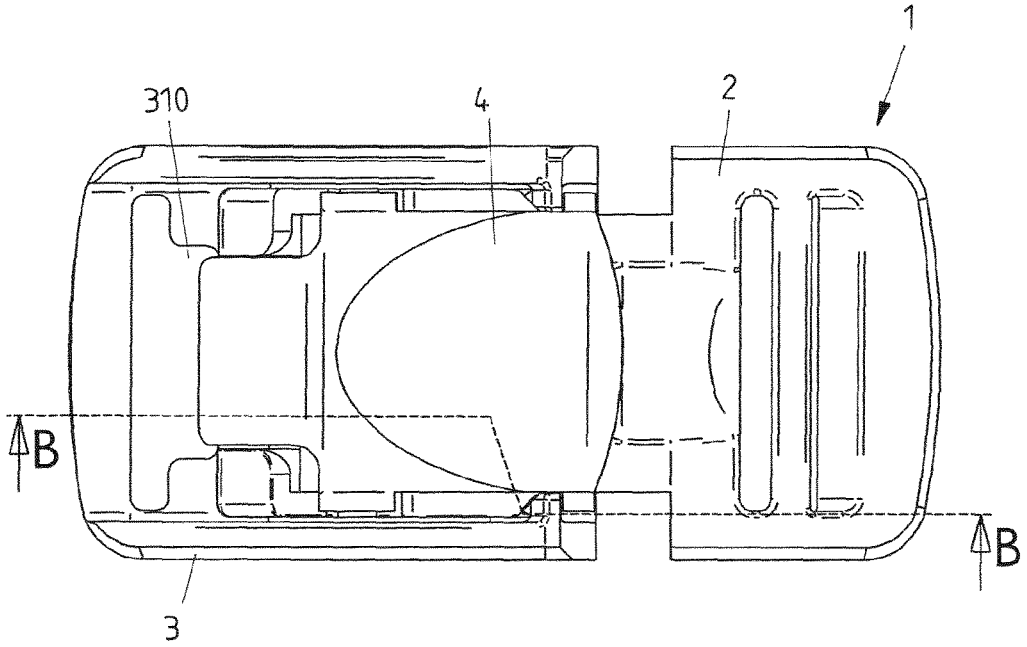
FIGS. 27A-27D show top views of the closure devices in different positions.
Figure 28A:
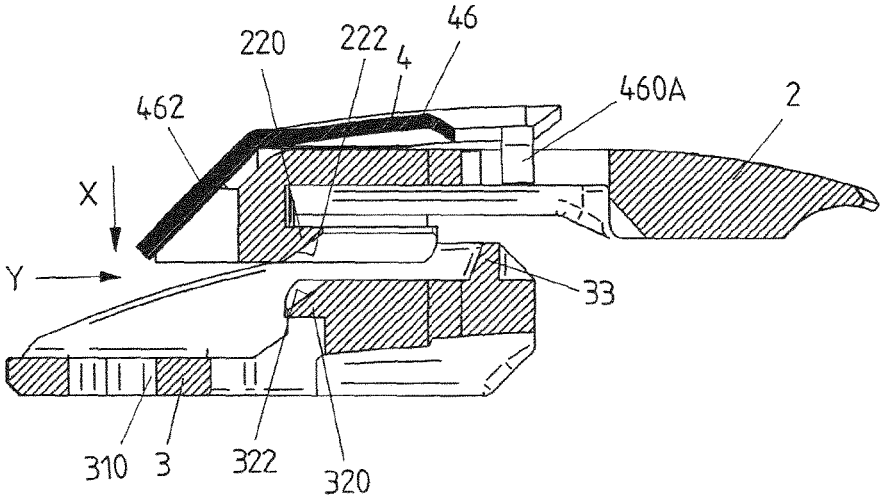
FIGS. 28A-28D show sectional views along line B-B according to the respectively associated FIG. 27A-27D.

For attaching the first closure part 2 to the second closure part 3 for closing the closure device 1, the first closure part 2 is approached to the second closure part 3 in closing direction X, as shown in FIGS. 27A, 28A. By magnets 25, 35 at the closure parts 2, 3 (or a magnet at a closure part 2, 3 and a magnetic armature at the other closure part 3, 2) this closing operation is magnetically supported, in that the closure parts 2, 3 are magnetically attracted to each other.

Figure 27B:
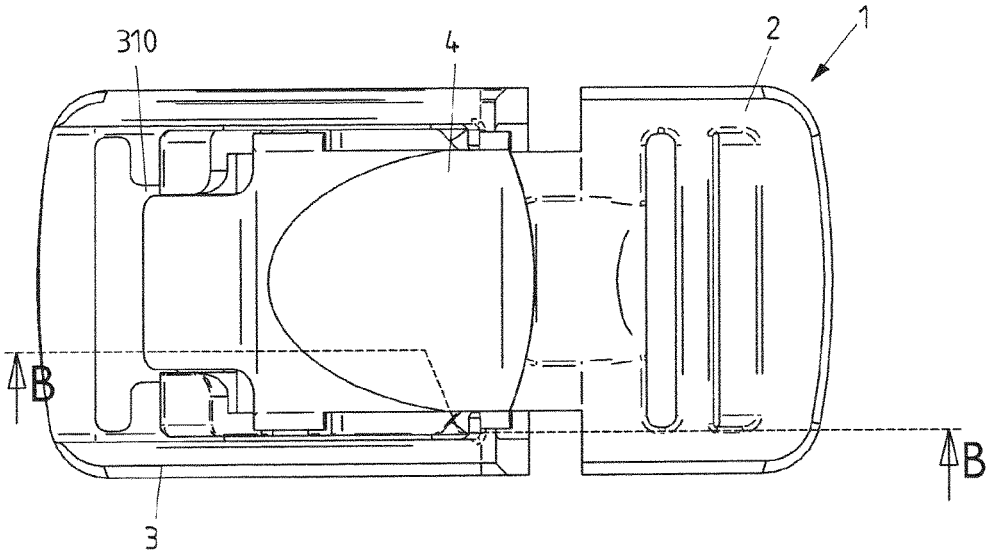
Figure 28B:
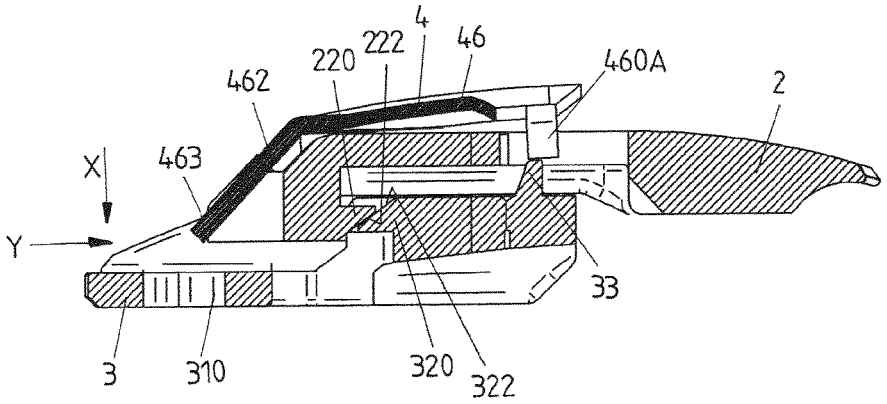

As shown in FIGS. 27B, 28B, run-up slopes 222, 322 at the engaging protrusions 220, 221, 320, 321 impinge on each other and run up onto each other such that the first closure part 2 is offset relative to the second closure part 3 against the engaging direction Y, so that the first closure part with its engaging protrusions 220, 221 can slide past the engaging protrusions 320, 321 and can get in engagement with the engaging protrusions 320, 321.

Figure 27C:
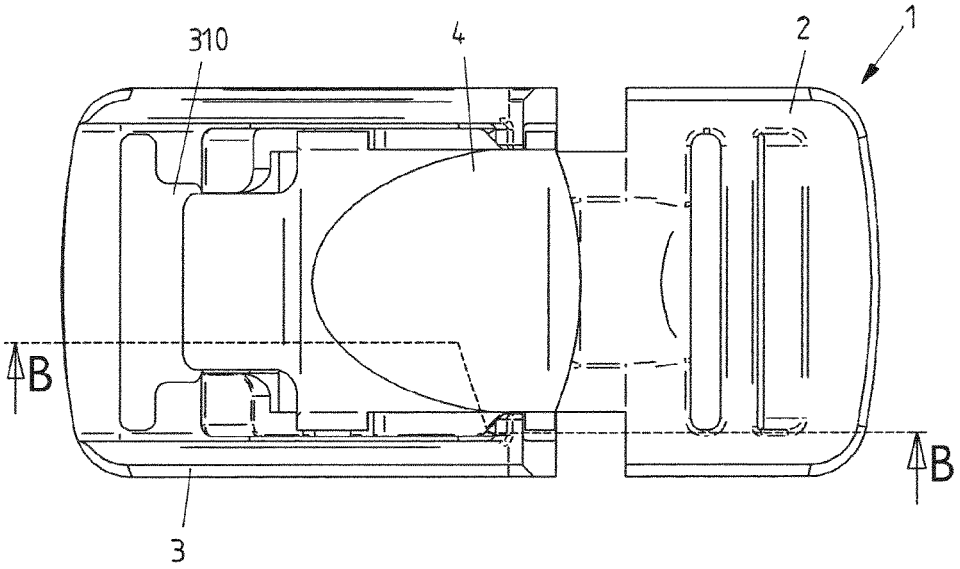
Figure 28C:
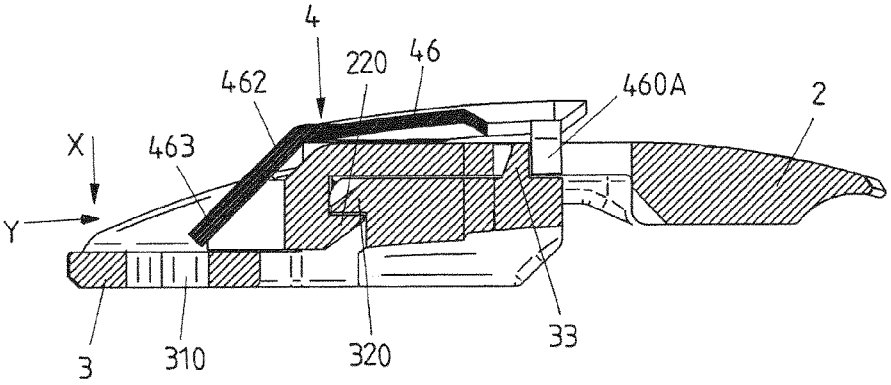

In the closed position, shown in FIGS. 27C, 28C, the engaging protrusions 220, 221, 320, 321 of the closure parts 2, 3 positively are in engagement with each other, so that in particular loads which act between the closure parts 2, 3 in engagement direction Y can effectively be absorbed.

At the base body of the first closure part 2 a web guide 207 is provided, which on attachment of the closure parts 2, 3 gets in engagement with a groove guide 300 at the base body 30 of the second closure part 3. The closure parts 2, 3 thereby are fixed to each other transversely to the closing direction X and transversely to the engagement direction Y, so that a displacement of the closure parts relative to each other only is possible along the engagement direction Y. The mechanical stability of the closure device 1 thereby is improved.

When attaching the closure parts 2, 3 to each other, the blocking noses 460A, 460B at the lever element 46 of the actuating mechanism 4 also impinge on the rigid blocking elements 33, 34 of the second closure part 3. The lever element 46 initially slightly backs away and is pivoted, as is shown in FIG. 28B. In the closed position, the blocking noses 460A, 460B come to lie behind the blocking elements 33, 34 as seen in engagement direction Y, so that a displacement of the first closure part 2 against the engagement direction Y relative to the second closure part 3 is blocked, as is shown in FIG. 28C. In the closed position, the closure parts 2, 3 thus are positively held at each other in engagement direction Y and blocked relative to each other against the engagement direction Y.

Figure 27D:
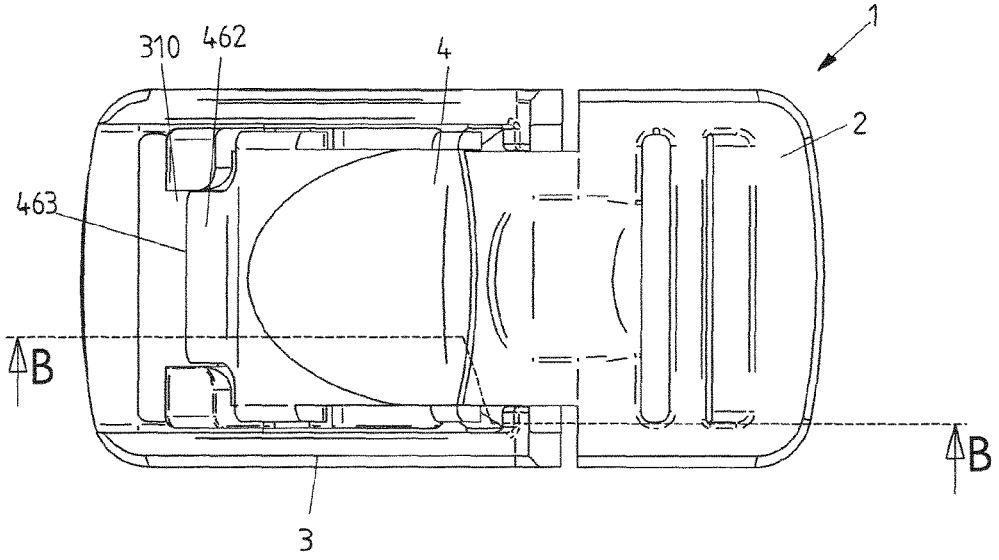
Figure 28D:
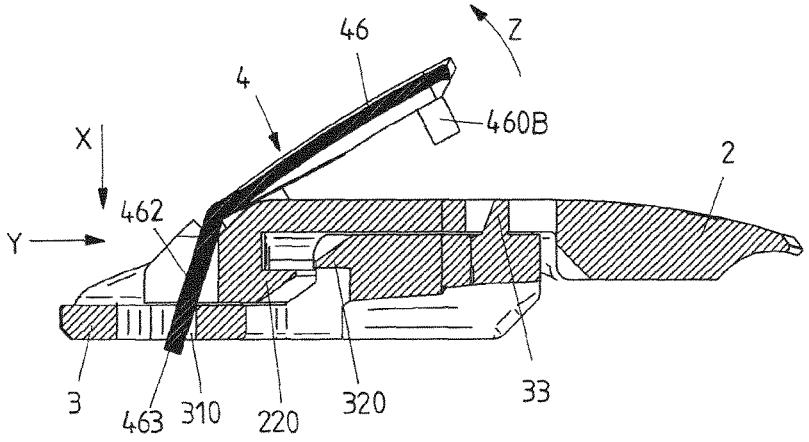

For opening, the lever element 46 is actuated and for this purpose pivoted in an opening direction Z, as is shown in FIGS. 27D, 28D. The blocking noses 460A, 460B at the lever element 46 thereby get out of the region of the blocking elements 33, 34 at the second closure part 3, so that the blockage between the closure parts 2, 3 is eliminated.

In addition, on actuation of the lever element 46 an end 463 of a lever portion 462 of the lever element 46 remote from the blocking noses 460A, 460B gets in engagement with an opening 310 in the base body 30 of the second closure part 3. By acting on an edge portion of this opening 310, a lever force is produced on the first closure part 2 against the engagement direction Y, which on actuation of the lever element 46 pushes the second closure part 2 with its engaging protrusions 220, 221 out of engagement with the engaging protrusions 320, 321 of the second closure part 3, as is shown in FIG. 28D.

The lever element thus on the one hand serves for blocking the closure parts 2, 3 relative to each other in the closed position and on the other hand for supporting the opening operation for separating the closure parts 2, 3 from each other.

The lever element 46 for example can be manufactured as metal part, for example as sheet-metal part of a ferromagnetic material. This has the advantage that a magnet 25 at the first closure part 2 attractingly acts on the lever element 46 and brings the same into a starting position in which the closure parts 2, 3 can be attached to each other. In this starting position, the blocking noses 460A, 460B at the lever element 46 are in a position in which they blockingly get in contact with the blocking elements 33, 34, when the closure parts 2, 3 are attached to each other. Due to the magnetic effect on the lever element 46, the lever element 46 also is held in this position when the closure device 1 is in the closed position, so that the closure parts 2, 3 are blocked in their position (FIG. 28C).

In addition, the lever element 46 for example also can be biased in direction of its starting position with respect to the base body 20 of the first closure part 2 via a mechanical spring element, so that after actuation the lever element 46 also is set back into its starting position due to the mechanical spring action.

Such mechanical spring bias is expedient in particular when no magnetic mechanism are provided at the closure parts 2, 3 and the closure device 1 thus is designed purely mechanical or when a magnetic armature (only) is provided at the first closure part 2.

Setting back the lever element 46 also can be effected by interaction of the lever portion 462 with the second closure part 3, in that on attachment of the closure parts 2, 3 the lever portion 462 gets in contact with the second closure part 3 and the lever element 46 thereby is set back into its starting position.

The idea underlying the invention is not limited to the exemplary embodiments described above, but can also be realized in completely different embodiments.

The application possibilities for a closure device as described here are manifold. In particular, closure devices as described here can be used for connecting two parts, for example for connecting two belts, straps, cables, cords or the like or also as closure for a bag, a cover, a box, a glove box, or some other container. Closures as described here can also be used for connecting other parts, for example for connecting objects at a backpack, a jacket or trousers, as closure for school satchels, for fixing objects at a sports helmet, for fixing mobile phones or computers at holders, for fixing accessories such as e.g. a bicycle lock at a bicycle or for connecting other parts.

LIST OF REFERENCE NUMERALS

1 closure device
2 closure part
20 base body
200 receiving space
200A, 200B gap
201 housing cover
202 object
203, 204 openings
205, 206 pin
207 guide web
21 belt webbing receptacle
22 engaging mechanism
220, 221 engaging protrusion
222 run-up slope
223 rounded portion
224 cutout
23, 24 blocking nose
25 magnet
250 magnet receptacle
26 pin receptacle
27 blocking element
28 platform
280 ramp
3 closure part
30 base body
300 guiding groove
31 belt webbing receptacle
310 opening
32 engaging mechanism
320, 321 engaging protrusion
322 run-up slope
33, 34 blocking element
330, 340 run-up slope
331, 341 opening
332 cutout
333 bevel
35 magnet
350 magnet receptacle
36 pin
37 stop
4 actuating mechanism
40 base body
40A, 40B actuating part
400A, 400B blocking nose
401 opening
41 retaining element
42, 43 actuating nose
420, 430 run-up slope
44 guide elements
45 spring element
46 lever
460A, 460B blocking engagement element (blocking nose)
461A, 461B tabs
462 lever portion
463 end
5 housing
50 base body
500 opening
501 stop
51 bottom
510 elevation
511 magnet receptacle
52 magnet
B actuating direction
F load direction
S pivot axis
X closing direction
Y engagement direction
Y' release direction
Z opening direction

The invention claimed is:

1. A closure device for releasably connecting two parts, comprising:

a first closure part and a second closure part, wherein the first closure part is attachable to the second closure part for closing the closure device and, in a closed position, is mechanically fixed to the second closure part, a first engaging protrusion of the first closure part and a second engaging protrusion of the second closure part, wherein the first engaging protrusion is engageable with the second engaging protrusion in an engagement direction, a blocking element arranged on one of the first closure part and the second closure part, wherein the blocking element is spaced apart, when viewed along the engagement direction, from the engaging protrusion on the closure part on which the blocking element is arranged, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and, wherein the blocking element during or after establishment of the engagement, is reset into its normal position so that in the normal position the positive engagement of the first engaging protrusion with the second engaging protrusion is locked, and a magnetic mechanism formed to act between the first closure part and the second closure part in order to support the attachment of the first closure part to the second closure part by providing a force of magnetic attraction.

2. The closure device according to claim 1, wherein the first engaging protrusion and the second engaging protrusion are rigidly formed at a base body of the respectively associated closure part.

3. The closure device according to claim 1, wherein the engagement direction is directed along a load direction in which a load acts when the closure device is properly used.

4. The closure device according to claim 1, wherein the blocking element is realized by a blocking tongue arranged at a base body of the second closure part, which is formed to elastically back away from its normal position during attachment of the first closure part to the second closure part in a direction transverse to the engagement direction and again get back into its normal position during or after production of the engagement.

5. The closure device according to claim 1, wherein, in the closed position, the blocking element blockingly acts on a blocking nose arranged on the other of the first closure part and the second closure part and different from the engaging protrusion of the other of the first closure part and the second closure part.

6. The closure device according to claim 1, further comprising an actuating mechanism for opening the closure device, which is formed to act on the blocking element upon actuation, in order to eliminate the blockage of the engagement between the first engaging protrusion and the second engaging protrusion by moving the blocking element out of its normal position.

7. The closure device according to claim 1, further comprising an actuating mechanism for opening the closure device, the actuation mechanism being formed such that on actuation a blocking nose of the blocking element is moved in order to release the locking of the engagement between the first engaging protrusion and the second engaging protrusion.

8. The closure device according to claim 7, wherein the actuating mechanism includes a lever element pivotally arranged on a base body of the one of the first closure part and the second closure part about a pivot axis, the lever element comprising the blocking nose.

9. The closure device according to claim 8, wherein the lever element includes a lever portion which on pivoting the lever element for opening the closure device operatively interacts with the other of the first closure part and the second closure part such that a force on the first closure part relative to the second closure part opposite to the engagement direction is produced.

10. The closure device according to claim 1, wherein for opening the closure device the first closure part or a part of the first closure part is to be moved relative to the second closure part, in order to eliminate the blockage of the engagement between the first engaging protrusion and the second engaging protrusion and/or the positive engagement between the first engaging protrusion and the second engaging protrusion.

11. The closure device according to claim 10, wherein at the first closure part and/or at the second closure part a ramp is arranged, which is formed to separate the first closure part from the second closure part in a direction vertical to the engagement direction, when moving the first closure part or the part of the first closure part.

12. The closure device according to claim 1, wherein the blocking element is formed such that the locking of the engagement between the first engaging protrusion and the second engaging protrusion is released if a force larger than a threshold force is applied on the first closure part in a direction opposite the engagement direction.

13. The closure device according to claim 1, wherein at least one of the first closure part and the second closure part include a slope section formed such that, on attachment of the first closure part to the second closure part in a closing direction different from the engagement direction, the first engaging protrusion is guided relative to the second engaging protrusion to move the first closure part opposite to the engagement direction until the first engaging protrusion is engageable with the second engaging protrusion.

14. The closure device according to claim 1, wherein the magnetic mechanism is formed by a first magnet of the first closure part and a second magnet of the second closure part, which magnetically attract each other on attachment of the first closure part to the second closure part, wherein the first magnet and the second magnet are offset to each other in the closed position, when viewed along the engagement direction, such that in the closed position a component of the force of magnetic attraction acts on the first closure part in the engagement direction.

15. The closure device according to claim 1, wherein the first closure part comprises two first engaging portions extending at an angle with respect to each other, and the second closure part comprises two second engaging protrusions extending at an angle with respect to each other.

16. The closure device according to claim 1, wherein the first closure element or the second closure element are retractably arranged at a housing such that in a retracted position the closure part is at least partly enclosed by the housing and on attachment of the first closure part to the second closure part for producing the engagement is extended from its retracted position.

17. A belt buckle, comprising:

a first closure part and a second closure part, wherein the first closure part is attachable to the second closure part for closing the belt buckle and, in a closed position, is mechanically fixed to the second closure part, a first engaging protrusion of the first closure part and a second engaging protrusion of the second closure part, wherein the first engaging protrusion is engageable with the second engaging protrusion in an engagement direction, and a blocking element arranged on one of the first closure part and the second closure part, wherein the blocking element is spaced apart, when viewed along the engagement direction, from the engaging protrusion on the closure part on which the blocking element is arranged, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and wherein the blocking element during or after establishment of the engagement is reset into its normal position so that in the normal position the positive engagement of the first engaging protrusion with the second engaging protrusion is locked, wherein at least one of the first closure part and the second closure part comprises a belt webbing receptacle for receiving a belt, wherein in a loaded condition load forces act in between the closure parts along a load direction such that the first closure part is loaded relative to the second closure part in the engagement direction.

18. A closure device for releasably connecting two parts, comprising:

a first closure part and a second closure part, wherein the first closure part is attachable to the second closure part for closing the closure device and in a closed position is mechanically fixed to the second closure part, wherein the first closure part comprises two first engaging protrusions extending at an angle with respect to each other, and the second closure part comprises two second engaging protrusions extending at an angle with respect to each other, wherein the first engaging protrusions and the second engaging protrusions are moved into the closed position in a closing direction, wherein the first engaging protrusions are engageable with the second engaging protrusions in an engagement direction substantially perpendicular to the closing direction such that in the closed position the first engaging protrusions and the second engaging protrusions are in a positive locking engagement with each other, the positive locking engagement being operative to receive load forces acting on the first closure part with respect to the second closure part in the engagement direction, the closure device further comprising a magnetic mechanism formed to act between the first closure part and the second closure part in order to support the attachment of the first closure part to the second closure part by providing a force of magnetic attraction.

19. A closure device for releasably connecting two parts, comprising:

a first closure part and a second closure part, wherein the first closure part is attachable to the second closure part for closing the closure device and, in a closed position, is mechanically fixed to the second closure part, a first engaging protrusion of the first closure part and a second engaging protrusion of the second closure part, wherein the first engaging protrusion is engageable with the second engaging protrusion in an engagement direction, a blocking element arranged on one of the first closure part and the second closure part, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and, wherein the blocking element during or after establishment of the engagement, is reset into its normal position so that in the normal position the positive engagement of the first engaging protrusion with the second engaging protrusion is locked, a magnetic mechanism formed to act between the first closure part and the second closure part in order to support the attachment of the first closure part to the second closure part by providing a force of magnetic attraction, and an actuating mechanism for opening the closure device, the actuation mechanism being formed such that on actuation a blocking nose of the blocking element is moved in order to release the locking of the engagement between the first engaging protrusion and the second engaging protrusion, wherein the actuating mechanism includes a lever element pivotally arranged on a base body of the one of the first closure part and the second closure part about a pivot axis, the lever element comprising the blocking nose.

20. A closure device for releasably connecting two parts, comprising:

a first closure part and a second closure part, wherein the first closure part is attachable to the second closure part for closing the closure device and, in a closed position, is mechanically fixed to the second closure part, a first engaging protrusion of the first closure part and a second engaging protrusion of the second closure part, wherein the first engaging protrusion is engageable with the second engaging protrusion in an engagement direction, a blocking element arranged on one of the first closure part and the second closure part, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and, wherein the blocking element during or after establishment of the engagement, is reset into its normal position so that in the normal position the positive engagement of the first engaging protrusion with the second engaging protrusion is locked, and a magnetic mechanism formed to act between the first closure part and the second closure part in order to support the attachment of the first closure part to the second closure part by providing a force of magnetic attraction, wherein at least one of the first closure part and the second closure part include a slope section formed such that, on attachment of the first closure part to the second closure part in a closing direction different from the engagement direction, the first engaging protrusion is guided relative to the second engaging protrusion to move the first closure part opposite to the engagement direction until the first engaging protrusion is engageable with the second engaging protrusion.

21. A closure device for releasably connecting two parts, comprising:

a first closure part and a second closure part, wherein the first closure part is attachable to the second closure part for closing the closure device and, in a closed position, is mechanically fixed to the second closure part, a first engaging protrusion of the first closure part and a second engaging protrusion of the second closure part, wherein the first engaging protrusion is engageable with the second engaging protrusion in an engagement direction, a blocking element arranged on one of the first closure part and the second closure part, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and, wherein the blocking element during or after establishment of the engagement, is reset into its normal position so that in the normal position the positive engagement of the first engaging protrusion with the second engaging protrusion is locked, and a magnetic mechanism formed to act between the first closure part and the second closure part in order to support the attachment of the first closure part to the second closure part by providing a force of magnetic attraction, wherein the magnetic mechanism is formed by a first magnet of the first closure part and a second magnet of the second closure part, which magnetically attract each other on attachment of the first closure part to the second closure part, wherein the first magnet and the second magnet are offset to each other in the closed position, when viewed along the engagement direction, such that in the closed position a component of the force of magnetic attraction acts on the first closure part in the engagement direction.

22. A closure device for releasably connecting two parts, comprising:

a first closure part and a second closure part, wherein the first closure part is attachable to the second closure part for closing the closure device and, in a closed position, is mechanically fixed to the second closure part, a first engaging protrusion of the first closure part and a second engaging protrusion of the second closure part, wherein the first engaging protrusion is engageable with the second engaging protrusion in an engagement direction, a blocking element arranged on one of the first closure part and the second closure part, wherein, on attachment of the first closure part to the second closure part, the blocking element is moved out of a normal position by cooperating with the other of the first closure part and the second closure part so that the first engaging protrusion is brought in engagement with the second engaging protrusion in the engagement direction, and, wherein the blocking element during or after establishment of the engagement, is reset into its normal position so that in the normal position the positive engagement of the first engaging protrusion with the second engaging protrusion is locked, and a magnetic mechanism formed to act between the first closure part and the second closure part in order to support the attachment of the first closure part to the second closure part by providing a force of magnetic attraction, wherein the first closure part comprises two first engaging portions extending at an angle with respect to each other, and the second closure part comprises two second engaging protrusions extending at an angle with respect to each other.

* * * * *